US009754544B2

(12) United States Patent
Tamaki et al.

(10) Patent No.: US 9,754,544 B2
(45) Date of Patent: Sep. 5, 2017

(54) IMAGE DISPLAY DEVICE, ELECTRONIC APPARATUS, AND METHOD FOR DRIVING IMAGE DISPLAY DEVICE

(71) Applicant: Japan Display Inc., Tokyo (JP)

(72) Inventors: Masaya Tamaki, Tokyo (JP); Amane Higashi, Tokyo (JP)

(73) Assignee: Japan Display Inc., Tokyo (JP)

( * ) Notice: Subject to any disclaimer, the term of this patent is extended or adjusted under 35 U.S.C. 154(b) by 85 days.

(21) Appl. No.: 14/854,955

(22) Filed: Sep. 15, 2015

(65) Prior Publication Data

US 2016/0078828 A1 Mar. 17, 2016

(30) Foreign Application Priority Data

Sep. 16, 2014 (JP) ..... 2014-188162

(51) Int. Cl.
*G09G 5/10* (2006.01)
*G09G 3/36* (2006.01)

(52) U.S. Cl.
CPC ... *G09G 3/3607* (2013.01); *G09G 2300/0452* (2013.01); *G09G 2340/06* (2013.01)

(58) Field of Classification Search
CPC ..... G09G 3/3607; G09G 2340/06; G09G 2300/0452
USPC ..... 345/690
See application file for complete search history.

(56) References Cited

U.S. PATENT DOCUMENTS

2005/0062767 A1* 3/2005 Choe ..... G09G 3/3607 345/694
2005/0275610 A1* 12/2005 Roh ..... G09G 3/3614 345/88
2009/0322802 A1* 12/2009 Noguchi ..... G09G 3/2003 345/694
2011/0181634 A1* 7/2011 Higashi ..... G09G 3/3426 345/691
2013/0027441 A1* 1/2013 Kabe ..... G09G 3/3413 345/690

FOREIGN PATENT DOCUMENTS

JP 2011-154321 A 8/2011
JP 2013-186294 9/2013

* cited by examiner

*Primary Examiner* — Adam R Giesy
*Assistant Examiner* — Chineyere Wills-Burns
(74) *Attorney, Agent, or Firm* — Michael Best & Friedrich LLP

(57) ABSTRACT

According to an aspect, a display device includes: an image display panel in which pixel units each including a first pixel including a first, a second, and a third sub pixels, and a second pixel including the first, the second, and a fourth sub pixels are periodically arranged; and a signal processing unit. The signal processing unit obtains a corrected output signal of the third sub pixel of the first pixel based on an input signal of the third sub pixel of the first pixel and an input signal of the third sub pixel of the second pixel of the same pixel unit, and obtains a corrected output signal of the fourth sub pixel of the second pixel based on an input signal of the fourth sub pixel of the first pixel of the same pixel unit and an input signal of the fourth sub pixel of the second pixel.

14 Claims, 25 Drawing Sheets

IMAGE DISPLAY DEVICE, ELECTRONIC APPARATUS, AND METHOD FOR DRIVING IMAGE DISPLAY DEVICE

CROSS-REFERENCE TO RELATED APPLICATIONS

This application claims priority from Japanese Application No. 2014-188162, filed on Sep. 16, 2014, the contents of which are incorporated by reference herein in its entirety.

BACKGROUND

1. Technical Field

The present disclosure relates to an image display device, an electronic apparatus, and a method for driving an image display device.

2. Description of the Related Art

Display devices such as liquid crystal display devices include transmissive display devices and reflective display devices. Transmissive display devices display images with light transmitted through a liquid crystal panel by emitting the light from a backlight provided on the back side of the liquid crystal panel. Reflective display devices display images with reflected light obtained by reflecting light emitted from the front of a liquid crystal panel toward the liquid crystal panel.

There is a technique in which a white sub pixel serving as a fourth sub pixel is added to red, green, and blue sub pixels serving as first to third sub pixels of a related art. As described in Japanese Patent Application Laid-open Publication No. 2011-154321 (JP-A-2011-154321), there is an image display panel in which pixel units including a first pixel including first, second, and third sub pixels and a second pixel including first, second, and fourth sub pixels are arranged in a two-dimensional (2D) matrix form.

According to JP-A-2011-154321, the first pixel does not include the fourth sub pixel, and the second pixel does not include the third sub pixel. Thus, for example, when it is desired to display a color of the fourth sub pixel, it is difficult for the first pixel to express the color. Similarly, when it is desired to display a color of the third sub pixel, it is difficult for the second pixel to express the color. Thus, in this case, an image to be displayed is likely to deteriorate.

For the foregoing reasons, there is a need for an image display device, an electronic apparatus, and a method for driving an image display device that can reduce deterioration of an image.

SUMMARY

According to an aspect, an image display device includes: an image display panel in which pixel units each of which includes a first pixel and a second pixel are periodically arranged in a two dimensional matrix form, the first pixel including a first sub pixel displaying a first color, a second sub pixel displaying a second color, and a third sub pixel displaying a third color, the second pixel including the first sub pixel, the second sub pixel, and a fourth sub pixel displaying a fourth color, the second pixel being adjacent to the first pixel; and a signal processing unit that generates an output signal by converting an input value of an input signal into an extension value of a color space extended by the first color, the second color, the third color, and the fourth color, and outputs the generated output signal to the image display panel. The signal processing unit obtains an output signal of the first sub pixel of the first pixel based on an input signal of the first sub pixel of the first pixel, and outputs the output signal of the first sub pixel to the first sub pixel of the first pixel. The signal processing unit obtains an output signal of the second sub pixel of the first pixel based on the input signal of the first sub pixel, an input signal of the third sub pixel, and an input signal of the fourth sub pixel of the first pixel, and outputs the output signal of the second sub pixel to the second sub pixel of the first pixel. The signal processing unit obtains an output signal of the first sub pixel of the second pixel based on an input signal of the first sub pixel of the second pixel, and outputs the output signal of the first sub pixel to the first sub pixel of the second pixel. The signal processing unit obtains an output signal of the second sub pixel of the second pixel based on the input signal of the first sub pixel, the input signal of the third sub pixel, and the input signal of the fourth sub pixel of the second pixel, and outputs the output signal of the second sub pixel to the second sub pixel of the second pixel. The signal processing unit obtains a corrected output signal of the third sub pixel of the first pixel based on the input signal of the third sub pixel of the first pixel and the input signal of the third sub pixel of the second pixel of the same pixel unit, and outputs the corrected output signal of the third sub pixel to the third sub pixel of the first pixel. The signal processing unit obtains a corrected output signal of the fourth sub pixel of the second pixel based on the input signal of the fourth sub pixel of the first pixel of the same pixel unit and the input signal of the fourth sub pixel of the second pixel, and outputs the corrected output signal of the fourth sub pixel to the fourth sub pixel of the second pixel.

DETAILED DESCRIPTION

Figure 1:
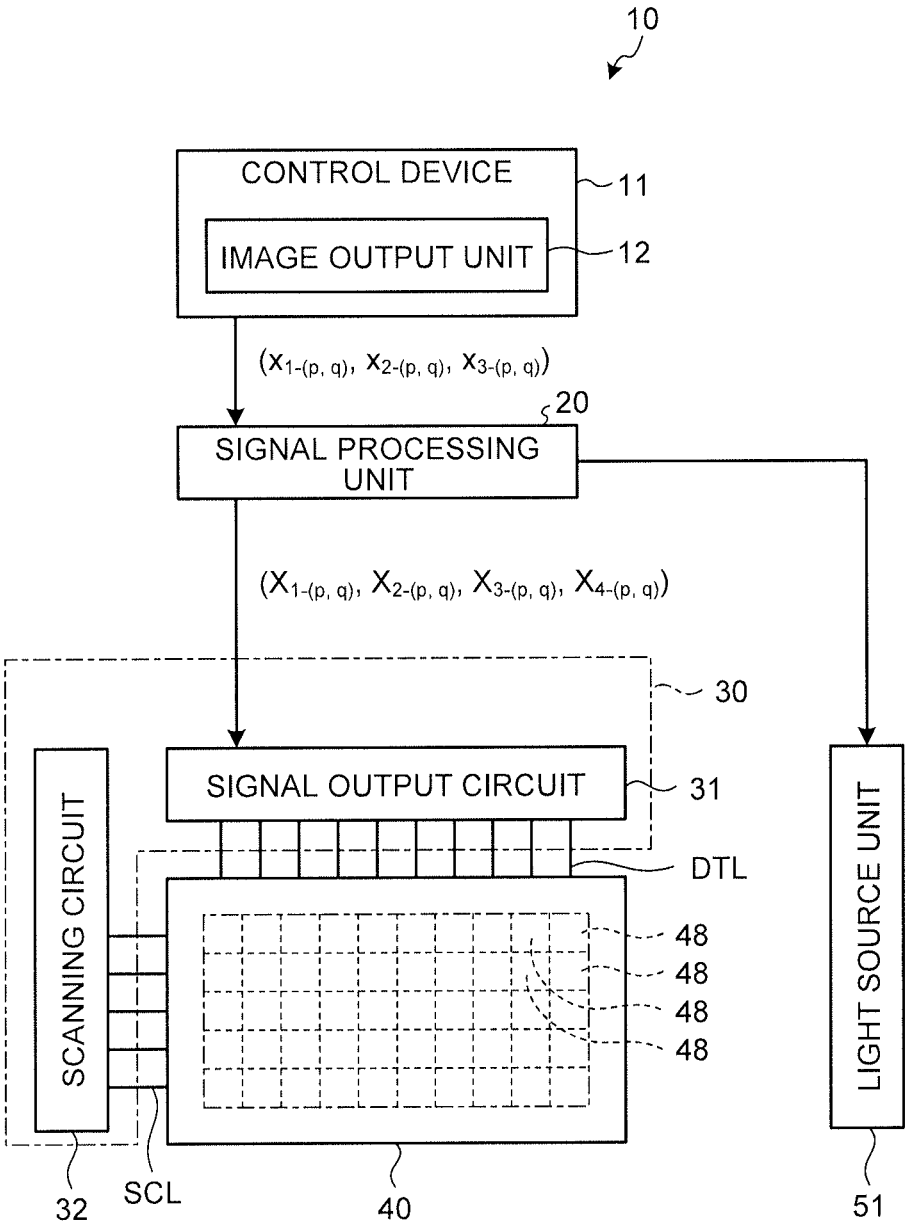
FIG. 1 is a block diagram illustrating an example of a configuration of a display device according to a first embodiment.

Embodiments of the present disclosure will be described in detail in the following order with reference to the appended drawings.

1. Embodiments
2. Application Examples

1. Embodiments

Hereinafter, embodiments of the present disclosure will be described with reference to the appended drawings. The disclosure is merely an example, and of course, appropriate modifications that are easily derived by those having skill in the art within the gist of the invention are included in the scope of the present invention. In order to further clarify the drawings, there are cases in which, for example, the width, the thickness, or the shape of each unit are illustrated schematically compared to an actual form, but it is merely an example and not intended to limit an interpretation of the present invention. In the present specification and the respective drawings, the same elements as those in the already-described drawings are denoted by the same reference numerals, and a detailed description thereof will be appropriately omitted.

First Embodiment

Overall Configuration of Display Device

Figure 2:
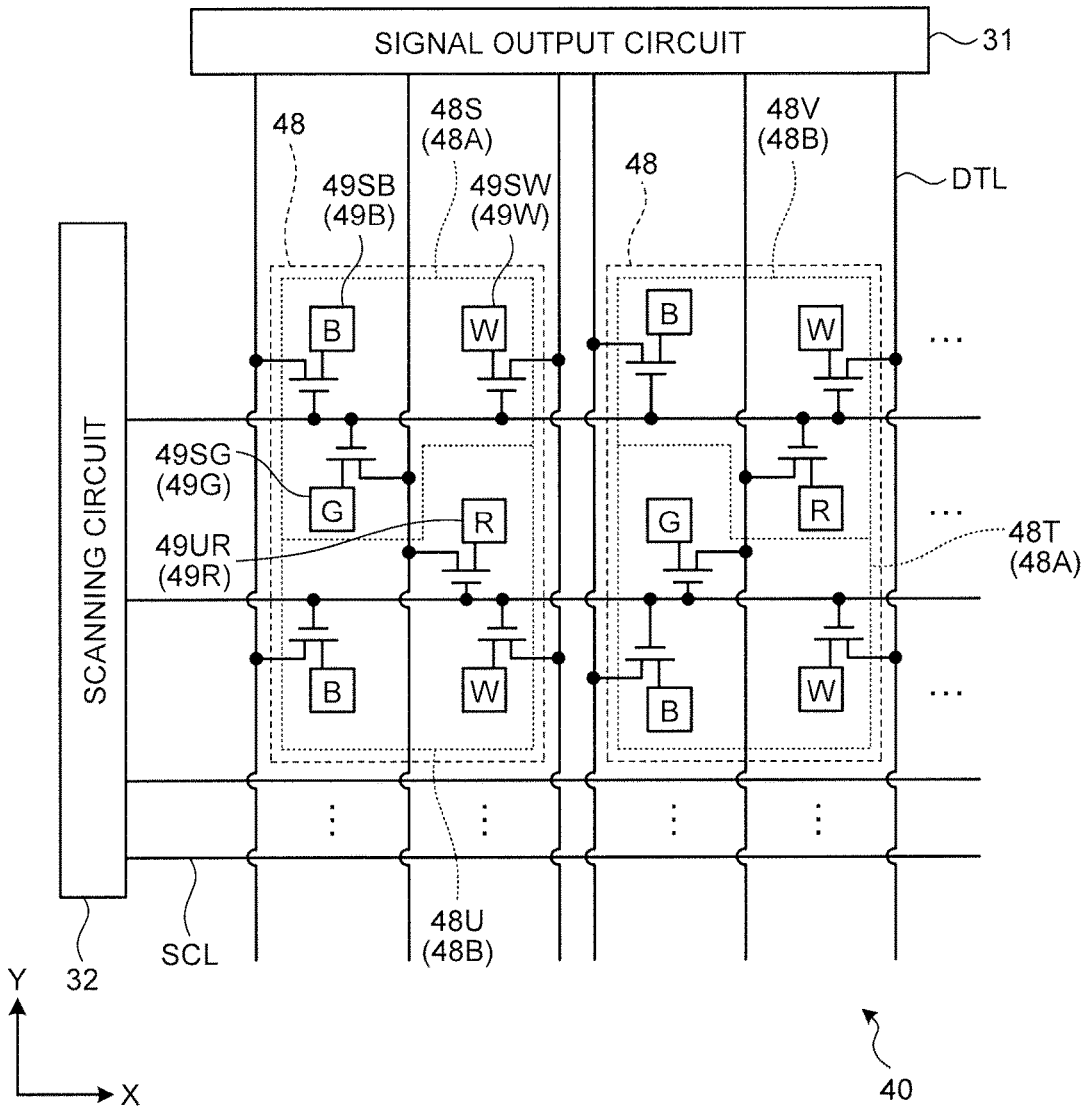
FIG. 2 is a conceptual diagram of an image display panel according to the first embodiment.

FIG. 1 is a block diagram illustrating an example of a configuration of a display device according to a first embodiment. FIG. 2 is a conceptual diagram of an image display panel according to the first embodiment. A display device 10 of the first embodiment includes a signal processing unit 20, an image-display-panel driving unit 30, an image display panel 40, and a light source unit 51 as illustrated in FIG. 1. The signal processing unit 20 receives an input signal (RGB data) from an image output unit 12 of a control device 11, and transfers a signal generated by performing a certain data conversion process on the input signal to the respective units of the display device 10. The image-display-panel driving unit 30 controls driving of the image display panel 40 based on the signal from the signal processing unit 20. The image display panel 40 displays an image based on the signal from the image-display-panel driving unit 30. The display device 10 displays an image by reflecting ambient light by the image display panel 40. When used outdoor during the night or in a dark place in which ambient light is insufficient, the display device 10 can display an image by reflecting light emitted from the light source unit 51 by the image display panel 40.

Configuration of Signal Processing Unit

The signal processing unit 20 is an arithmetic processing unit that controls an operation of the image display panel 40 through the image-display-panel driving unit 30 as illustrated in FIG. 1. The signal processing unit 20 is coupled with the image-display-panel driving unit 30 and the light source unit 51.

The signal processing unit 20 processes an input signal input from an external application processor (a host CPU) (not illustrated), and generates an output signal. The signal processing unit 20 converts an input value of the input signal into an extension value (output signal) of an extended color space (a HSV color space in the first embodiment) extended by a first color, a second color, a third color, and a fourth color to generate the output signal. The signal processing unit 20 outputs the generated output signal to the image-display-panel driving unit 30. The first color, the second color, the third color, and the fourth color will be described later. In the first embodiment, the extended color space is the HSV (Hue-Saturation-Value, Value is also called Brightness) color space but not limited to this example. The extended color space may be any other coordinate system such as an XYZ color space, a YUV space.

Figure 3:
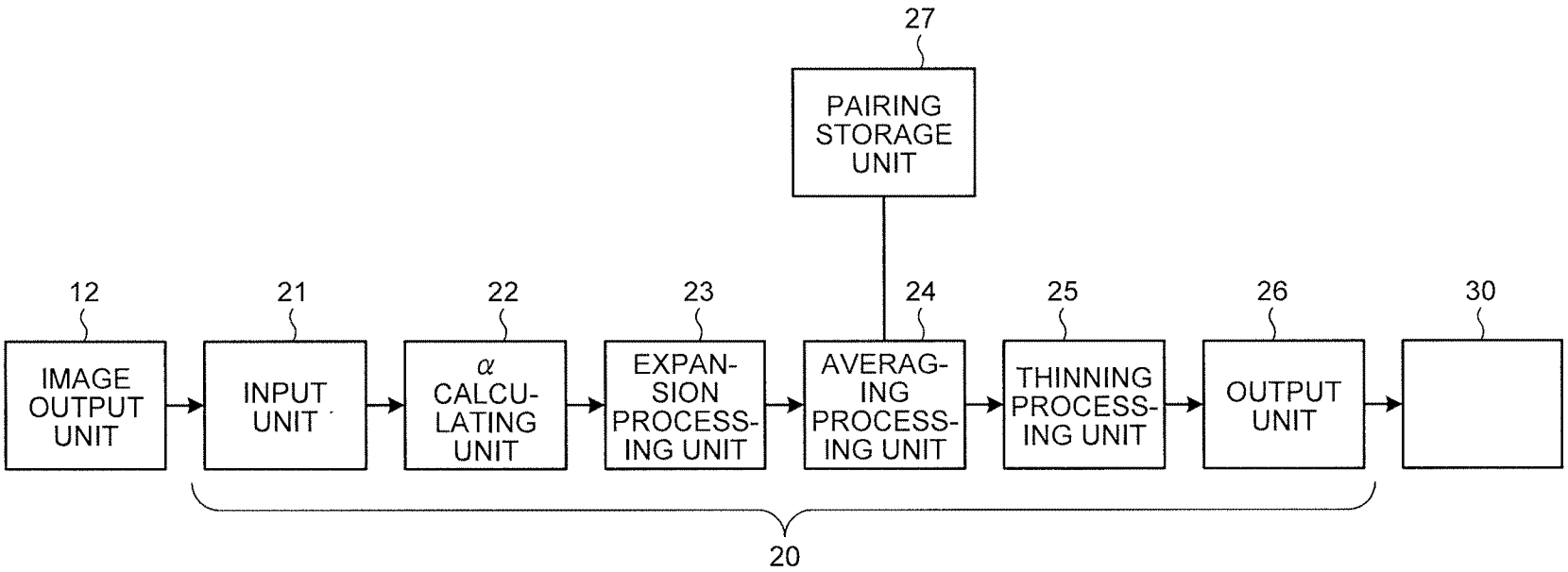
FIG. 3 is a block diagram illustrating a concept of a configuration of a signal processing unit according to the first embodiment.

FIG. 3 is a block diagram illustrating an overview of a configuration of a signal processing unit according to the first embodiment. The signal processing unit 20 includes an input unit 21, an $\alpha$ calculating unit 22, an expansion processing unit 23, an averaging processing unit 24, a thinning processing unit 25, an output unit 26, and a pairing storage unit 27 as illustrated in FIG. 3.

The input unit 21 receives the input signal from the image output unit 12 of the control device 11. The $\alpha$ calculating unit 22 calculates an expansion coefficient $\alpha$ based on the input signal input to the input unit 21. A process of calculating the expansion coefficient $\alpha$ will be described later. The expansion processing unit 23 performs an expansion process on the input signal using the expansion coefficient $\alpha$ calculated by the $\alpha$ calculating unit 22 and the input signal input to the input unit 21. In other words, the expansion processing unit 23 converts the input value of the input signal into an extension value of the extended color space (the HSV color space in the first embodiment) extended by the first color, the second color, the third color, and the fourth color to generate an output signal having color information of the first to fourth colors. The expansion process will be described later.

The pairing storage unit 27 stores information on each pixel serving as a pairing counterpart used for the averaging process performed on each of pixels included in the image display panel 40. The averaging processing unit 24 generates a corrected output signal by performing the averaging process based on a generation signal of a sub pixel in the pixels included in the image display panel 40 and a generation signal of a sub pixel in the pixel serving as the pairing counterpart indicated in the information stored in the pairing storage unit 27. The averaging process will be described later.

The thinning processing unit 25 thins out the output signal by excluding the color information of the third color or the color information of the fourth color from the output signal having the color information of the first to fourth colors. In other words, the thinning processing unit 25 generates a thinned output signal having the color information of the first to third colors or a thinned output signal having the color information of the first color, the second color, and the fourth color from the output signal having the color information of the first to fourth colors. The output unit 26 outputs the thinned output signal generated by the thinning processing unit 25 to the image-display-panel driving unit 30. The above-mentioned signal processing of the signal processing unit 20 is merely an example and not intended to limit an interpretation of the present invention.

Configuration of Image-Display-Panel Driving Unit

The image-display-panel driving unit 30 includes a signal output circuit 31 and a scanning circuit 32 as illustrated in FIGS. 1 and 2. The image-display-panel driving unit 30 holds a video signal in the signal output circuit 31 and sequentially outputs the video signal to the image display panel 40 from the signal output circuit 31. More specifically, the signal output circuit 31 outputs an image output signal having a certain potential according to the output signal of the signal processing unit 20 to the image display panel 40. The signal output circuit 31 is electrically coupled with the image display panel 40 via a signal line DTL. The scanning circuit 32 controls an ON/OFF operation of a switching element (for example, a TFT) for controlling operations (light transmittance) of sub pixels 49 in the image display panel 40. The scanning circuit 32 is electrically coupled with the image display panel 40 via a scanning SCL.

Configuration of Image Display Panel

Figure 4:
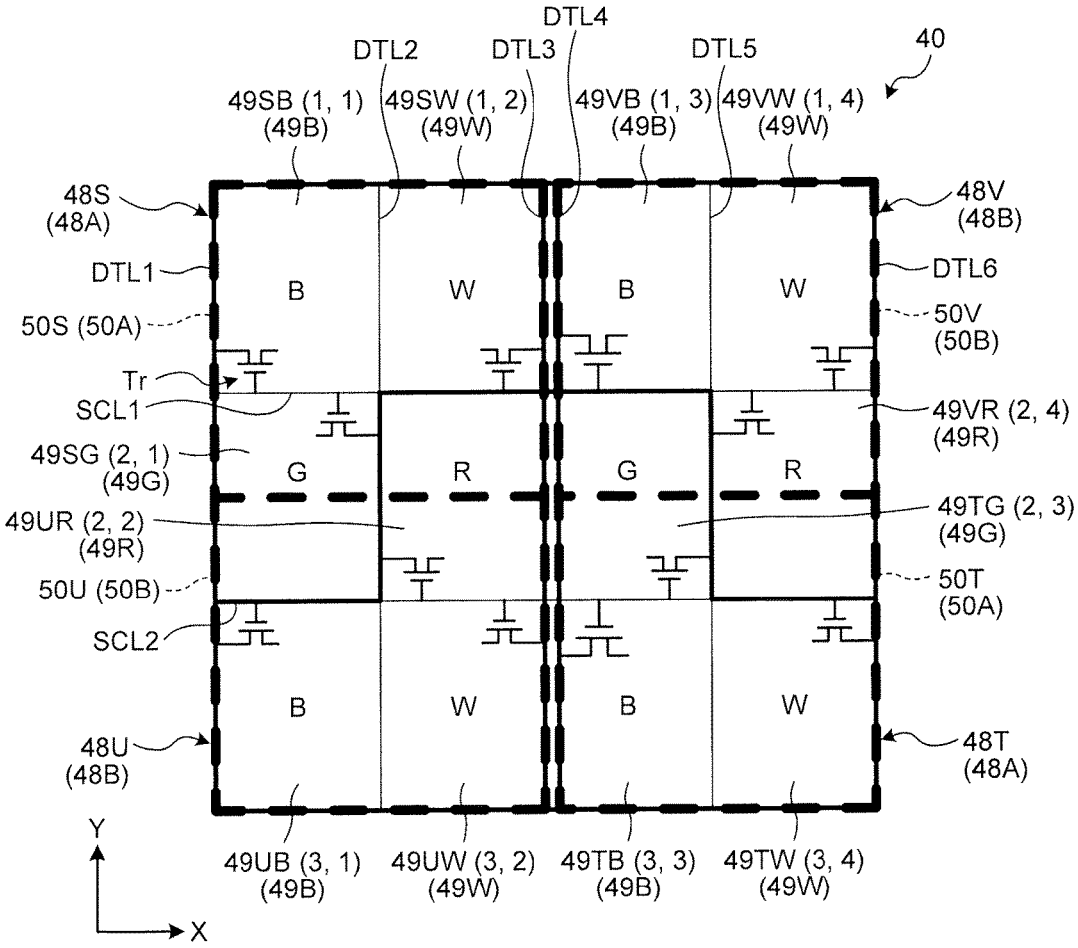
FIG. 4 is a schematic diagram illustrating a pixel array of the image display panel according to the first embodiment.

Next, the image display panel 40 will be described. First, the pixel array of the image display panel 40 will be described. FIG. 4 is a schematic diagram illustrating the pixel array of the image display panel according to the first embodiment. As illustrated in FIGS. 2 and 4, in the image display panel 40, a pixel 48A (a first pixel) and a pixel 48B (a second pixel) arranged in the column direction configure a set of pixels (a pixel unit) 48, and P×Q pixel units 48 (P pixels in the row direction and Q pixels in the column direction) are arranged in the 2D matrix form. FIGS. 2 and 4 illustrate an example in which a plurality of pixels 48A and a plurality of pixels 48B are arranged in a 2D XY coordinate system so as to be arranged alternately in the row direction and the column direction, and the pixel units 48 are arranged in the matrix form. In this example, the row direction is the X direction, and the column direction is the Y direction. The row direction and the column direction are not limited to this example, the row direction may be the Y direction, and the column direction may be the X direction. The row direction and the column direction may not be the X direction and the Y direction which are orthogonal to each other in the 2D XY coordinate system as long as they are different directions.

In the first embodiment, the pixel 48A and the pixel 48B are arranged alternately in the X direction (the row direction) and the Y direction (the column direction). The arrangement of the pixel 48A and the pixel 48B is not limited to this example. For example, the pixel 48A and the pixel 48B are alternately arranged in the X direction, and the pixels 48A may be consecutively arranged in the Y direction, and the pixels 48B may be consecutively arranged in the Y direction. Alternatively, the pixels 48A and the pixel 48B are alternately arranged in the Y direction, whereas the pixels 48A may be consecutively arranged in the X direction, and the pixels 48B may be consecutively arranged in the X direction.

As illustrated in FIG. 4, the pixel 48A is a pixel array including three pixels, that is, a first sub pixel 49B, a second sub pixel 49W, and a third sub pixel 49G among the first sub pixel 49B, the second sub pixel 49W, the third sub pixel 49G, and a fourth sub pixel 49R. The pixel 48B is a pixel array including three pixels, that is, the first sub pixel 49B, the second sub pixel 49W, the fourth sub pixel 49R among the first sub pixel 49B, the second sub pixel 49W, the third sub pixel 49G, and the fourth sub pixel 49R.

As described above, the pixel 48 includes the first sub pixel 49B, the second sub pixel 49W, the third sub pixel 49G, and the fourth sub pixel 49R. The first sub pixel 49B displays the first color (blue as an original color in the first embodiment). The second sub pixel 49W displays the second color (white in the first embodiment). The third sub pixel 49G displays the third color (green as an original color in the first embodiment). The fourth sub pixel 49R displays the fourth color (red as an original color in the first embodiment). Hereinafter, when it is unnecessary to distinguish the first sub pixel 49B, the second sub pixel 49W, the third sub pixel 49G, and the fourth sub pixel 49R from one another, they are referred to as a "sub pixel 49". The image output unit 12 outputs RGB data that can be displayed by the first color, the third color, and the fourth color in the pixel unit 48 as the input signal of the signal processing unit 20. The first to fourth colors are not limited to this combination and may be different colors such as complementary colors, for example.

In the first embodiment, a so-called RG thinning configuration in which the pixel 48A does not include the fourth sub pixel 49R, and the pixel 48B does not include the third sub pixel 49G is employed, but the present disclosure is not limited to this example. For example, the pixel 48A may include the fourth sub pixel 49R, the third sub pixel 49G, and the first sub pixel 49B instead of the first sub pixel 49B, the second sub pixel 49W, and the third sub pixel 49G. The pixel 48B may include the fourth sub pixel 49R, the third sub pixel 49G, and the second sub pixel 49W instead of the first sub pixel 49B, the second sub pixel 49W, and the fourth sub pixel 49R. This configuration is a so-called BW thinning configuration. As described above, a combination of sub pixels is arbitrary as long as the pixel 48A includes three of four sub pixels, the pixel 48B includes three of four sub pixels, and one of the sub pixels of the pixel 48B is different from one of the sub pixels of the pixel 48A.

In the first embodiment, the first sub pixel 49B and the second sub pixel 49W have the same shape. The third sub pixel 49G and the fourth sub pixel 49R have the same shape. More specifically, the first sub pixel 49B, the second sub pixel 49W, the third sub pixel 49G, and the fourth sub pixel 49R have the same shape, that is, the rectangular shape. The first sub pixel 49B, the second sub pixel 49W, the third sub pixel 49G, and the fourth sub pixel 49R may be neither the same shape nor the rectangular shape. For example, the length of the third sub pixel 49G and the fourth sub pixel 49R in the Y direction may be larger than the length of the first sub pixel 49B and the second sub pixel 49W in the Y direction.

More specifically, the pixel 48A includes a pixel 48S (a third pixel) and a pixel 48T (a fourth pixel) as illustrated in FIG. 4. The pixel 48B includes a pixel 48U (a fifth pixel) and a pixel 48V (a sixth pixel). The pixel 48S is adjacent to the pixel 48U in the Y direction and adjacent to the pixel 48V in the X direction. The pixel 48T is adjacent to the pixel 48U in the X direction and adjacent to the pixel 48V in the Y direction. In other words, the pixel 48T is arranged at the position diagonal to the pixel 48S. In the first embodiment, the pixel 48S and the pixel 48U belong to the same pixel 48 (pixel unit), and the pixel 48T and the pixel 48V belong to the same pixel 48 (pixel unit).

The pixel 48S includes a first sub pixel 49SB serving as the first sub pixel 49B, a second sub pixel 49SW serving as the second sub pixel 49W, and a third sub pixel 49SG serving as the third sub pixel 49G. The pixel 48T includes a first sub pixel 49TB serving as the first sub pixel 49B, a second sub pixel 49TW serving as the second sub pixel 49W, and a third sub pixel 49TG serving as the third sub pixel 49G. The pixel 48U includes a first sub pixel 49UB serving as the first sub pixel 49B, a second sub pixel 49UW serving as the second sub pixel 49W, and a fourth sub pixel 49UR serving as the fourth sub pixel 49R. The pixel 48V includes a first sub pixel 49UB serving as the first sub pixel 49B, a second sub pixel 49VW serving as the second sub pixel 49W, and a fourth sub pixel 49VR serving as the fourth sub pixel 49R.

The sub pixels 49 are arranged in the X direction and the Y direction. As illustrated in FIG. 4, the sub pixels 49 are arranged along a first row extending in the X direction, a second row arranged as a row next to the first row, and a third row arranged as a row next to the second row. The sub pixels 49 are arranged along a first column extending in the Y direction, a second column arranged as a column next to the first column, a third column arranged as a column next to the second column, and a fourth column arranged as a column next to the third column. The first to third rows of the sub pixels 49 are periodically arranged in the Y direction and the first to fourth columns of the sub pixels 49 are periodically arranged in the X direction.

An array of the sub pixels 49 of the pixels 48S, 48T, 48U, and 48V will be described under the assumption that in a row and column in which a sub pixel is arranged, a sub pixel 49 arranged in an s-th row and a t-th column is indicated by a sub pixel 49(s,t). For example, since the first sub pixel 49SB of the pixel 48S is arranged in the first row and the first column, the first sub pixel 49SB is described as the first sub pixel 49SB(1,1). When it is unnecessary to describe an arrangement order of sub pixels, the sub pixel is described as the first sub pixel 49SB.

The pixel 48S (the third pixel) includes a first sub pixel 49SB(1,1), a second sub pixel 49SW(1,2), and a third sub pixel 49SG(2,1) as illustrated in FIG. 4. In other words, the first sub pixel 49SB(1,1) and the second sub pixel 49SW(1,2) are arranged in the same row, that is, the first row and adjacent in the X direction. The first sub pixel 49SB(1,1) and the third sub pixel 49SG(2,1) are adjacent in the Y direction.

The pixel 48U (the fifth pixel) includes a first sub pixel 49UB(3,1), a second sub pixel 49UW(3,2), and a fourth sub pixel 49UR(2,2). In other words, the first sub pixel 49UB(3,1) and the second sub pixel 49UW(3,2) are arranged in the same row, that is, the third row and adjacent in the X direction. The second sub pixel 49UW(3,2) and the fourth sub pixel 49UR(2,2) are adjacent in the Y direction. The fourth sub pixel 49UR(2,2) and the third sub pixel 49SG(2,1) of the pixel 48S are arranged in the same row, that is, the second row and adjacent in the X direction.

The pixel 48V (the sixth pixel) includes the first sub pixel 49VB(1,3), the second sub pixel 49VW(1,4), and the fourth sub pixel 49VR(2,4). In other words, the first sub pixel 49VB(1,3) and the second sub pixel 49VW(1,4) are arranged in the same row, that is, the first row and adjacent in the X direction. The second sub pixel 49VW(1,4) and the fourth sub pixel 49VR(2,4) are adjacent in the Y direction. The first sub pixel 49VB(1,3) is adjacent to the second sub pixel 49SW(1,2) of the pixel 48S in the X direction.

The pixel 48T (the fourth pixel) includes the first sub pixel 49TB(3,3), the second sub pixel 49TW(3,4), and the third sub pixel 49TG(2,3). In other words, the first sub pixel 49TB(3,3) and the second sub pixel 49TW(3,4) are arranged in the same row, that is, the third row and adjacent in the X direction. The first sub pixel 49TB(3,3) and the third sub pixel 49TG(2,3) are adjacent in the Y direction. The first sub pixel 49TB(3,3) is adjacent to the second sub pixel 49UW(3,2) of the pixel 48U in the X direction. The second sub pixel 49TW(3,4) is adjacent to the fourth sub pixel 49VR(2,4) of the pixel 48V in the Y direction. The third sub pixel 49TG(2,3) is arranged between the fourth sub pixel 49UR(2,2) of the pixel 48U and the fourth sub pixel 49VR(2,4) of the pixel 48V in the X direction, and arranged adjacent to the fourth sub pixel 49UR(2,2) of the pixel 48U and the fourth sub pixel 49VR(2,4) of the pixel 48V in the X direction. The third sub pixel 49TG(2,3) is adjacent to the first sub pixel 49VB(1,3) of the pixel 48V in the Y direction.

As described above, in the image display panel 40, the third sub pixel 49G and the fourth sub pixel 49R are adjacent to each other in the X direction. The third sub pixel 49G and the fourth sub pixel 49R need not necessarily be adjacent to each other when the third sub pixel 49G and the fourth sub pixel 49R overlap in the Y direction at least partially.

Each of the sub pixels 49 arranged as described above is coupled to one of scanning lines SCL1 and SCL2 extending in the X direction and one of signal lines DTL1, DTL2, DTL3, DTL4, DTL5, and DTL6 extending in the Y direction via a switching element Tr.

The scanning line SCL1 is coupled to the first sub pixel 49SB(1,1), the second sub pixel 49SW(1,2), and the third sub pixel 49SG(2,1) of the pixel 48S as illustrated in FIG. 4. The scanning line SCL1 is coupled to the first sub pixel 49VB(1,3), the second sub pixel 49VW(1,4), and the fourth sub pixel 49VR(2,4) of the pixel 48V.

The scanning line SCL2 is coupled to the first sub pixel 49UB(3,1), the second sub pixel 49UW(3,2), and the fourth sub pixel 49UR(2,2) of the pixel 48U. The scanning line SCL2 is coupled to the first sub pixel 49TB(3,3), the second sub pixel 49TW(3,4), and the third sub pixel 49TG(2,3) of the pixel 48T. In other words, in the first embodiment, it is possible to drive one pixel through control of one scanning line SCL.

The signal line DTL1 is coupled with the first sub pixel 49SB(1,1) of the pixel 48S and the first sub pixel 49UB(3,1) of the pixel 48U. The signal line DTL2 is coupled with the third sub pixel 49SG(2,1) of the pixel 48S and the fourth sub pixel 49UR(2,2) of the pixel 48U. The signal line DTL3 is coupled with the second sub pixel 49SW(1,2) of the pixel 48S and the second sub pixel 49UW(3,2) of the pixel 48U. The signal line DTL4 is coupled with the first sub pixel 49VB(1,3) of the pixel 48V and the first sub pixel 49TB(3,3) of the pixel 48T.

The signal line DTL5 is coupled to the fourth sub pixel 49VR(2,4) of the pixel 48V, the third sub pixel 49TG(2,3) of the pixel 48T. The signal line DTL6 is coupled to the second sub pixel 49VW(1,4) of the pixel 48V, the second sub pixel 49TW(3,4) of the pixel 48T.

The scanning line SCL and the signal line DTL are coupled to the respective sub pixels 49 as described above, but the connection of the scanning line SCL and the signal line DTL is not limited to this example and can be arbitrarily selected.

Meanwhile, the input signal output from the image output unit 12 of the control device 11 has color information for displaying a color of one of divided regions (pixel display regions) when an image of one frame is divided in a 2D matrix form. Color information of an image of one frame is collected by a plurality of input signals having color information of different pixel display regions. Thus, an image of one frame can be displayed. In other words, a region of the image display panel 40 in which an image is displayed is divided in a 2D matrix form in units of pixel display regions serving as regions in which a color is displayed based on color information of each input signal. Further, a plurality of input signals are input, and all pieces of color information of the region of the image display panel 40 in which an image is displayed are collected. Thus, an image of one frame can be displayed in the region of the image display panel 40 in which an image is displayed.

As illustrated in FIG. 4, the pixel display regions for dividing the region of the image display panel 40 in which an image is displayed include a pixel display region 50A (a first pixel display region) and a pixel display region 50B (a second pixel display region) adjacent to the pixel display region 50A. In the first embodiment, the pixel display region 50A and the pixel display region 50B are adjacent in the Y direction. The pixel display region 50A and the pixel display region 50B have the same shape, that is, the rectangular shape. The shape of the pixel display region 50A and the pixel display region 50B is not limited to this example and arbitrary, and the pixel display region 50A and the pixel display region 50B may have different shapes.

More specifically, the pixel display region 50A includes a pixel display region 50S (a third pixel display region) and a pixel display region 50T (a fourth pixel display region) as illustrated in FIG. 4. The pixel display region 50B includes a pixel display region 50U (a fifth pixel display region) and a pixel display region 50V (a sixth pixel display region). The pixel display region 50S is adjacent to the pixel display region 50U in the Y direction and adjacent to the pixel display region 50V in the X direction. The pixel display region 50T is adjacent to the pixel display region 50U in the X direction and adjacent to the pixel display region 50V in the Y direction. In other words, the pixel display region 50T is positioned on the diagonal line to the pixel display region 50S.

As illustrated in FIG. 4, a region in which the first sub pixel 49SB(1,1) and the second sub pixel 49SW(1,2) of the pixel 48S are arranged, a region of one part of the third sub pixel 49SG(2,1) of the pixel 48S, and a region of one part of the fourth sub pixel 49UR(2,2) of the pixel 48U are arranged in the pixel display region 50S. More specifically, the region of the part of the third sub pixel 49SG(2,1) of the pixel 48S is a first row side region of regions obtained by dividing the third sub pixel 49SG(2,1) of the pixel 48S into two in the Y direction. The region of the part of the fourth sub pixel 49UR(2,2) of the pixel 48U is a first row side region of regions obtained by dividing the fourth sub pixel 49UR(2,2) of the pixel 48U into two in the Y direction.

A region in which the first sub pixel 49TB(3,3) and the second sub pixel 49TW(3,4) of the pixel 48T are arranged, a region of one part of the third sub pixel 49TG(2,3) of the pixel 48T, and a region of one part of the fourth sub pixel 49VR(2,4) of the pixel 48V are arranged in the pixel display region 50T. More specifically, the region of the part of the third sub pixel 49TG(2,3) of the pixel 48T is a third row side region of regions obtained by dividing the third sub pixel 49TG(2,3) of the pixel 48T into two in the Y direction. The region of the part of the fourth sub pixel 49VR(2,4) of the pixel 48V is a third row side region of regions obtained by dividing the fourth sub pixel 49VR(2,4) of the pixel 48V into two in the Y direction.

A region in which the first sub pixel 49UB(3,1) and the second sub pixel 49UW(3,2) of the pixel 48U are arranged, a region of the other part of the third sub pixel 49SG(2,1) of the pixel 48S, and a region of the other part of the fourth sub pixel 49UR(2,2) of the pixel 48U are arranged in the pixel display region 50U. More specifically, the region of the other part of the third sub pixel 49SG(2,1) of the pixel 48S is a third row side region of regions obtained by dividing the third sub pixel 49SG(2,1) of the pixel 48S into two in the Y direction. The region of the other part of the fourth sub pixel 49UR(2,2) of the pixel 48U is a third row side region of regions obtained by dividing the fourth sub pixel 49UR(2,2) of the pixel 48U into two in the Y direction.

A region in which the first sub pixel 49VB(1,3) and the second sub pixel 49VW(1,4) of the pixel 48V are arranged, a region of the other part of the third sub pixel 49TG(2,3) of the pixel 48T, and a region of the other part of the fourth sub pixel 49VR(2,4) of the pixel 48V are arranged in the pixel display region 50V. More specifically, the region of the other part of the third sub pixel 49TG(2,3) of the pixel 48T is a first row side region of regions obtained by dividing the third sub pixel 49TG(2,3) of the pixel 48T into two in the Y direction. The region of the other part of the fourth sub pixel 49VR(2,4) of the pixel 48V is a first row side region of regions obtained by dividing the fourth sub pixel 49VR(2,4) of the pixel 48V into two in the Y direction.

A relation between the regions of the sub pixels 49 and the pixel display regions can be represented as follows. The region of the first sub pixel 49B and the second sub pixel 49W of the pixel 48A, the region of one part of the third sub pixel 49G, and the region of one part of the fourth sub pixel 49R are arranged in the pixel display region 50A. The region of the first sub pixel 49B and the second sub pixel 49W of the pixel 48B, the region of the other part of the third sub pixel 49G of the pixel 48A, and the region of the other part of the fourth sub pixel 49R of the pixel 48B are arranged in the pixel display region 50B.

More specifically, for the third sub pixel 49G and the fourth sub pixel 49R, a previous row side region of the two regions divided in the Y direction is arranged in the pixel display region 50A, and a next row side region of the two regions divided in the Y direction is arranged in the pixel display region 50B. In the third sub pixel 49G, the divided two regions preferably have the same area, and the divided two regions preferably have the same shape. Similarly, in the fourth sub pixel 49R, the divided two regions preferably have the same area, and the divided two regions preferably have the same shape. A method of dividing the third sub pixel 49G and the fourth sub pixel 49R is arbitrary. For example, the third sub pixels 49G in the respective pixel display regions may not have the same area, and the fourth sub pixels 49R in the respective pixel display regions need not necessarily have the same area. Further, the present disclosure is not limited to the example in which the third sub pixels 49G in the respective pixel display regions and the fourth sub pixels 49R in the respective pixel display regions have the same area. Further, for example, one part and the other part of each of the third sub pixel 49G and the fourth sub pixel 49R are preferably arranged in different pixel display regions.

In other words, in the pixel 48A, one part of the third sub pixel 49G extends in the pixel display region 50B that is opposite to the pixel 48A in the Y direction. For example, one part at the third row side of two parts obtained by dividing the third sub pixel 49SG(2,1) of the pixel 48S of the pixel 48A into two in the Y direction extends in the pixel display region 50U. In the pixel 48B, one part of the fourth sub pixel 49R extends in the pixel display region 50A that is opposite in the Y direction. For example, one part at the first row side of two parts obtained by dividing the fourth sub pixel 49UR(2,2) of the pixel 48U of the pixel 48B into two in the Y direction extends in the pixel display region 50S.

Figure 5:
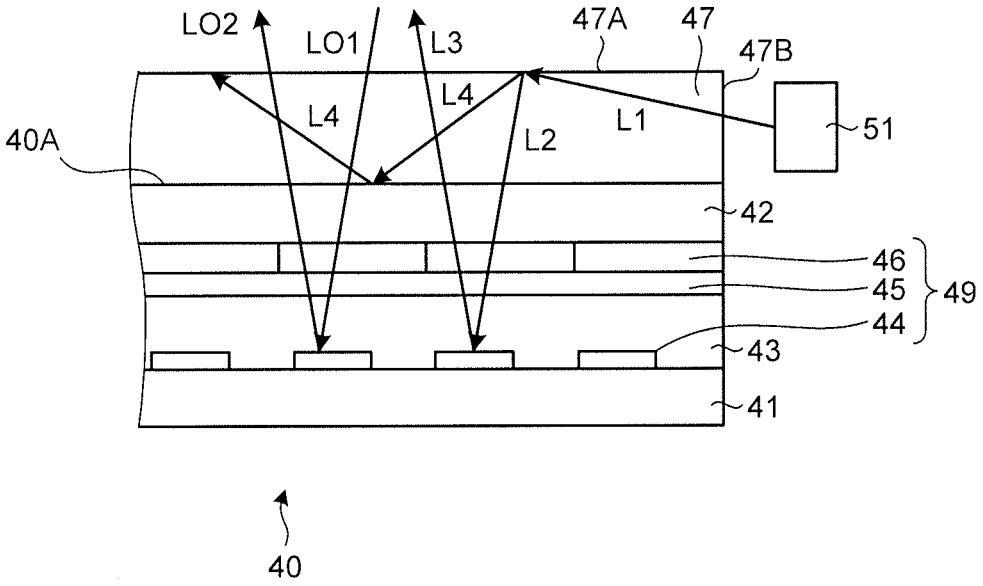
FIG. 5 is a cross-sectional view schematically illustrating a structure of the image display panel according to the first embodiment.

Next, a structure of the image display panel 40 will be described. In the first embodiment, the image display panel 40 is a reflective image display panel. FIG. 5 is a cross-sectional view schematically illustrating a structure of the image display panel according to the first embodiment. The image display panel 40 includes an array substrate 41, a counter substrate 42 which is opposite to the array substrate 41, and a liquid crystal layer 43 in which a liquid crystal element is sealed between the array substrate 41 and the counter substrate 42 as illustrated in FIG. 5.

A plurality of pixel electrodes 44 are provided on a liquid crystal layer 43 side surface of the array substrate 41. The pixel electrode 44 is coupled to the signal line DTL via a switching element, and an image output signal serving as a video signal is applied to the pixel electrode 44. The pixel electrode 44 is a member having reflectivity made of, for example, aluminum or silver, and reflects ambient light or light emitted from the light source unit 51. In other words, in the first embodiment, the pixel electrode 44 configures a reflecting unit, and the reflecting unit reflects light incident from the front surface (the surface at the side at which an image is displayed) of the image display panel 40 so that an image is displayed.

The counter substrate 42 is a substrate having transparency such as glass or the like. A counter electrode 45 and a color filter 46 are provided on a liquid crystal layer 43 side surface of the counter substrate 42. More specifically, the counter electrode 45 is provided on a liquid crystal layer 43 side surface of the color filter 46.

For example, the counter electrode 45 is a conductive material having transparency such as indium tin oxide (ITO) or indium zinc oxide (IZO). The counter electrode 45 is coupled with the switching element to which the pixel electrode 44 is coupled. Since the pixel electrode 44 and the counter electrode 45 are formed to be opposite to each other, when a voltage of the image output signal is applied to between the pixel electrode 44 and the counter electrode 45, the pixel electrode 44 and the counter electrode 45 cause the electric field to be generated in the liquid crystal layer 43. The electric field generated in the liquid crystal layer 43 twists the liquid crystal element and changes birefringence thereof, and thus the display device 10 adjust a quantity of light reflected from the image display panel 40. The image display panel 40 employs a so-called vertical electric field scheme but may employ a horizontal electric field scheme in which the electric field is generated in a direction parallel to the display surface of the image display panel 40.

A plurality of color filters 46 are disposed in a manner corresponding to the pixel electrodes 44. The pixel electrode 44, the counter electrode 45, and the color filter 46 configure the sub pixel 49. For the color filter 46, a first color filter that is disposed in the first sub pixel 49B and passes the first color to an image observer, a second color filter that is disposed in the third sub pixel 49G and passes the third color to the image observer, and a third color filter that is disposed in the fourth sub pixel 49R and passes the fourth color to the image observer are arranged. In the image display panel 40, no color filter is arranged for the second sub pixel 49W. The second sub pixel 49W may be provided with a transparent resin layer instead of a color filter. As described above, the image display panel 40 provided with the transparent resin layer can suppress the occurrence of a large gap above the second sub pixel 49W, otherwise a large gap occurs because no color filter is arranged for the second sub pixel 49W.

A light guide plate 47 is disposed on a surface of the counter substrate 42 which is opposite to the liquid crystal layer 43 side surface. For example, the light guide plate 47 is a flat-like member having transparency made of acrylic resin, polycarbonate (PC) resin, methyl methacrylate-styrene copolymer (MS resin), or the like. The light guide plate 47 has a top surface 47A opposite to a counter substrate 42 side surface and the top surface 47A has undergone a prism process.

Configuration of Light Source Unit

The light source unit 51 is an LED in the first embodiment. The light source unit 51 is disposed along a side surface 47B of the light guide plate 47 as illustrated in FIG. 5. The light source unit 51 emits light to the image display panel 40 from the front surface of the image display panel 40 through the light guide plate 47. The light source unit 51 is switched between the ON and OFF states according to an operation performed by the image observer or an ambient light sensor that is attached to the display device 10 to measure ambient light. The light source unit 51 emits light in the ON state but does not emit light in the OFF state. For example, when the image observer feels that an image is dark, the image observer turns on the light source unit 51, and thus light is emitted from the light source unit 51 to the image display panel 40, and the image becomes bright. When the ambient light sensor determines that the intensity of ambient light is smaller than a certain value, for example, the signal processing unit 20 turns on the light source unit 51, and thus light is emitted from the light source unit 51 to the image display panel 40, and the image becomes bright. In the first embodiment, the signal processing unit 20 does not control luminance of light of the light source unit 51 according to the expansion coefficient $\alpha$. In other words, the luminance of the light of the light source unit 51 is set regardless of the expansion coefficient $\alpha$ which will be described later. The luminance of the light of the light source unit 51 may be adjusted according to an operation performed by the image observer or a measurement result of the ambient light sensor.

Next, reflection of light by the image display panel 40 will be described. Ambient light LO1 is incident on the image display panel 40 as illustrated in FIG. 5. The ambient light LO1 is incident on the pixel electrode 44 through the light guide plate 47 and the image display panel 40. The ambient light LO1 incident on the pixel electrode 44 is reflected by the pixel electrode 44 and then exits to the outside through the image display panel 40 and the light guide plate 47 as light LO2. When the light source unit 51 is turned on, light L1 emitted from the light source unit 51 is incident on the light guide plate 47 from the side surface 47B of the light guide plate 47. The light L1 incident into the light guide plate 47 is scattered and reflected by the top surface 47A of the light guide plate 47, and a part of the light L1 is incident into the image display panel 40 from the counter substrate 42 side of the image display panel 40 and irradiated to the pixel electrode 44 as light L2. The light L2 irradiated to the pixel electrode 44 is reflected by the pixel electrode 44 and exits to the outside through the image display panel 40 and the light guide plate 47 as light L3. Another part of the light scattered by the top surface 47A of the light guide plate 47 is reflected as light L4 and repeatedly reflected in the light guide plate 47.

In other words, the pixel electrode 44 reflects the ambient light LO1 or the light L2 incident on the image display panel 40 from the front surface serving as the outside side (the counter substrate 42 side) surface of the image display panel 40 toward the outside. The light LO2 and L3 reflected toward the outside pass through the liquid crystal layer 43 and the color filter 46. Thus, the display device 10 can display an image with the light LO2 and L3 reflected toward the outside. As described above, the display device 10 according to the first embodiment is a reflective display device of a front light type including the light source unit 51 of an edge light type. In the first embodiment, the display device 10 includes the light source unit 51 and the light guide plate 47 but may not include the light source unit 51 and the light guide plate 47. In this case, the display device 10 can display an image with the light LO2 generated by reflection of the ambient light LO1.

Processing Operation of Display Device

Figure 6:
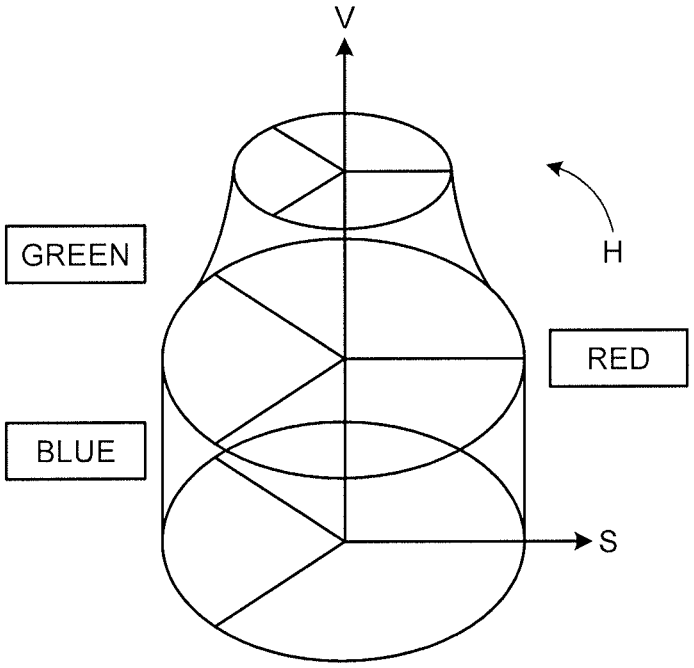
FIG. 6 is a conceptual diagram of an extended HSV color space that is extendable by the display device according to the present embodiment.
Figure 7:
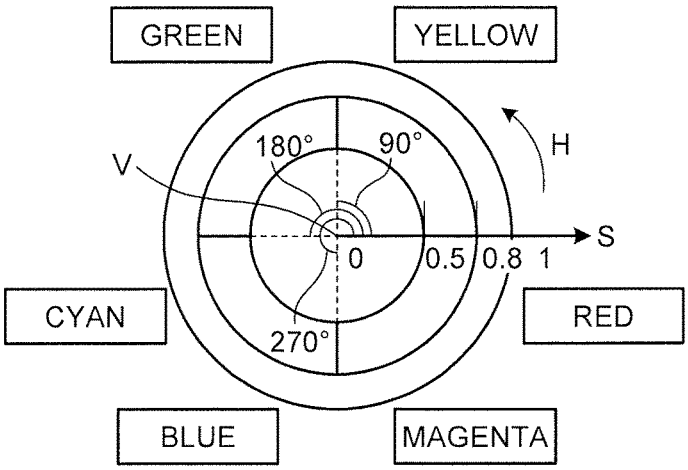
FIG. 7 is a conceptual diagram illustrating a relation between a hue and a saturation of an extended HSV color space.

FIG. 6 is a conceptual diagram of an extended HSV color space that is extendable by the display device according to the present embodiment. FIG. 7 is a conceptual diagram illustrating a relation between a hue and a saturation of the extended HSV color space. The signal processing unit 20 receives an input signal serving as information of an image to be displayed from the outside. The input signal includes information of an image (color) to be displayed at a corresponding position for each pixel as an input signal. Specifically, in the image display panel 40 in which P×Q pixel units 48 are arranged in a matrix form, for the pixel 48A of a (p,q)-th pixel unit 48 (here, $1 \le p \le P$, $1 \le q \le Q$), a signal including an input signal of the first sub pixel 49B whose signal value is $x_{1A-(p,q)}$, an input signal of the third sub pixel 49G whose signal value is $x_{3A-(p,q)}$, and an input signal of the fourth sub pixel 49R whose signal value is $x_{4A-(p,q)}$ (see FIG. 1) is input to the signal processing unit 20. Similarly, for the pixel 48B of the (p,q)-th pixel unit 48 (here, $1 \le p \le P$, $1 \le q \le Q$), a signal including an input signal of the first sub pixel 49B whose signal value is $x_{1B-(p,q)}$, an input signal of the third sub pixel 49G whose signal value is $x_{3B-(p,q)}$, and an input signal of the fourth sub pixel 49R whose signal value is $x_{4B-(p,q)}$ (see FIG. 1) is input to the signal processing unit 20.

The signal processing unit 20 illustrated in FIG. 1 processes the input signals, generates an output signal (a signal value $X_{1A-(p,q)}$) of the first sub pixel for deciding a display gradation of the first sub pixel 49B of the pixel 48A, a corrected output signal (a signal value $XA_{3A-(p,q)}$) of the third sub pixel for deciding a display gradation of the third sub pixel 49G, a corrected output signal (a signal value $XA_{4A-(p,q)}$) of the fourth sub pixel for deciding a display gradation of the fourth sub pixel 49R, and an output signal (a signal value $X_{2A-(p,q)}$) of the second sub pixel for deciding a display gradation of the second sub pixel 49W, and outputs the output signals to the image-display-panel driving unit 30. Similarly, the signal processing unit 20 generates an output signal (a signal value $X_{1B-(p,q)}$) of the first sub pixel for deciding a display gradation of the first sub pixel 49B of the pixel 48B, a corrected output signal (a signal value $XB_{3B-(p,q)}$) of the third sub pixel for deciding the display gradation of the third sub pixel 49G, a corrected output signal (a signal value $XB_{4B-(p,q)}$) of the fourth sub pixel for deciding the display gradation of the fourth sub pixel 49R, and an output signal (a signal value $X_{2B-(p,q)}$) of the second sub pixel for deciding the display gradation of the second sub pixel 49W, and outputs the output signals to the image-display-panel driving unit 30. Hereinafter, when it is unnecessary to distinguish the input signal of the pixel 48A from the input signal of the pixel 48B, for example, $x_{1A-(p,q)}$ and $x_{1B-(p,q)}$ are referred to appropriately as "$x_{1-(p,q)}$." Further, when it is unnecessary to distinguish the output signal of the pixel 48A from the output signal of the pixel 48B, for example, $X_{1A-(p,q)}$ and $X_{1B-(p,q)}$ are referred to appropriately as "$X_{1-(p,q)}$." A relation between the corrected output signal and the output signal will be described later.

In the display device 10, the pixel unit 48 includes the second sub pixel 49W that outputs a second color component (for example, white), and thus it is possible to widen the dynamic range of brightness in the HSV color space (the extended HSV color space) as illustrated in FIG. 6. In other words, as illustrated in FIG. 6, a three-dimensional shape having substantially a truncated cone shape in which a maximum value of a brightness V decreases as a saturation S increases is placed on a HSV color space of a circular cylindrical shape that can be displayed on the first sub pixel 49B, the third sub pixel 49G, and the fourth sub pixel 49R.

The signal processing unit 20 stores the maximum value Vmax(S) of the brightness with the saturation S as a variable in the HSV color space extended by adding the second color component (for example, white) in the signal processing unit 20. In other words, the signal processing unit 20 stores the value of the maximum value Vmax(S) of the brightness for each coordinates (coordinate values) of the saturation and the hue for the three-dimensional shape of the HSV color space illustrated in FIG. 6. Since the input signal includes the input signals of the first sub pixel 49B, the third sub pixel 49G, and the fourth sub pixel 49R, the HSV color space of the input signal has the same shape as the circular cylindrical shape, that is, the circular cylindrical shaped portion of the extended HSV color space.

The signal processing unit 20 calculates the output signal of the first sub pixel 49B (the signal value $X_{1-(p,q)}$) based on at least an input signal (the signal value $x_{1-(p,q)}$) of the first sub pixel 49B and the expansion coefficient α, and outputs the output signal of the first sub pixel 49B (the signal value $X_{1-(p,q)}$) to the first sub pixel 49B. The signal processing unit 20 calculates a generation signal (the signal value $X_{3-(p,q)}$) of the third sub pixel 49G based on at least an input signal (the signal value $x_{3-(p,q)}$) of the third sub pixel 49G and the expansion coefficient α. The signal processing unit 20 calculates a generation signal (the signal value $X_{4-(p,q)}$) of the fourth sub pixel 49R based on at least an input signal (the signal value $x_{4-(p,q)}$) of the fourth sub pixel 49R and the expansion coefficient α. Further, the signal processing unit 20 calculates an output signal (the signal value $X_{2-(p,q)}$) of the second sub pixel 49W based on the input signal (the signal value $x_{1-(p,q)}$) of the first sub pixel 49B, the input signal (the signal value $x_{3-(p,q)}$) of the third sub pixel 49G, and the input signal (the signal value $x_{4-(p,q)}$) of the fourth sub pixel 49R, and outputs the output signal (the signal value $X_{2-(p,q)}$) of the second sub pixel 49W to the second sub pixel 49W.

Specifically, the signal processing unit 20 calculates the output signal of the first sub pixel 49B based on the input signal of the first sub pixel 49B, the expansion coefficient α, and the output signal of the second sub pixel 49W, calculates the generation signal of the third sub pixel 49G based on the input signal of the third sub pixel 49G, the expansion coefficient α, and the output signal of the second sub pixel 49W, and calculates the generation signal of the fourth sub pixel 49R based on the input signal of the fourth sub pixel 49R, the expansion coefficient α, and the output signal of the second sub pixel 49W.

In other words, when χ is a constant depending on the display device 10, the signal processing unit 20 obtains the signal value $X_{1-(p,q)}$ serving as the output signal of the first sub pixel 49B, the signal value $X_{3-(p,q)}$ serving as the generation signal of the third sub pixel 49G, and the signal value $X_{4-(p,q)}$ serving as the generation signal of the fourth sub pixel 49R for the (p,q)-th pixel (a set of the first sub pixel 49B, the third sub pixel 49G, and the fourth sub pixel 49R) using the following Formulas (1) to (3):

$$X_{1-(p,q)}=\alpha\cdot x_{1-(p,q)}-\chi\cdot X_{2-(p,q)} \quad (1)$$

$$X_{3-(p,q)}=\alpha\cdot x_{3-(p,q)}-\chi\cdot X_{2-(p,q)} \quad (2)$$

$$X_{4-(p,q)}=\alpha\cdot x_{4-(p,q)}-\chi\cdot X_{2-(p,q)} \quad (3)$$

More specifically, the signal processing unit 20 obtains an output signal value $X_{1A-(p,q)}$ of the first sub pixel 49B in the pixel 48A of the (p,q)-th pixel unit 48 using the following Formula (1-1), and obtains a generation signal value $X_{3A-(p,q)}$ of the third sub pixel 49G using the following Formula (2-1).

$$X_{1A-(p,q)}=\alpha\cdot x_{1A-(p,q)}-\chi\cdot X_{2A-(p,q)} \quad (1\text{-}1)$$

$$X_{3A-(p,q)}=\alpha\cdot x_{3A-(p,q)}-\chi\cdot X_{2A-(p,q)} \quad (2\text{-}1)$$

The signal processing unit 20 obtains an output signal value $X_{1B-(p,q)}$ of the first sub pixel 49B in the pixel 48B of the (p,q)-th pixel unit 48 using the following Formula (1-2), and obtains a generation signal value $X_{4B-(p,q)}$ of the fourth sub pixel 49R using the following Formula (3-1).

$$X_{1B-(p,q)}=\alpha\cdot x_{1B-(p,q)}-\chi\cdot X_{2B-(p,q)} \quad (1\text{-}2)$$

$$X_{4B-(p,q)}=\alpha\cdot x_{4B-(p,q)}-\chi\cdot X_{2B-(p,q)} \quad (3\text{-}1)$$

The signal processing unit 20 obtains the maximum value Vmax(S) of the brightness in which the saturation S in the HSV color space extended by adding the fourth color is a variable, obtains the saturation S and the brightness V(S) of a plurality of pixels based on the input signal values of the sub pixels in the plurality of pixel, and decides the expansion coefficient α so that the ratio of pixels in which a value of extended brightness obtained from the product of the brightness V(S) and the expansion coefficient α exceeds the maximum value Vmax(S) to all the pixels is a limit value β or less. The limit value β is an upper limit value (upper limit ratio) of the ratio of the range exceeding the maximum value of the brightness of the extended HSV color space in a combination of values of the hue and the saturation to the maximum value.

The saturation S and the brightness V(S) is represented by S=(Max−Min)/Max and V(S)=Max, respectively. The saturation S takes a value of 0 to 1, the brightness V(S) takes a value of 0 to $(2^n-1)$, and n is a display gradation bit number. Max is a maximum value of the input signal values of the three sub pixels, that is, the input signal value of the first sub pixel, the input signal value of the third sub pixel and the input signal value of the fourth sub pixel for the pixel. Min is a minimum value of the input signal values of the three sub pixels, that is, the input signal value of the first sub pixel, the input signal value of the third sub pixel and the input signal value of the fourth sub pixel for the pixel. The hue H is indicated by 0° to 360° as illustrated in FIG. 7. As it increases from 0° to 360°, it indicates red, yellow, green, cyan, blue, magenta, and red. In the present embodiment, a region including an angle 0° is red, a region including an angle 120° is green, and a region including an angle 240° is blue.

In the present embodiment, an output signal value $X_{2-(p,q)}$ of the second sub pixel 49W can be obtained based on the product of $Min_{(p,q)}$ and the expansion coefficient α. Specifically, the signal value $X_{2-(p,q)}$ can be obtained based on the following Formula (4). In Formula (4), the product of $Min_{(p,q)}$ and the expansion coefficient α is divided by χ, but the present disclosure is not limited to this example. χ will be described later. The expansion coefficient α is decided for each image display frame.

$$X_{2-(p,q)}=\mathrm{Min}_{(p,q)}\cdot\alpha/\chi \quad (4)$$

More specifically, the signal processing unit 20 obtains an output signal value $X_{2A-(p,q)}$ of the second sub pixel 49W in the pixel 48A of the (p,q)-th pixel unit 48 using the following Formula (4-1), and obtains an output signal value $X_{2B-(p,q)}$ of the second sub pixel 49W in the pixel 48B of the (p,q)-th pixel unit 48 using the following Formula (4-2).

$$X_{2A-(p,q)}=\mathrm{Min}A_{(p,q)}\cdot\alpha/\chi \quad (4\text{-}1)$$

$$X_{2B-(p,q)}=\mathrm{Min}B_{(p,q)}\cdot\alpha/\chi \quad (4\text{-}2)$$

$MinA_{(p,q)}$ is a minimum value of the input signal values of the three sub pixels 49 of ($x_{1A-(p,q)}$, $x_{3A-(p,q)}$, $x_{4A-(p,q)}$). $MinB_{(p,q)}$ is a minimum value of the input signal values of the three sub pixels 49 of ($x_{1B-(p,q)}$, $x_{3B-(p,q)}$, $x_{4B-(p,q)}$).

Generally, the saturation $S_{(p,q)}$ and the brightness $V(S)_{(p,q)}$ in the circular cylindrical HSV color space can be obtained based on the input signal (the signal value $X_{1-(p,q)}$) of the first sub pixel 49B, the input signal (the signal value $x_{3-(p,q)}$) of the third sub pixel 49G, and the input signal (the signal value $x_{4-(p,q)}$) of the fourth sub pixel 49R of the (p,q)-th pixel using the following Formulas (5) and (6).

$$S_{(p,q)}=(\mathrm{Max}_{(p,q)}-\mathrm{Min}_{(p,q)})\mathrm{Max}_{(p,q)} \quad (5)$$

$$V(S)_{(p,q)}=\mathrm{Max}_{(p,q)} \quad (6)$$

Here, $Max_{(p,q)}$ is a maximum value of the input signal values of the three sub pixels 49 of ($x_{1-(p,q)}$, $x_{3-(p,q)}$, $x_{4-(p,q)}$), and $Min_{(p,q)}$ is a minimum value of the input signal values of the three sub pixels 49 of ($x_{1-(p,q)}$, $x_{3-(p,q)}$, $x_{4-(p,q)}$). In the present embodiment, n=8 is assumed. In other words, the display gradation bit number is assumed to be 8 (the display gradation has a value of 256 gradations of 0 to 255).

More specifically, the saturation $S_{A(p,q)}$ of the (p,q)-th pixel 48A, the saturation $S_{B(p,q)}$ of the (p,q)-th pixel 48B, the brightness $V_{A(p,q)}$ of the (p,q)-th pixel 48A, and the brightness $V_{B(p,q)}$ of the (p,q)-th pixel 48B are obtained using the following Formulas (5-1), (5-2), (6-1), and (6-2), respectively.

$$S_{A(p,q)}=(\mathrm{Max}_{A(p,q)}-\mathrm{Min}_{A(p,q)})/\mathrm{Max}_{A(p,q)} \quad (5\text{-}1)$$

$$S_{B(p,q)}=(\mathrm{Max}_{B(p,q)}-\mathrm{Min}_{B(p,q)})/\mathrm{Max}_{B(p,q)} \quad (5\text{-}2)$$

$$V_{A(p,q)}=\mathrm{Max}_{A(p,q)} \quad (6\text{-}1)$$

$$V_B(p,\ q)=\mathrm{Max}_B(p,\ q) \quad (6\text{-}2)$$

Here, $Max_{A(p,q)}$ is a maximum value among the input signals $x_{1A-(p,q)}$, $x_{3A-(p,q)}$, and $x_{4A-(p,q)}$ of the sub pixels of the (p,q)-th pixel 48A. $Min_{A(p,q)}$ is a minimum value among the input signals $x_{1A-(p,q)}$, $x_{3A-(p,q)}$, and $x_{4A-(p,q)}$ of the sub pixels of the (p,q)-th pixel 48A. $Max_{B(p,q)}$ is a maximum value among the input signals $X_{1B-(p,q)}$, $x_{3B-(p,q)}$, and $x_{4B-(p,q)}$ of the sub pixels of the (p,q)-th pixel 48B. $Min_{B(p,q)}$ is a minimum value among the input signals $x_{1B-(p,q)}$, $x_{3B-(p,q)}$, and $x_{4B-(p,q)}$ of the sub pixels of the (p,q)-th pixel 48B.

No color filter is arranged in the second sub pixel 49W displaying white. When t a signal having a value corresponding to the maximum signal value of the output signal of the first sub pixel is input to the first sub pixel 49B, a signal having a value corresponding to the maximum signal value of the output signal of the third sub pixel is input to the third sub pixel 49G, and a signal having a value corresponding to the maximum signal value of the output signal of the fourth sub pixel is input to the fourth sub pixel 49R, luminance of an aggregate the first sub pixel 49B, the third sub pixel 49G, and the fourth sub pixel 49R arranged in the pixel unit 48 is assumed to be $BN_{134}$. When a signal having a value corresponding to the maximum signal value of the output signal of the second sub pixel 49W is input to the second sub pixel 49W included in the pixel unit 48, luminance of the second sub pixel 49W is assumed to be $BN_2$. In other words, white of the maximum luminance is displayed by an aggregate of the first sub pixel 49B, the third sub pixel 49G, and the fourth sub pixel 49R, and luminance of white is indicated by $BN_{134}$. In this case, when $\chi$ is a constant depending on the display device 10, the constant $\chi$ is indicated by $\chi=BN_2/BN_{134}$.

Specifically, the luminance $BN_2$ when the input signal having the value 255 of the display gradation is assumed to be input to the second sub pixel 49W is, for example, 1.5 times as high as the luminance $BN_{134}$ of white when the signal value $x_{1-(p,q)}$ (=255) , the signal value $x_{3-(p,q)}$ (=255), and the signal value $x_{4-(p,q)}$ (=255) are input to the aggregate of the first sub pixel 49B, the third sub pixel 49G, and the fourth sub pixel 49R as input signals having the above values of the display gradation, respectively. In other words, in the present embodiment, $\chi=1.5$.

Meanwhile, when the signal value $X_{2-(p,q)}$ is given by Formula (4), Vmax(S) can be represented as in the following Formulas (7) and (8).

when $S \leq S_0$, $$V\max(S)=(\chi+1)\cdot(2^n-1) \tag{7}$$

when $S_0 \leq S \leq 1$, $$V\max(S)=(2^n-1)\cdot(1/S) \tag{8}$$

Here, $S_0=1/(\chi+1)$.

For example, the signal processing unit 20 stores the maximum value Vmax(S) of the brightness in which the saturation S in the HSV color space extended by adding the second color is a variable, which is obtained as described above, as a sort of lookup table. Alternatively, the maximum value Vmax(S) of the brightness in which the saturation S in the extended HSV color space is a variable is obtained by the signal processing unit 20 each time.

The averaging processing unit 24 of the signal processing unit 20 obtains a corrected output signal value $XA_{3A-(p,q)}$ for the third sub pixel 49G in the pixel 48A of the (p,q)-th pixel unit 48 based on the input signal value $x_{3A-(p,q)}$ for the third sub pixel 49G in the pixel 48A of the (p,q)-th pixel unit 48 and the input signal value $x_{3B-(p,q)}$ for the third sub pixel 49G in the pixel 48B of the (p,q)-th pixel unit 48 belonging to the same pixel unit 48, and outputs the corrected output signal value $XA_{3A-(p,q)}$ to the third sub pixel 49G in the pixel 48A of the (p,q)-th pixel unit 48. The averaging processing unit 24 obtains a corrected output signal value $XB_{4B-(p,q)}$ of the fourth sub pixel 49R in the pixel 48B of the (p,q)-th pixel unit 48 based on the input signal value $x_{4A-(p,q)}$ for the fourth sub pixel 49R of the pixel 48A of the (p,q)-th pixel unit 48 belonging to the same pixel unit 48 and the input signal value $x_{4B-(p,q)}$ for the fourth sub pixel 49R of the pixel 48A adjacent to the pixel 48B, and outputs the corrected output signal value $XB_{4B-(p,q)}$ to the fourth sub pixel 49R in the pixel 48B of the (p,q)-th pixel unit 48.

More specifically, the signal processing unit 20 calculates the corrected output signal $XA_{3A-(p,q)}$ of the third sub pixel 49G in the pixel 48A of the (p,q)-th pixel unit 48 based on the generation signal value $X_{3A-(p,q)}$ of the third sub pixel 49G in the pixel 48A of the (p,q)-th pixel unit 48 and the generation signal value $X_{3B-(p,q)}$ of the third sub pixel 49G of the pixel 48B of the (p,q)-th pixel unit 48 belonging to the same pixel unit 48.

The signal processing unit 20 calculates the corrected output signal $XB_{4B-(p,q)}$ of the fourth sub pixel 49R in the pixel 48B of the (p,q)-th pixel unit 48 based on the generation signal value $X_{4B-(p,q)}$ of the fourth sub pixel 49R in the pixel 48B of the (p,q)-th pixel unit 48 and the generation signal value $X_{4A-(p,q)}$ of the fourth sub pixel 49R in the pixel 48A of the (p,q)-th pixel unit 48 belonging to the same pixel unit 48.

As described above, the signal processing unit 20 uses only the input signal $x_{3A-(p,q)}$ for the third sub pixel 49G in the pixel 48A of the pixel unit 48 and the input signal $x_{3B-(p,q)}$ for the third sub pixel 49G in the pixel 48B of the same pixel unit 48 as the input signal when obtaining the corrected output signal $XA_{3A-(p,q)}$ for the third sub pixel 49G in the pixel 48A of the pixel unit 48. Similarly, the signal processing unit 20 uses only the input signal $x_{4A-(p,q)}$ for the fourth sub pixel 49R in the pixel 48A of the same pixel unit 48 and the input signal $x_{4B-(p,q)}$ for the fourth sub pixel 49R in the pixel 48B of the pixel unit 48 as the input signal when obtaining the corrected output signal $XB_{4B-(p,q)}$ for the fourth sub pixel 49R in the pixel 48B of the pixel unit 48.

More specifically, the signal processing unit 20 uses only the generation signal $X_{3A-(p,q)}$ for the third sub pixel 49G in the pixel 48A of the pixel unit 48 and the generation signal $X_{3B-(p,q)}$ for the third sub pixel 49G in the pixel 48B of the same pixel unit 48 as the generation signal when obtaining the corrected output signal $XA_{3A-(p,q)}$ for the third sub pixel 49G in the pixel 48A of the pixel unit 48. Similarly, the signal processing unit 20 uses only the generation signal $X_{4A-(p,q)}$ for the fourth sub pixel 49R in the pixel 48A of the same pixel unit 48 and the generation signal $X_{4B-(p,q)}$ of the fourth sub pixel 49R in the pixel 48B of the pixel unit 48 as the generation signal when obtaining the corrected output signal $XB_{4B-(p,q)}$ for the fourth sub pixel 49R in the pixel 48B of the pixel unit 48.

In other words, when calculating a corrected output signal of a sub pixel in a certain pixel (the pixel 48A or the pixel 48B), the signal processing unit 20 performs the averaging process of the generation signal of the sub pixel included in the certain pixel and the generation signal of the sub pixel of another pixel (the pixel 48B or the pixel 48A) belonging to the same pixel unit 48. In other words, as a counterpart pixel used for performing the averaging process, the signal processing unit 20 selects a pixel belonging to the same pixel unit 48 but does not select a pixel belonging to a different pixel unit 48. The signal processing unit 20 stores another pixel belonging to the same pixel unit 48, which is the pairing counterpart used in the averaging process in the pairing storage unit 27. The averaging processing unit 24 of the signal processing unit 20 reads information on the pixel as the pairing counterpart stored in the pairing storage unit 27 and performs the averaging process.

More specifically, the averaging processing unit 24 calculates the corrected output signal $XA_{3A-(p,q)}$ of the third sub pixel 49G in the pixel 48A of the (p,q)-th pixel unit 48 based on the following Formula (9):

$$XA_{3A-(p,q)}=(f\cdot X_{3A-(p,q)}+g\cdot X_{3B-(p,q)})/(f+g) \quad (9)$$

Here, f and g are certain coefficients, and in the first embodiment, f and g are 1. f and g are not limited to 1 as long as the corrected output signal $XA_{3B-(p,q)}$ is obtained by averaging $X_{3A-(p,q)}$ and $X_{3B-(p,q)}$ at a certain ratio. The averaging process by the averaging processing unit 24 is not limited to Formula (9) , and the averaging process may be performed, for example, a geometric mean or the like. For example, preferably, $XA_{3A-(p,q)}$ is a value of a smaller value of $X_{3A-(p,q)}$ and $X_{3B-(p-1,q)}$ to a larger value of $X_{3A-(p,q)}$ and $X_{3B-(p-1,q)}$. The averaging processing unit 24 preferably obtains the corrected output signal $XA_{3A-(p,q)}$ by averaging $X_{3A-(p,q)}$ and $X_{3B-(p-1,q)}$.

The averaging processing unit 24 calculates the corrected output signal $XB_{4B-(p,q)}$ of the fourth sub pixel 49R in the pixel 48B of the (p,q)-th pixel unit 48 based on the following Formula (10):

$$XB_{4B-(p,q)}=(h\cdot X_{4B-(p,q)}+i\cdot X_{4A-(p,q)})/(h+i) \quad (10)$$

Here, h and i are certain coefficients, and in the first embodiment, h and i are 1. h and i are not limited to 1 as long as the corrected output signal $XB_{4B-(p,q)}$ is obtained by averaging $X_{4A-(p,q)}$ and $X_{4B-(p,q)}$ at a certain ratio. For example, it is preferable that h and f have the same value, and i and g have the same value. The averaging process by the averaging processing unit 24 is not limited to Formula (10), and the averaging process may be performed, for example, by the geometric mean or the like. For example, $XB_{4B-(p,q)}$ is preferably a value of a smaller value of $X_{4B-(p,q)}$ and $X_{4A-p-1,q)}$ to a larger value of $X_{4B-(p,q)}$ and $X_{4A-(p-1,q)}$.

The averaging processing unit 24 preferably obtains the corrected output signal $XB_{4B-(p,q)}$ by averaging $X_{4A-p,\ q)}$ and $X_{4B-(p-1,q)}$.

Next, a method of obtaining the output signals $X_{1A-(p,q)}$ and $X_{2A-(p,q)}$ and the generation signal values $X_{3A-(p,q)}$ and $X_{4A-(p,q)}$ for the pixel 48A of the (p,q)-th pixel unit 48 and a method of obtaining the output signal values $X_{1B-(p,q)}$ and $X_{2B-(p,q)}$ and the generation signal values $X_{3B-(p,q)}$ and $X_{4B-p,\ q)}$ for the pixel 48B of the (p,q)-th pixel unit 48 (the expansion process) will be described. The following process is performed such that the ratio the luminance of the first color (the original color) displayed by (the first sub pixel 49B+the second sub pixel 49W), the luminance of the third color (the original color) displayed by the third sub pixel 49G+the second sub pixel 49W), and the luminance of the fourth color (the original color) displayed by (the fourth sub pixel 49R+the second sub pixel 49W) is maintained. In addition, the following process is performed such that a color tone is held (maintained). Moreover, the following process is performed such that gradation-luminance characteristic (a gamma characteristic, a γ characteristic) is held (maintained).

First Process

First, the signal processing unit 20 obtains the saturation S and the brightness V(S) of a plurality of pixels 48A and a plurality of pixels 48B based on the input signal values of the sub pixels 49 of a plurality of pixels 48A and a plurality of pixels 48B. Specifically, $S_{(p,q)}$ and $V(S)_{(p,q)}$ are obtained based on the signal value $x_{1A-(p,q)}$ serving as the input signal of the first sub pixel 49B of the pixel 48A of the (p,q)-th pixel unit 48, the signal value $x_{3A-(p,q)}$ serving as the input signal of the third sub pixel 49G, and the signal value $x_{4A-(p,q)}$ serving as the input signal of the fourth sub pixel 49R using Formulas (5) and (6) . Similarly, $S_{(p,q)}$ and $V(S)_{(p,q)}$ are obtained based on the signal value $x_{1B-(p,q)}$ serving as the input signal of the first sub pixel 49B of the pixel 48B of the (p,q)-th pixel 48, the signal value $x_{3B-(p,q)}$ serving as the input signal of the third sub pixel 49G, and the signal value $x_{4B-(p,q)}$ serving as the input signal of the fourth sub pixel 49R using Formulas (5) and (6) . The signal processing unit 20 performs this process on all the pixels 48A and 48B.

Second Process

Then, the signal processing unit 20 obtains the expansion coefficient α(S) based on Vmax(S)/V(S) obtained with respect to a plurality of pixel units 48 using Formula (11).

$$\alpha(S)=V\max(S)/V(S) \quad (11)$$

Third Process

Then, the signal processing unit 20 obtains the signal value $X_{2A-(p,q)}$ for the pixel 48A of the (p,q)-th pixel unit 48 based on at least the signal value $x_{1A-(p,q)}$, the signal value $x_{3A-(p,q)}$, and the signal value $x_{4A-(p,q)}$ of the input signals. In the present embodiment, the signal processing unit 20 decides the signal value $X_{2A-(p,q)}$ based on $Min_{(p,q)}$, the expansion coefficient α, and the constant χ. More specifically, the signal processing unit 20 obtains the signal value $X_{2A-(p,q)}$ using Formula (4) as described above. Similarly, the signal processing unit 20 obtains the signal value $X_{2B-(p,q)}$ for the pixel 48B of the (p,q)-th pixel unit 48 using Formula (4) . The signal processing unit 20 obtains the signal values $X_{2A-(p,q)}$ and $X_{2B-(p,q)}$ for the pixels 48A and 48B of all $P_0 \times Q_0$ pixel units 48.

Fourth Process

Thereafter, the signal processing unit 20 obtains the output signal value $X_{1A-(p,q)}$ for the pixel 48A of the (p,q)-th pixel unit 48 based on the input signal value $x_{1A-(p,q)}$, the expansion coefficient α, and the output signal value $X_{2A-(p,q)}$, obtains the generation signal value $X_{3A-(p,q)}$ based on the input signal value $x_{3A-(p,q)}$, the expansion coefficient α, and the output signal value $X_{2A-(p,q)}$ and obtains the generation signal value $X_{4A-(p,q)}$ based on the input signal value $x_{4A-(p,q)}$, the expansion coefficient α, and the output signal value $X_{2A-(p,q)}$. Specifically, the signal processing unit 20 obtains the output signal value $X_{1A-(p,q)}$, the generation signal value $X_{3A-(p,q)}$, and the generation signal value $X_{4A-(p,q)}$ for the pixel 48A of the (p,q)-th pixel unit 48 using Formulas (1) to (3). Similarly, the signal processing unit 20 obtains the output signal value $X_{1B-(p,q)}$ for the pixel 48B of the (p,q)-th pixel unit 48 based on the input signal value $x_{1B-(p,q)}$, the expansion coefficient α, and the output signal value $X_{2B-(p,q)}$, obtains the generation signal value $X_{3B-(p,q)}$ based on the input signal value $x_{3B-(p,q)}$, the expansion coefficient α, and the output signal value $X_{2B-(p,q)}$, and obtains the generation signal value $X_{4B-(p,q)}$ based on the input signal value $x_{4B-(p,q)}$, the expansion coefficient α, and the output signal value $X_{2B-(p,q)}$. The signal processing unit 20 obtains the output signal value $X_{1B-(p,q)}$, the generation signal value $X_{3B-(p,q)}$, and the generation signal value $X_{4B-(p,q)}$ for the pixel 48B of the (p,q)-th pixel unit 48 using Formulas (1) to (3).

Figure 8:
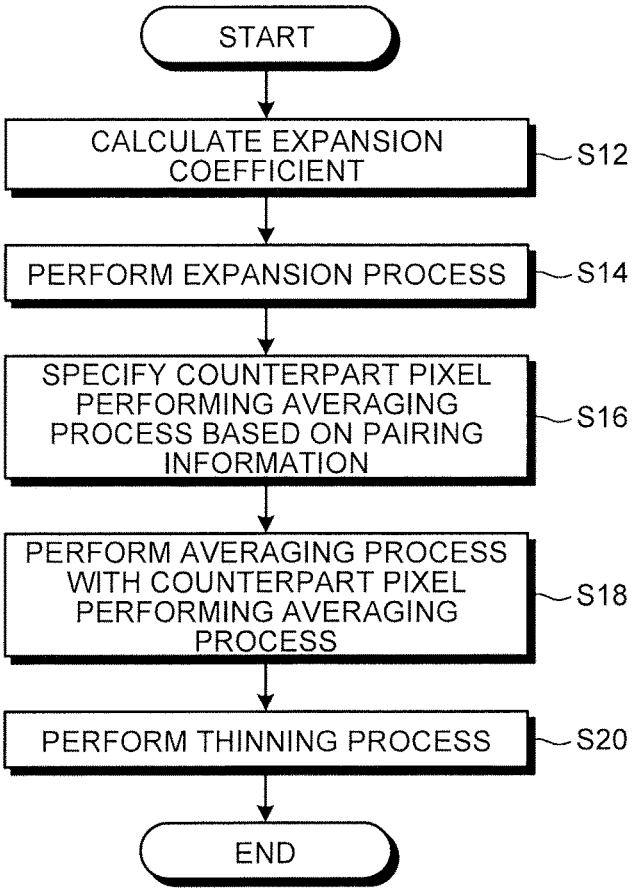
FIG. 8 is a flowchart illustrating steps of an averaging process according to the first embodiment.

Next, the averaging process by the signal processing unit 20 will be described. FIG. 8 is a flowchart illustrating steps of the averaging process according to the first embodiment.

As illustrated in FIG. 8, the signal processing unit 20 first calculates the expansion coefficient α based on the input signals to the respective sub pixels (step S12). Specifically, the signal processing unit 20 obtains the expansion coefficient α(S) using Formula (11).

After calculating the expansion coefficient α, the signal processing unit 20 performs the expansion process based on the input signals for the respective sub pixels and the calculated expansion coefficient α (step S14). Specifically, as described above, the signal processing unit 20 obtains the output signal value $X_{2A-(p,q)}$ of the second sub pixel 49W in the pixel 48A of the (p,q)-th pixel unit 48 and the output signal value $X_{2B-(p,q)}$ of the second sub pixel 49W in the pixel 48B of the (p,q)-th pixel unit 48 using Formula (4). The signal processing unit 20 obtains the output signal value $X_{1A-(p,q)}$ of the first sub pixel 49B, the generation signal value $X_{3A-(p,q)}$ of the third sub pixel 49G, and the generation signal value $X_{4A-(p,q)}$ of the fourth sub pixel 49R in the pixel 48A of the (p,q)-th pixel unit 48 using Formulas (1) to (3). The signal processing unit 20 obtains the output signal value $X_{1B-(p,q)}$ of the first sub pixel 49B, the generation signal value $X_{3B-(p,q)}$ of the third sub pixel 49G, and the generation signal value $X_{4B-(p,q)}$ of the fourth sub pixel 49R in the pixel 48B of the (p,q)-th pixel unit 48 using Formulas (1) to (3).

After calculating the respective signals through the expansion process, the signal processing unit 20 specifies a counterpart pixel used for performing the averaging process based on pairing information indicating information on each pixel serving as a pairing counterpart used in the averaging process (step S16). Specifically, when the averaging process is performed on the pixel 48A of the (p,q)-th pixel unit 48, the signal processing unit 20 specifies the pixel 48B of the (p,q)-th pixel unit 48 belonging to the same pixel unit 48 as the pixel of the pairing counterpart used in the averaging process. Further, when the averaging process is performed on the pixel 48B of the (p,q)-th pixel unit 48, the signal processing unit 20 specifies the pixel 48A of the (p,q)-th pixel unit 48 belonging to the same pixel unit 48 as the pixel of the pairing counterpart used in the averaging process. In other words, in the first embodiment, the signal processing unit 20 specifies a pixel that belongs to the same pixel unit and is adjacent to a pixel on which the average processing is performed in the Y direction as the pairing counterpart. For example, when the averaging process is performed on the pixel 48S, the signal processing unit 20 specifies the pixel 48U that belongs to the same pixel unit and is adjacent to the pixel 48S in the column direction as the pairing counterpart. Further, when the averaging process is performed on the pixel 48U, the signal processing unit 20 specifies the pixel 48S that belongs to the same pixel unit and is adjacent to the pixel 48U in the column direction as the pairing counterpart. Step S16 is performed after the expansion process is performed in step S14, but the order is not limited to this example, and, for example, Step S16 may be performed before step S14, After the counterpart pixel performing the averaging process is specified, the signal processing unit 20 performs the averaging process to average the generation signal of the sub pixel in each pixel and the generation signal of the sub pixel in the specified counterpart pixel for the averaging process (step S18). Specifically, the signal processing unit 20 calculates the corrected output signal $XA_{3A-(p,q)}$ of the third sub pixel 49G in the pixel 48A of the (p,q)-th pixel unit 48 based on the generation signal value $X_{3A-(p,q)}$ of the third sub pixel 49G in the pixel 48A of the (p,q)-th pixel unit 48 and the generation signal value $X_{3B-(p,q)}$ of the third sub pixel 49G of the pixel 48B of the (p,q)-th pixel unit 48 belonging to the same pixel unit 48. The signal processing unit 20 calculates the corrected output signal $XA_{4B-(p,q)}$ of the fourth sub pixel 49R in the pixel 48B of the (p,q)-th pixel unit 48 based on the generation signal value $X_{4B-(p,q)}$ of the fourth sub pixel 49R in the pixel 48B of the (p,q)-th pixel unit 48 and the generation signal value $X_{4A-(p,q)}$ of the fourth sub pixel 49R in the pixel 48A of the (p,q)-th pixel unit 48 belonging to the same pixel unit 48. More specifically, the signal processing unit 20 calculates the corrected output signal $XA_{3A-(p,q)}$ using Formula (9). Similarly, the signal processing unit 20 calculates the corrected output signal $XB_{4B-(p,q)}$ using Formula (10).

After performing the averaging process, the signal processing unit 20 performs the thinning process (step S20). More specifically, the signal processing unit 20 selects an output signal and a corrected output signal of a sub pixel except a sub pixel that is not included in each pixel, and generates a thinned output signal. Specifically, the signal processing unit 20 generates a thinned output signal having only the signal value $X_{1A-(p,q)}$ of the first sub pixel 49B, the signal value $X_{2A-(p,q)}$ of the second sub pixel 49W, and the signal value $X_{3A-(p,q)}$ of the third sub pixel 49G in the pixel 48A of the (p,q)-th pixel unit 48. Further, the signal processing unit 20 generates a thinned output signal having only the signal value $X_{1B-(p,q)}$ of the first sub pixel 49B, the signal value $X_{2B-(p,q)}$ of the second sub pixel 49W, and the signal value $X_{4B-(p,q)}$ of the fourth sub pixel 49R in the pixel 48B of the (p,q)-th pixel unit 48. Then, the signal processing unit 20 ends the signal processing and outputs each thinned output signal to the image-display-panel driving unit 30.

First Display Image Example

Next, a display image when an image is displayed on the image display panel 40 will be described. Display image examples which will be described below include examples with the pixel array and the image processing that are different from those of the first embodiment, but all the input signals are the same as those in the first embodiment. First, an image display by an image display panel 40X including only the first sub pixel 49B, the third sub pixel 49G, and the fourth sub pixel 49R when the averaging process is not performed will be described. In other words, the image display panel 40X is configured with only pixels 48X having three colors of R, G, and B unlike the image display panel 40 according to the first embodiment.

Figure 9:
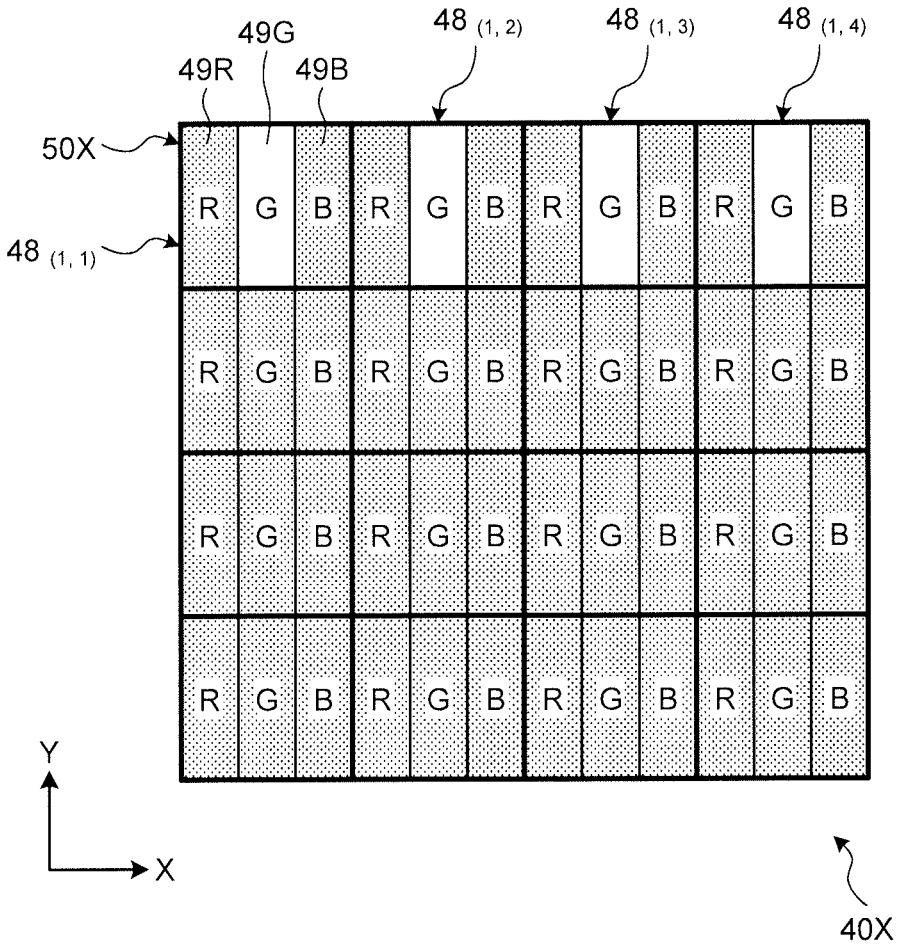
FIG.9 RELATED ART
FIG. 9 is a schematic diagram illustrating an image display example of an image display panel configured with only pixels including three colors of R, G, and B.

FIG. 9 is a schematic diagram illustrating an image display example of an image display panel configured with only pixels having three colors of R, G, and B. The image display panel 40X is configured with only pixels 48X each including a first sub pixel 49B, a third sub pixel 49G, and a fourth sub pixel 49R as illustrated in FIG. 9. In the pixels 48X, the fourth sub pixel 49R, the third sub pixel 49G, and the first sub pixel 49B are arranged in the X direction in a stripe form in the described order. In the image display panel 40X, a region of the first sub pixel 49B, the third sub pixel 49G, and the fourth sub pixel 49R is identical to a pixel display region 50X. In other words, a region of the pixel 48X is identical to the pixel display region 50X. The pixel display region 50X has the same shape as the pixel display region 50S according to the first embodiment.

FIG. 9 illustrates an example in which when the control device 11 outputs input signals for displaying straight lines of green extending in first row of a pixel array in the X direction, the image display panel 40X displays an image based on the input signals. The averaging process described in the first embodiment is not performed. In the image display panel 40X, when the (p,q)-th pixel 48 (here, $1 \le p \le P$ and $1 \le q \le Q$) is described as a pixel $_{(p,q)}$, the third sub pixels 49G of the pixel $\mathbf{48}_{(1,1)}$, the pixel $\mathbf{48}_{(1,2)}$, the pixel $\mathbf{48}_{(1,3)}$, and the pixel $\mathbf{48}_{(1,4)}$ are turned on as illustrated in FIG. 9. In the image display panel 40X, since all pixels include the third sub pixel 49G, and the third sub pixels 49G in the pixels 48X in the first row are turned on, a straight line of green extending in the first row in the X direction according to the input signals are displayed.

Figure 10:
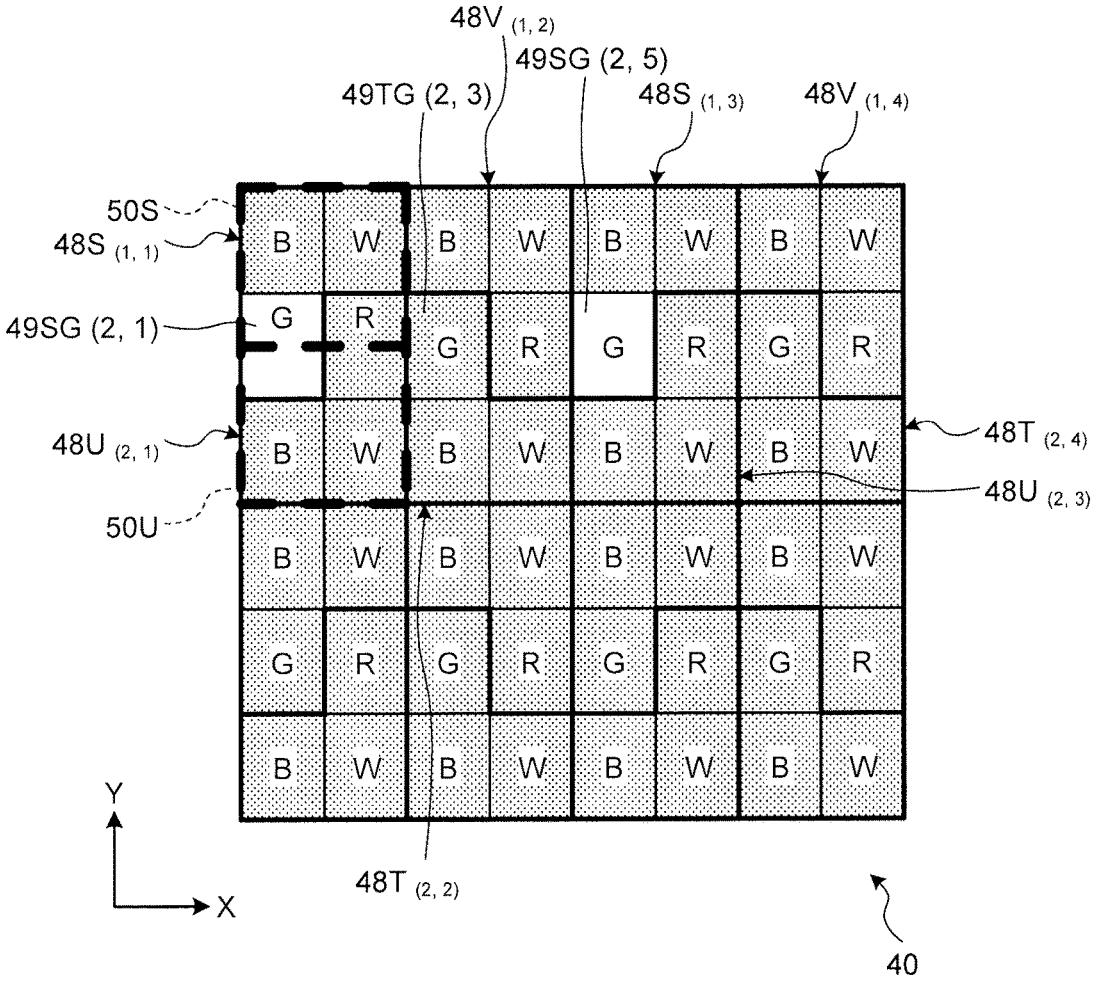
FIG.10 RELATED ART
FIG. 10 is a diagram illustrating an image display example of an image display panel according to a first comparative example.

Next, an example in which the image display panel 40 according to the first embodiment is used, but no averaging process is performed will be described as a first comparative example. FIG. 10 is a diagram illustrating an image display example of an image display panel according to the first comparative example. FIG. 10 illustrates an example in which when the control device 11 outputs input signals for displaying a straight line of green extending in the first row of a pixel array in the X direction, the image display panel 40 displays an image without performing the averaging process.

In the image display panel 40 according to the first comparative example, the third sub pixels 49G of the pixel 48$S_{(1,1)}$ and the pixel 48$S_{(1,3)}$ are turned on as illustrated in FIG. 10. In other words, in the image display panel 40, only the third sub pixel 49SG(2,1) and the third sub pixel 49SG(2,5) are turned on. In other words, when no averaging process is performed as in the first comparative example, the image display panel 40 is unlikely to suppress deterioration of an image, for example, when the straight line of green extending in the first row of the pixel array in the X direction is displayed.

Figure 11:
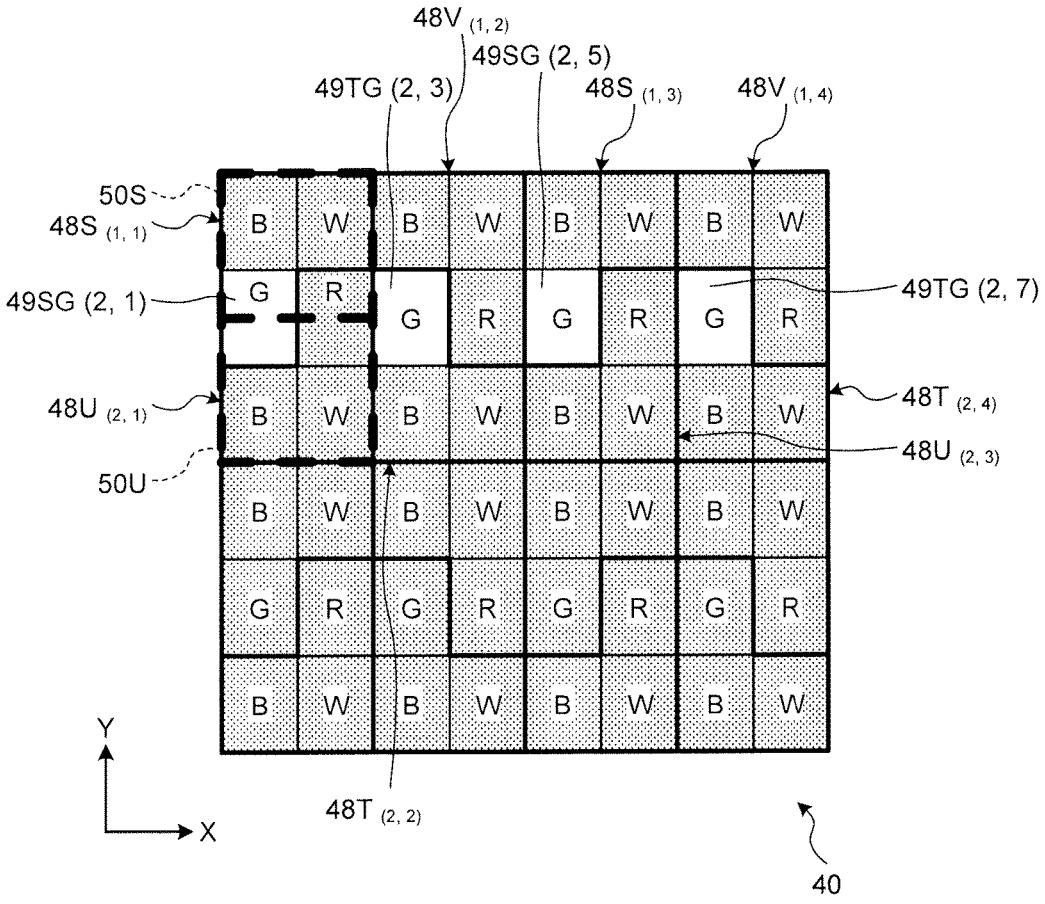
FIG. 11 is a diagram illustrating an image display example of an image display panel according to the first embodiment.

Next, an example of the first embodiment in which the averaging process is performed on a pixel with another pixel belonging to the same pixel unit 48 will be described. FIG. 11 is a diagram illustrating an image display example of the image display panel according to the first embodiment. FIG. 11 illustrates an example in which when the control device 11 outputs input signals for displaying the straight line of green extending in the first row of the pixel array in the X direction, the averaging process is performed according to the method of the first embodiment, and the image display panel 40 displays an image.

As illustrated in FIG. 11, when the averaging process according to the first embodiment is performed, in the image display panel 40, the third sub pixels 49G of the pixel 48$S_{(1,1)}$, the pixel 48$T_{(2,2)}$, the pixel 48$S_{(1,3)}$, and the pixel 48$T_{(2,4)}$ are turned on. In other words, in the image display panel 40, the third sub pixel 49SG(2,1), the third sub pixel 49TG(2,3), the third sub pixel 49SG(2,5), and the third sub pixel 49TG(2,7) in the array of the sub pixels 49 are turned on. The input signal for turning on the third sub pixel 49G is not input to the pixel 48$T_{(2,2)}$ and the pixel 48$T_{(2,4)}$. However, the averaging process is performed on the pixel 48$T_{(2,2)}$ with the pixel 48$V_{(1,2)}$ that belongs to the same pixel unit 48 and receives the input signal for turning on the third sub pixel 49G. Similarly, the averaging process is performed on the pixel 48$T_{(2,4)}$ with the pixel 48$V_{(1,4)}$ that receives the input signal for turning on the third sub pixel 49G. Thus, the third sub pixel 49TG(2,3) of the pixel 48$T_{(2,2)}$ and the third sub pixel 49TG(2,7) of the pixel 48$T_{(2,4)}$ are turned on.

As described above, when the averaging process according to the first embodiment is performed, the image display panel 40 turns on the third sub pixel 49SG(2,1), the third sub pixel 49TG(2,3), the third sub pixel 49SG(2,5), and the third sub pixel 49TG(2,7) and thus can display the straight line of green in the X direction according to the input signals. Thus, when the averaging process according to the first embodiment is performed, it is possible to suppress deterioration of an image. The third sub pixel 49SG(2,1), the third sub pixel 49TG(2,3), the third sub pixel 49SG(2,5), and the third sub pixel 49TG(2,7) undergo the averaging process based on a one-to-one arithmetic average. Thus, in this case, the value of the corrected output signal that has undergone the averaging process becomes half the value of the output signal that has not undergone the averaging process.

Second Display Image Example

Figure 12:
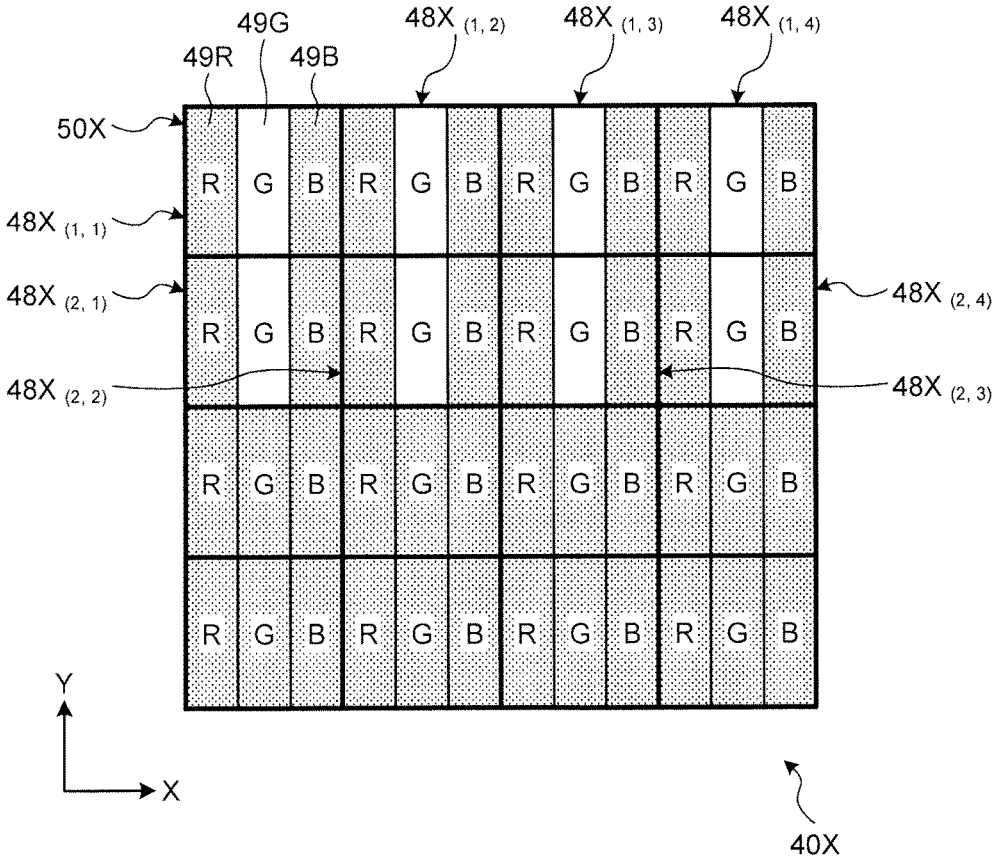
FIG.12 RELATED ART
FIG. 12 is a schematic diagram illustrating an image display example of an image display panel configured with only pixels having three colors of R, G, and B.

Next, second display image examples will be described. The second display image examples which will be described below include examples with the pixel array and the image processing that are different from those of the first embodiment, but all the input signals are the same as those in the first embodiment. First, a second image display by the image display panel 40X including only the first sub pixel 49B, the third sub pixel 49G, and the fourth sub pixel 49R when the averaging process is not performed will be described. FIG. 12 is a schematic diagram illustrating an image display example of an image display panel configured with only pixels including three colors of R, G, and B.

FIG. 12 illustrates an example in which when the control device 11 outputs input signals for displaying the straight lines of green extending in the first and second rows of the pixel array in the X direction, the image display panel 40X displays an image based on the input signals. The averaging process described in the first embodiment is not performed. In the image display panel 40X, when the (p,q)-th pixel 48 (here, $1 \le p \le P$ and $1 \le q \le Q$) is described as a pixel $_{(p,q)}$, the third sub pixels 49G of the pixel 48$X_{(1,1)}$, the pixel 48$X_{(1,2)}$, the pixel 48$X_{(1,3)}$, the pixel 48$X_{(1,4)}$, the pixel 48$X_{(2,1)}$, the pixel 48$X_{(2,2)}$, the pixel 48$X_{(2,3)}$, and the pixel 48$X_{(2,4)}$ are turned on as illustrated in FIG. 12. In the image display panel 40X, since all pixels include the third sub pixel 49G, and the third sub pixels 49G in the pixels 48X in the first and second rows are turned on, the straight lines of green extending in the first and second rows in the X direction according to the input signals are displayed.

Next, an example in which the averaging process is performed by a method different from that in the averaging process of the first embodiment will be described as a second comparative example. The image display panel of the second comparative example is the same image display panel 40 as that of the first embodiment. The averaging process according to the first embodiment uses another pixel belonging to the same pixel unit 48 as a counterpart side pixel, but the averaging process according to the second comparative example uses a pixel that is in a previous row and adjacent to each pixel in the Y direction as a counterpart side pixel. For example, the averaging process according to the second comparative example selects the pixel 48B that is in a previous row and adjacent to the pixel 48A in the Y direction as a counterpart used in the averaging process performed on the pixel 48A. In other words, in the second comparative example, for example, when the averaging process is performed on the pixel 48A of the (p,q)-th pixel unit 48, if the pixel 48B that is in the previous row and adjacent to the pixel 48A in the Y direction is the pixel 48B belonging to a different (p-1,q)-th pixel unit 48, the pixel 48B belonging to the different (p-1,q)-th pixel unit 48 is selected. The averaging process according to the second comparative example is performed similarly even in the case where a counterpart used in the averaging process performed on the pixel 48B is selected. Formulas (9) and (10) are used as a calculation formula of the averaging process of the second comparative example, similarly to the first embodiment.

Figure 13:
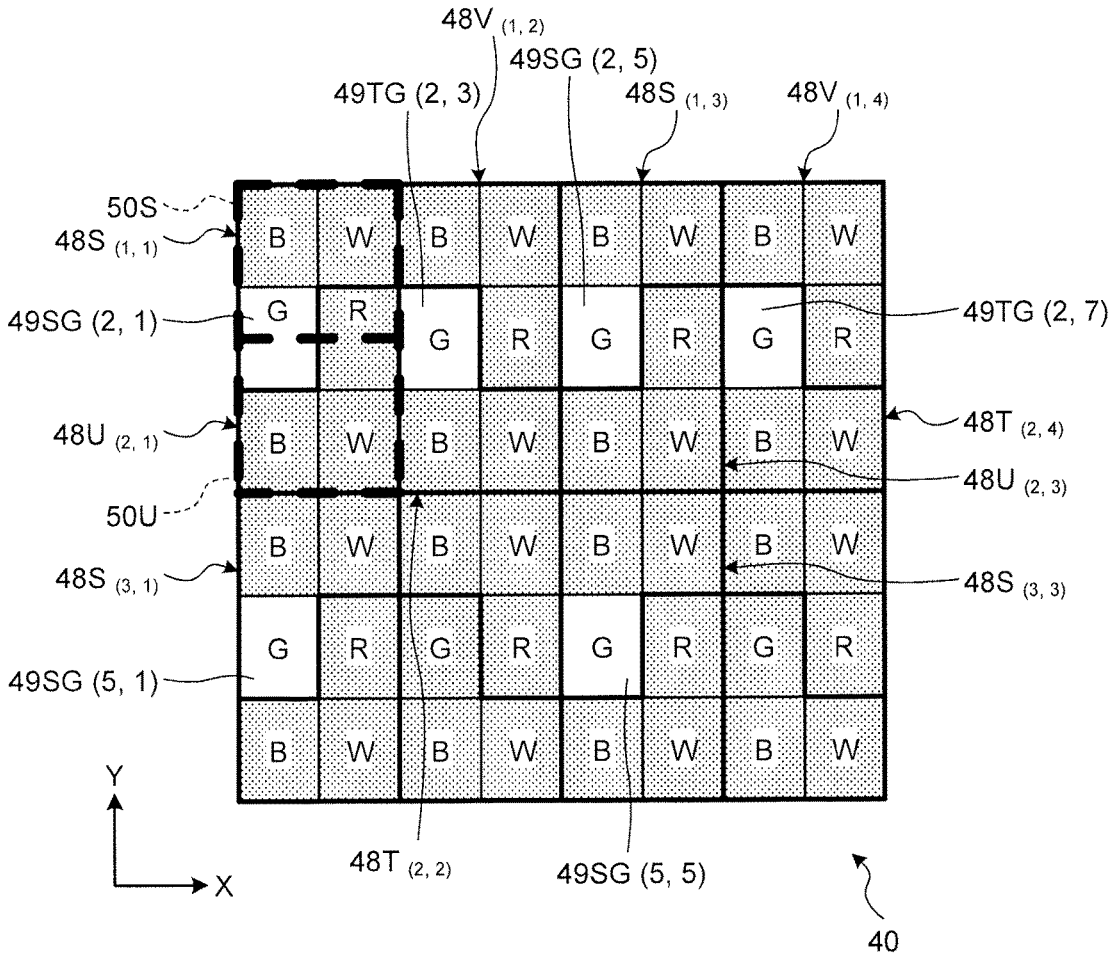
FIG.13 RELATED ART
FIG. 13 is a diagram illustrating an image display example of an image display panel according to a second comparative example.

FIG. 13 is a diagram illustrating an image display example of an image display panel according to the second comparative example. FIG. 13 illustrates an example in which when the control device 11 outputs input signals for displaying the straight lines of green extending in the first and second rows of the pixel array in the X direction, the averaging process is performed on a pixel using a pixel that is in the previous row and adjacent to the pixel in the column direction as the counterpart used in the averaging process as described above, and the image display panel 40 displays an image.

As illustrated in FIG. 13, in the image display panel 40 of the second comparative example, the third sub pixels 49G of the pixel 48$S_{(1,1)}$, the pixel 48$T_{(2,2)}$, the pixel 48$S_{(1,3)}$, the pixel 48$T_{(2,4)}$, the pixel 48$S_{(3,1)}$, and the pixel 48$S_{(3,3)}$ are turned on. Since the input signal for turning on the sub pixel 49G is input to the pixel 48$S_{(1,1)}$, the pixel 48$T_{(2,2)}$, the pixel 48$S_{(1,3)}$, and the pixel 48$T_{(2,4)}$, the sub pixels 49G are turned on.

On the other hand, the input signal for turning on the sub pixel 49G is not input to the pixel 48$S_{(3,1)}$ and the pixel 48$S_{(3,3)}$. However, in the second comparative example, the averaging process is performed on the pixel 48$S_{(3,1)}$ with the pixel 48$U_{(2,1)}$, and the averaging process is performed on the pixel 48$S_{(3,3)}$ with the pixel 48$U_{(2,3)}$. The input signal for turning on the third sub pixel 49G is input to the pixel 48$U_{(2,1)}$ and the pixel 48$U_{(2,3)}$. Thus, in the second comparative example, the third sub pixels 49G of the pixel 48$S_{(3,1)}$ and the pixel 48$S_{(3,3)}$ are turned on.

In other words, in the image display panel 40 of the second comparative example, the third sub pixel 49SG(2,1), the third sub pixel 49TG(2,3), the third sub pixel 49SG(2,5), the third sub pixel 49TG(2,7), the third sub pixel 49SG(5,1), and the third sub pixel 49SG(5,5) are turned on. In the second comparative example, it is difficult to display a straight line form by turning on the third sub pixel 49SG(5, 1) and the third sub pixel 49SG(5,5). In other words, in the image display panel 40 according to the second comparative example, when the averaging process is performed on a pixel together with a pixel belonging to a different pixel unit 48, an image is likely to deteriorate, for example, when it is desired to display the straight lines of green extending in the first and second rows in the X direction.

Figure 14:
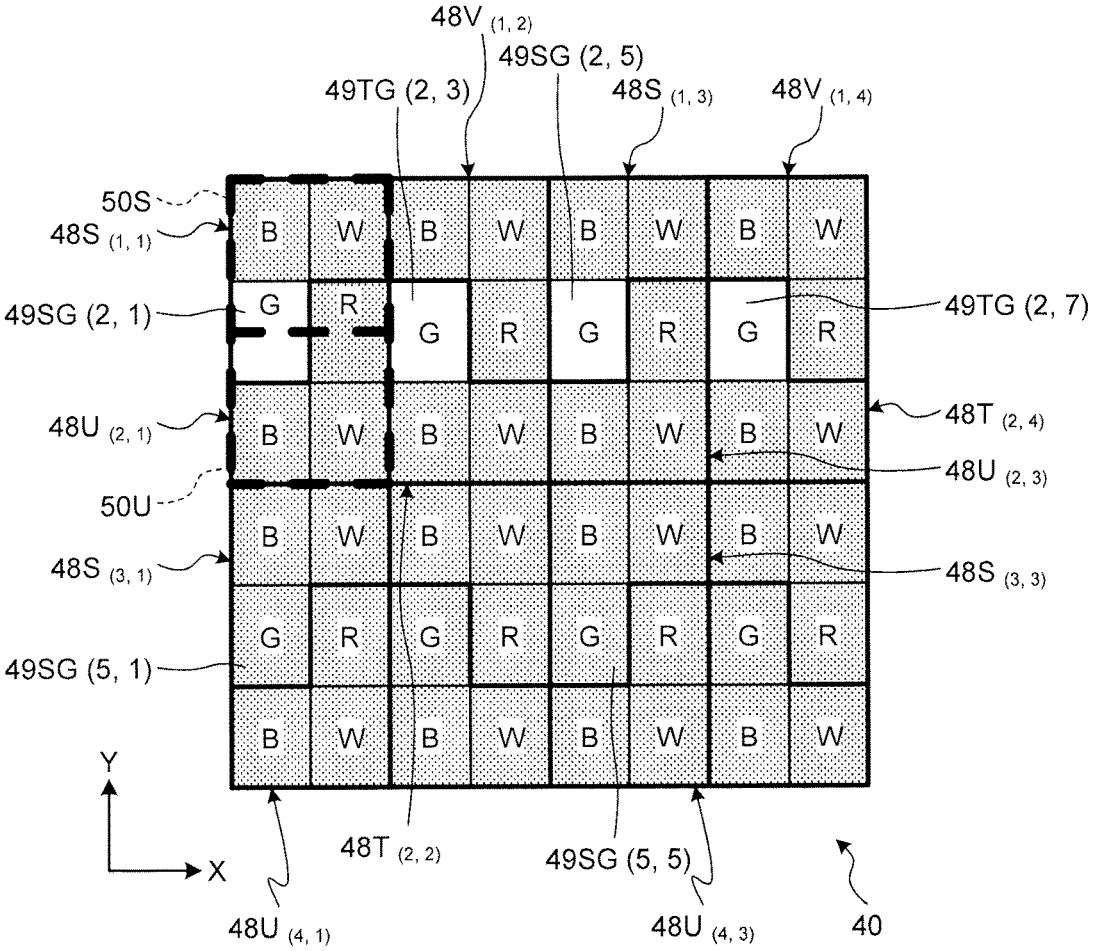
FIG. 14 is a diagram illustrating an image display example of the image display panel according to the first embodiment.

Next, an example of the first embodiment in which the averaging process is performed on a pixel together with another pixel belonging to the same pixel unit 48 will be described. FIG. 14 is a diagram illustrating an image display example of an image display panel according to the first embodiment. FIG. 14 illustrates an example in which when the control device 11 outputs input signals for displaying the straight lines of green extending in the first and second rows of the pixel array in the X direction, the averaging process is performed according to the method of the first embodiment, and the image display panel 40 displays an image.

As illustrated in FIG. 14, in the image display panel 40 of the first embodiment, the third sub pixels 49G of the pixel 48$S_{(1,1)}$, the pixel 48$T_{(2,2)}$, the pixel 48$S_{(1,2)}$, and the pixel 48$T_{(2,4)}$ are turned on. Since the input signal for turning on the sub pixel 49G is input to the pixel 48$S_{(1,1)}$, the pixel 48$T_{(2,2)}$, the pixel 48$S_{(1,3)}$, and the pixel 48$T_{(2,4)}$, the sub pixels 49G are turned on.

In the first embodiment, the sub pixels 49G of the pixel 48$S_{(3,1)}$ and the pixel 48$S_{(3,3)}$ are not turned on. The input signal for turning on the sub pixel 49G is not input to the pixel 48$S_{(3,1)}$ and the pixel 48$S_{(3,3)}$, and the averaging process is not performed on the pixel 48$S_{(3,1)}$ and the pixel 48$S_{(3,3)}$ together with the pixel to which the input signal for turning on the sub pixel 49G is input. The averaging process is performed on the pixel 48$S_{(3,1)}$ with the pixel 48$U_{(4,1)}$ to which the input signal for turning on the sub pixel 49G is not input, and the averaging process is performed on the pixel 48$S_{(3,3)}$ with the pixel 48$U_{(4,3)}$ to which the input signal for turning on the sub pixel 49G is not input. Thus, in the first embodiment, the sub pixels 49G of the pixel 48$S_{(3,1)}$ and the pixel 48$S_{(3,3)}$ are not turned on.

In other words, in the image display panel 40 of the first embodiment, the third sub pixel 49SG(2,1), the third sub pixel 49TG(2,3), the third sub pixel 49SG(2,5), and the third sub pixel 49TG(2,7) are turned on. In other words, according to the averaging process of the first embodiment, it is possible to display the straight line extending in the X direction according to instructions of the input signals by turning on only the third sub pixels 49G that is in the same row in the array of the sub pixels 49. Thus, according to the averaging process according to the first embodiment, it is possible to suppress deterioration of an image.

In the first embodiment, the pixel 48$S_{(1,1)}$ undergoes the averaging process together with the pixel 48$U_{(2,1)}$, the pixel 48$V_{(1,2)}$ undergoes the averaging process together with the pixel 48$T_{(2,2)}$, the pixel 48$S_{(1,3)}$ undergoes the averaging process together with the pixel 48$U_{(2,3)}$, and the pixel 48$V_{1,4)}$ undergoes the averaging process together with the pixel 48$T_{(2,4)}$. The input signal for turning on the sub pixel 49G is input to the pixel 48$S_{(1,1)}$, the pixel 48$U_{(2,1)}$, the pixel 48$V_{(1,2)}$, the pixel 48$T_{(2,2)}$, the pixel 48$S_{(1,3)}$, the pixel 48$U_{(2,3)}$, the pixel 48$V_{(1,4)}$, and the pixel 48$T_{(2,4)}$. Thus, in the first embodiment, the sub pixels 49G have the same lighting amount, and thus it is possible to form an appropriate straight line corresponding to the input signals.

In the image display device 10, when the averaging process described in the first embodiment is performed, it is possible to suppress deterioration of an image in an arbitrary pixel array. More specifically, in the image display device 10, the pixel including no third sub pixel 49G and the pixel including no fourth sub pixel 49R are alternately arranged, and when the averaging process described in the first embodiment is performed, it is possible to suppress deterioration of an image. An image display example when the averaging process described in the second comparative example is performed using an image display panel including a pixel array according to another example is compared with an image display example when the averaging process described in the first embodiment using the image display panel including a pixel array according to another example.

Figure 15A:
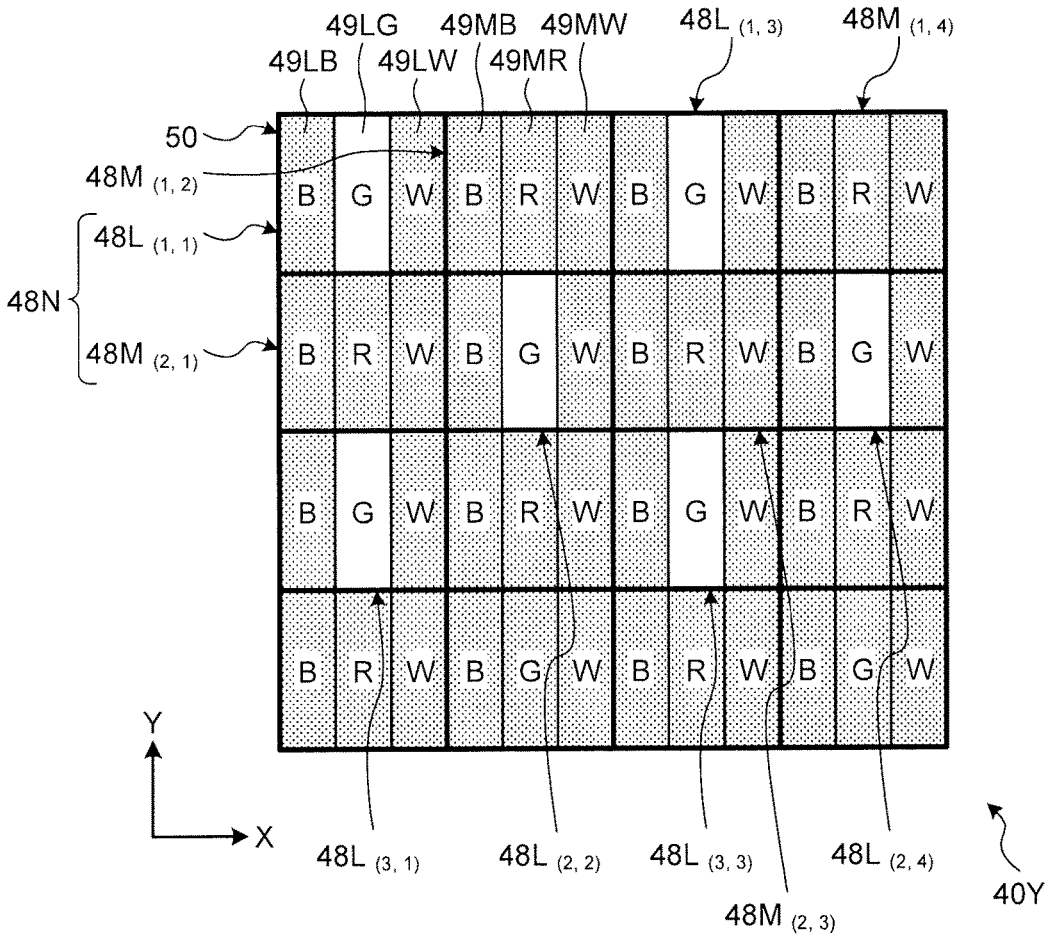
FIG. 15A is a diagram illustrating an image display example of an image display panel according to another example.

FIG. 15A is a diagram illustrating an image display example of an image display panel of another example. FIG. 15A illustrates an example in which the averaging process described in the second comparative example is performed on an image display panel 40Y of an image display device 10Y according to another example based on input signals for displaying the straight lines of green extending in the first and second rows of the pixel array in the X direction, similarly to the second display image example, and thus an image is displayed. Similarly to the image display panel 40 according to the first embodiment, the image display panel 40Y according to another example includes the first sub pixel 49B, the second sub pixel 49W, the third sub pixel 49G, and the fourth sub pixel 49R as illustrated in FIG. 15A. Since the second sub pixel 49W is provided, the image display panel 40Y can make an image brighter than in the image display panel 40X in some instances.

As illustrated in FIG. 15A, in the image display panel 40Y, pixel units 48N each including a pixel 48L and a pixel 48M which are adjacent in the Y direction are arranged in the X direction and the Y direction in the 2D matrix form. In the adjacent pixel units 48N, the positions of the pixel 48L and the pixel 48M are opposite. In the pixel 48L, a first sub pixel 49LB, a third sub pixel 49LG, and a second sub pixel 49LW are arranged in the X direction in a stripe form in the described order. In the pixel 48M, a first sub pixel 49MB, a fourth sub pixel 49MR, and a second sub pixel 49MW are arranged in the X direction in a stripe form in the described order. In other words, in the image display panel 40Y, similarly to the image display panel 40 according to the first embodiment, the pixel including no third sub pixel 49G and the pixel including no fourth sub pixel 49R alternately arranged.

Similarly to the averaging process according to the second comparative example, in the image display panel 40Y, a pixel that is in a previous row and adjacent to a certain pixel in the Y direction is regarded as a counterpart for the averaging process performed on the certain pixel.

As illustrated in FIG. 15A, when the averaging process of the second comparative example is performed for the image display panel 40Y, the third sub pixels 49G of the pixel 48$L_{(1,1)}$, the pixel 48$L_{(2,2)}$, the pixel 48$L_{(1,3)}$, the pixel 48$L_{(2,4)}$, the pixel 48$L_{(3,1)}$, and the pixel 48$L_{(3,3)}$ are turned on. Since the input signal for turning on the sub pixel 49G is input to the pixel 48$L_{(1,1)}$, the pixel 48$L_{(2,2)}$, the pixel 48$L_{(1,3)}$, and the pixel 48$L_{(2,4)}$, the sub pixels 49G thereof are turned on. The pixel 48$L_{(3,1)}$ and the pixel 48$L_{(3,3)}$ undergo the averaging process together with the pixel 48$M_{(2,1)}$ and the pixel 48$M_{(2,3)}$ in the previous row in the Y direction, respectively. The input signal for turning on the third sub pixel 49G is input to the pixel 48$M_{(2,1)}$ and the pixel 48$M_{(2,3)}$. Thus, when the averaging process of the second comparative example is performed for the image display panel 40Y, the third sub pixels 49G of the pixel 48$L_{(3,1)}$ and the pixel 48$L_{(3,3)}$ are turned on.

Thus, when the averaging process of the second comparative example is performed for the image display panel 40Y, the pixel 48$L_{(3,1)}$ and the pixel 48$L_{(3,3)}$ are turned on. Thus, lines across three rows are displayed even when it is desired to display straight lines across two rows along the X direction, and thus an image is likely to deteriorate. In addition, since the input signal for turning on its own pixel is not input to the pixel 48$L_{(3,1)}$ and the pixel 48$L_{(3,3)}$, the display images of the pixel 48$L_{(3,1)}$ and the pixel 48$L_{(3,3)}$ become darker than an image displayed by the output signal to the third sub pixel 49G when no averaging process is performed. For example, even if there is pixels in a previous row that are used as counterparts in the averaging process performed on the pixel 48$L_{(1,1)}$ and the pixel 48$L_{(1,3)}$, the input signal for turning on is not input to the pixels in the previous row. Thus, in this case, the display images of the pixel 48$L_{(1,1)}$ and the pixel 48$L_{(1,3)}$ become dark as well. In other words, when the averaging process of the second comparative example is performed for the image display panel 40Y, the lines of the first row and the third rows among the lines across three rows are likely to become dark, resulting in image deterioration.

Figure 15B:
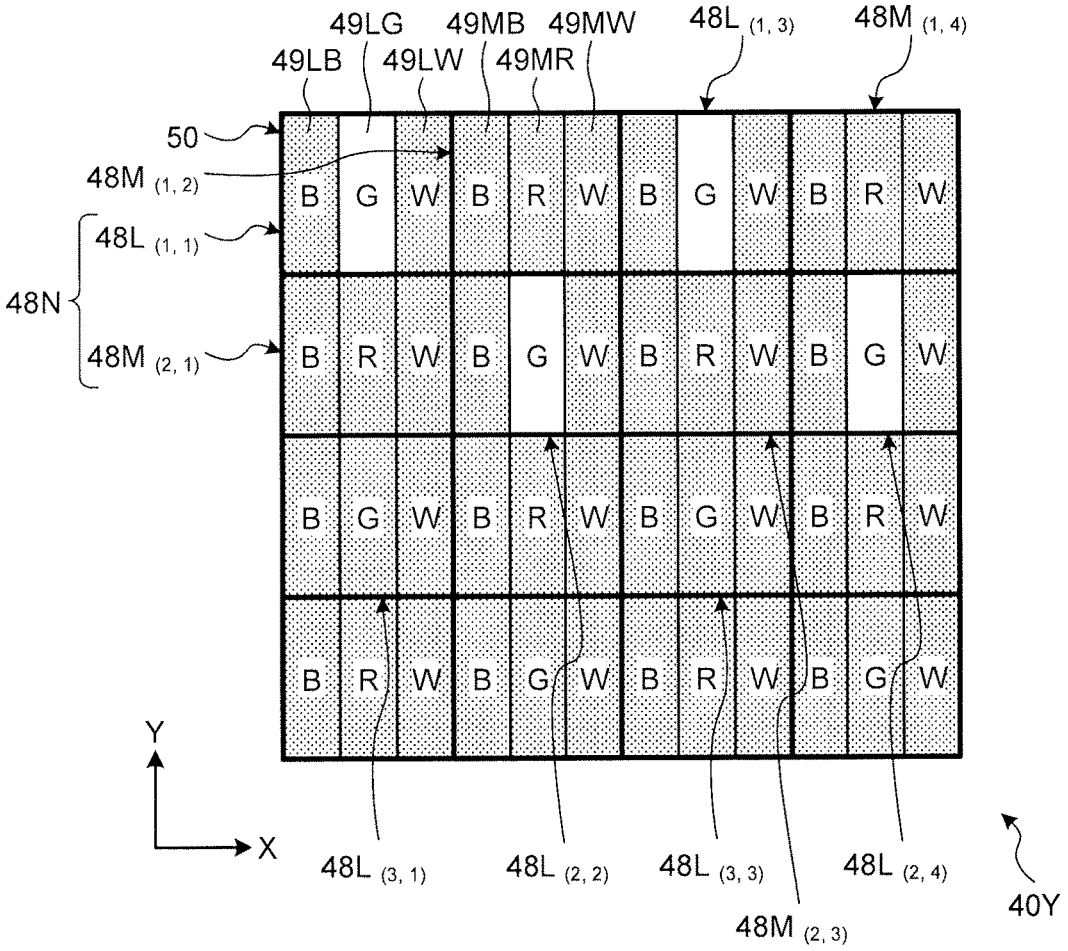
FIG. 15B is a diagram illustrating an image display example of an image display panel according to another example.

FIG. 15B is a diagram illustrating an image display example of an image display panel according to another example. FIG. 15B illustrates an example in which in the image display panel 40Y of the image display device 10Y according to another example, an image is displayed by performing the averaging process described in the first embodiment based on input signals for displaying the straight lines of green extending in the first and second rows of the pixel array in the X direction, similarly to the second display image example. In other words, in each pixel of the image display panel 40Y, the pixel 48L and the pixel 48M that belong to the same pixel unit 48N and are adjacent to each other in the Y direction each function as a counterpart side pixel in the averaging process performed on the other pixel thereof. For example, for the pixel 48$L_{(1,1)}$ illustrated in FIG. 15B, the pixel 48$M_{(2,1)}$ that belongs to the same pixel unit 48N and is adjacent to the pixel 48$L_{(1,1)}$ in the Y direction functions as a counterpart side pixel in the averaging process performed on the pixel 4 8$L_{(1,1)}$. For the pixel 48$M_{(2,1)}$, the pixel 48$L_{(1,1)}$ that belongs to the same pixel unit 48N and is adjacent to pixel 48$M_{(2,1)}$ in the Y direction functions as a counterpart side pixel in the averaging process performed on the pixel 48$M_{(2,1)}$.

As illustrated in FIG. 15B, when the averaging process of the first embodiment is performed for the image display panel 40Y, the third sub pixels 49G of the pixel 48$L_{(1,1)}$, the pixel 48$L_{(2,2)}$, the pixel 48$L_{(1,3)}$, and the pixel 48$L_{(2,4)}$ are turned on. Since the input signal for turning on the sub pixel 49G is input to the pixel 48$L_{(1,1)}$, the pixel 48$L_{(2,2)}$, the pixel 48$L_{(1,3)}$, and the pixel 48$L_{(2,4)}$, the sub pixels 49G thereof are turned on. However, when the averaging process according to the first embodiment is performed, the pixel 48$L_{(3,1)}$ and the pixel 48$L_{(3,3)}$ do not undergo the averaging process together with the pixel to which the input signal for turning on the sub pixel 49G is input. Thus, when the averaging process of the first embodiment is performed for the image display panel 40Y, the pixel 48$L_{(3,1)}$ and the pixel 48$L_{(3,3)}$ are not turned on. The input signal for turning on the sub pixel 49G is input to a pixel serving as a counterpart side pixel in the averaging process performed on each of the third sub pixels 49G of the pixel 48$L_{(1,1)}$, the pixel 48$L_{(2,2)}$, the pixel 48$L_{(1,3)}$, and the pixel 48$L_{(2,4)}$. Thus, an image displayed by the third sub pixels 49G of the pixel 48$L_{(1,1)}$, the pixel 48$L_{(2,2)}$, the pixel 48$L_{(1,3)}$, and the pixel 48$L_{(2,4)}$ does not become dark.

Thus, when the averaging process of the first embodiment is performed for the image display panel 40Y, only the pixel 48$L_{(1,1)}$, the pixel 48$L_{(2,2)}$, the pixel 48$L_{(1,3)}$, and the pixel 48$L_{(2,4)}$ are turned on. Thus, lines across two rows are displayed according to the input signals without displaying lines across three rows. Further, an image of each of two lines does not become dark. Thus, when the averaging process of the first embodiment is performed in the image display panel 40Y, it is possible to suppress deterioration of an image. As described above, when the averaging process described in the first embodiment is performed, for example, the image display device 10 can suppress deterioration of an image in an arbitrary pixel array such as the image display panel 40Y.

Figure 16:
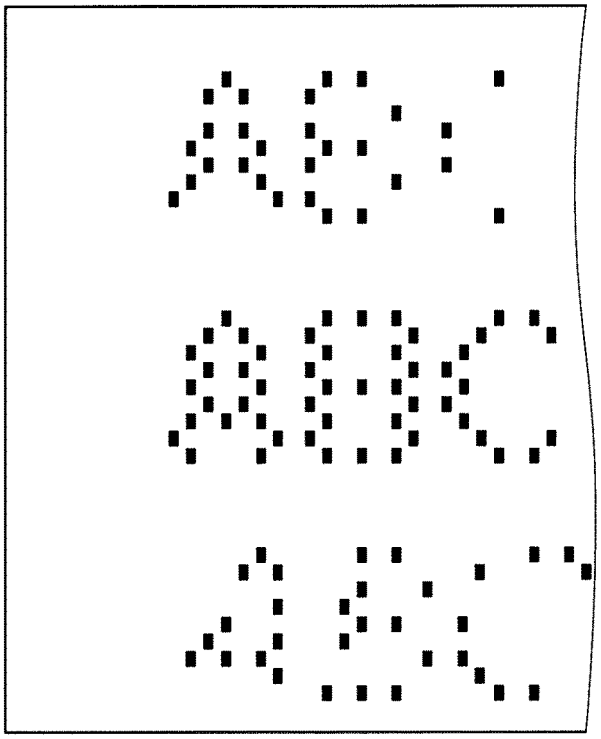
FIG. 16 is a schematic diagram illustrating an example in which letters are displayed on an image display panel according to another example.
Figure 17:
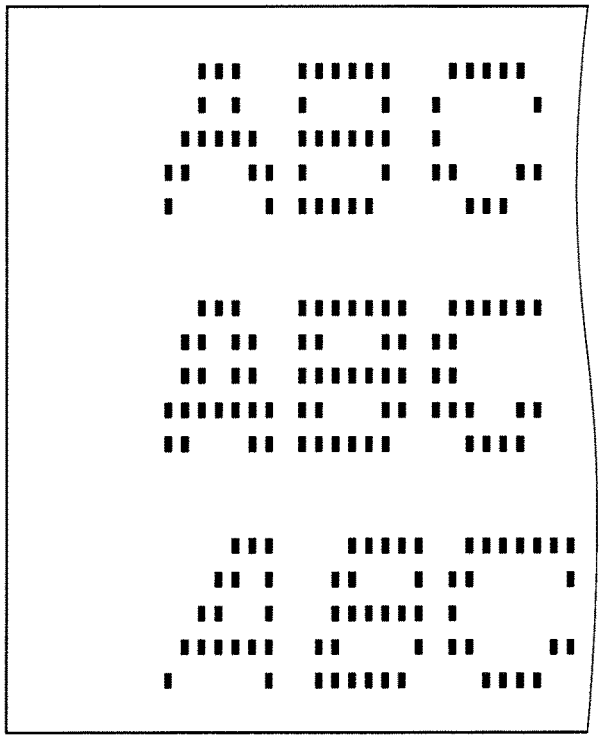
FIG. 17 is a schematic diagram illustrating an example in which letters are displayed on the image display panel according to the first embodiment.

Next, a letter display example when the averaging process according to the first embodiment is performed will be described. FIG. 16 is a schematic diagram illustrating an example in which letters are displayed on an image display panel according to another example. FIG. 17 is a schematic diagram illustrating an example in which letters are displayed on the image display panel according to the first embodiment. FIG. 16 illustrates an example in which the averaging process is not performed for the image display panel 40 according to another example described above, and letters such as ABC are displayed in three different types of fonts. FIG. 17 illustrates an example in which the averaging process according to the first embodiment is performed for the image display panel 40 according to the first embodiment, and letters such as ABC are displayed in three different types of fonts as in FIG. 16. When FIG. 16 is compared with FIG. 17, it is understood that letters such as ABC displayed in FIG. 17 are more easily recognized than letters such as ABC displayed in FIG. 16. In other words, when the averaging process according to the first embodiment is performed for the image display panel 40 according to the first embodiment, deterioration of an image is suppressed.

Second Embodiment

Next, a second embodiment will be described. A display device 10*a* according to the second embodiment differs in that a pixel array of an image display panel 40*a* is different from the pixel array of the image display panel 40 of the display device 10 according to the first embodiment. The display device 10*a* according to the second embodiment has the same configuration as the display device 10 according to the first embodiment in the other points, and thus a description thereof is omitted.

Figure 18:
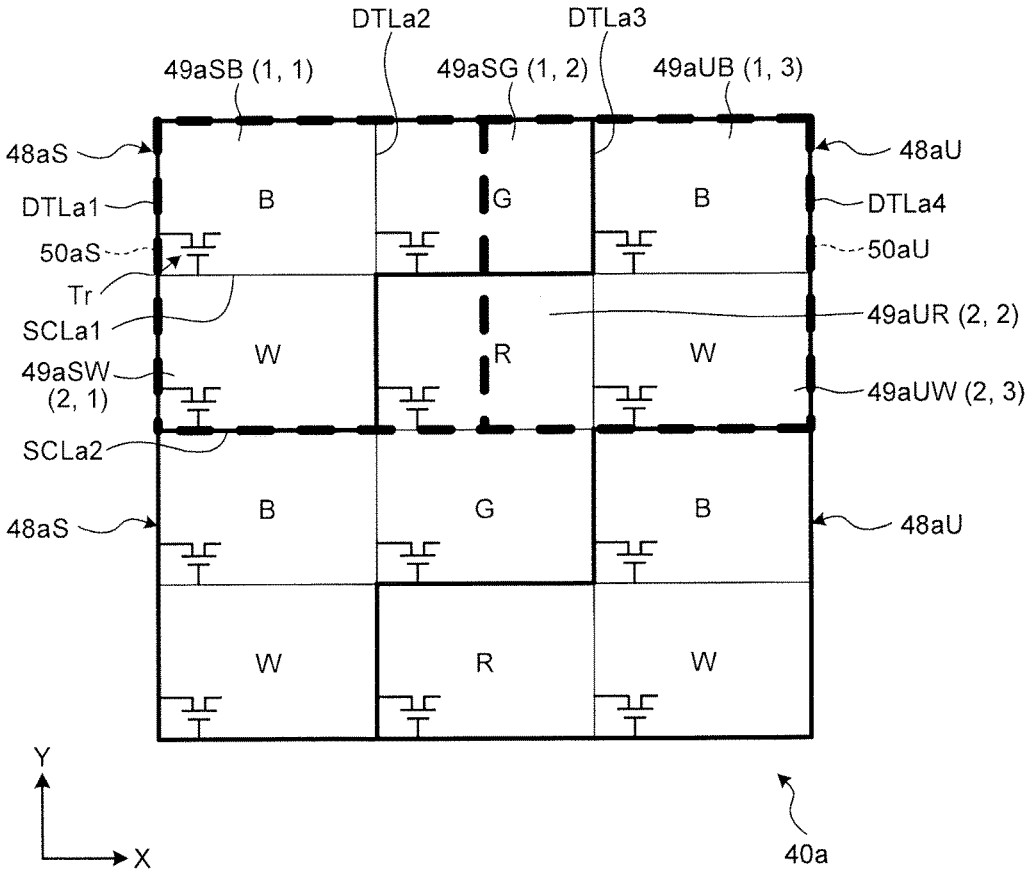
FIG. 18 is a schematic diagram illustrating a pixel array of an image display panel according to a second embodiment.

FIG. 18 is a schematic diagram illustrating a pixel array of the image display panel according to the second embodiment. As illustrated in FIG. 18, in the image display panel 40*a*, a pixel 48*a*S and a pixel 48*a*U configure a set of pixels (a pixel unit) 48*a*, and P×Q pixel units 48*a* (P pixels in the row direction and Q pixels in the column direction) are arranged in a 2D matrix form.

In the second embodiment, the pixel 48*a*S and the pixel 48*a*U are alternately arranged in the X direction (the row direction). The pixel 48*a*S and the pixel 48*a*U are consecutively arranged in the Y direction (the column direction).

The sub pixels 49*a* of the pixel 48*a*S and the pixel 48*a*S are arranged in the X direction and the Y direction. As illustrated in FIG. 18, the sub pixels 49*a* are arranged along a first row extending in the X direction and a second row arranged in a row next to the first row. The sub pixels 49*a* are arranged along a first column extending in the Y direction, a second column arranged in a column next to the first column, and a third column arranged in a column next to the second column. The first row and the second row of the sub pixels 49*a* are periodically arranged in the Y direction, and the first column to the third column of the sub pixels 49*a* are periodically arranged in the X direction.

Next, an array of the sub pixels 49*a* of the pixel 48*a*S and the pixel 48*a*U will be described under the assumption that in a row and column in which a sub pixel is arranged, a sub pixel 49 arranged in an s-th row and a t-th column is indicated by a sub pixel 49(*s*,*t*).

The pixel 48*a*S includes a first sub pixel 49*a*SB(1,1), a second sub pixel 49*a*SW(2,1), and a third sub pixel 49*a*SG (1,2) as illustrated in FIG. 18. In other words, the first sub pixel 49*a*SB(1,1) and the second sub pixel 49*a*SW(2,1) are arranged in the same column, that is, the first column and adjacent in the Y direction. The first sub pixel 49*a*SB(1,1) and the third sub pixel 49*a*SG(1,2) are adjacent in the X direction.

The pixel 48*a*U includes a first sub pixel 49*a*UB(1,3), a second sub pixel 49*a*UW(2,3), and a fourth sub pixel 49*a*UR(2,2). In other words, the first sub pixel 49*a*UB(1,3) and the second sub pixel 49*a*UW(2,3) are arranged in the same column, that is, the third column and adjacent in the Y direction. The second sub pixel 49*a*UW(2,3) and the fourth sub pixel 49*a*UR(2,2) are adjacent in the X direction. The fourth sub pixel 49*a*UR(2,2) and the third sub pixel 49*a*SG (1,2) of the pixel 48*a*S are arranged in the same column, that is, the second column and adjacent in the Y direction.

As described above, in the image display panel 40*a*, a third sub pixel 49*a*G and a fourth sub pixel 49*a*R are adjacent to each other in the Y direction. The third sub pixel 49*a*G and the fourth sub pixel 49*a*R need not necessarily be adjacent to each other when the third sub pixel 49*a*G and the fourth sub pixel 49*a*R overlap at least partially in the X direction.

Each of the sub pixels 49*a* arranged as described above is coupled to one of scanning lines SCLa1 and SCLa2 extending in the X direction and one of signal lines DTLa1, DTLa2, and DTLa3 extending in the Y direction via a switching element Tr.

The scanning line SCLa1 is coupled to the first sub pixel 49SB(1,1) and the third sub pixel 49*a*SG(1,2) of the pixel 48*a*S and the first sub pixel 49UB(1,3) of the pixel 48*a*U as illustrated in FIG. 18. The scanning line SCLa2 is coupled to the second sub pixel 49*a*SW(2,1) of the pixel 48*a*S and the fourth sub pixel 49*a*UR(2,2) and the second sub pixel 49*a*UW(2,3) of the pixel 48*a*U. In other words, in the second embodiment, it is possible to drive one pixel through control of two scanning lines SCL.

The signal line DTLa1 is coupled to the first sub pixel 49SB(1,1) and the second sub pixel 49*a*SW(2,1) of the pixel 48*a*S. The signal line DTLa2 is coupled to the third sub pixel 49SG(1,2) of the pixel 48*a*S and the fourth sub pixel 49*a*UR(2,2) of the pixel 48*a*U. The signal line DTLa3 is coupled to the first sub pixel 49*a*UB(1,3) and the second sub pixel 49*a*UW(2,3) of the pixel 48*a*U.

A pixel display region 50*a*S is adjacent to a pixel display region 50*a*U in the X direction as illustrated in FIG. 18. A region in which the first sub pixel 49*a*SB(1,1) and the second sub pixel 49*a*SW(2,1) of the pixel 48*a*S are arranged, a first column side region of regions obtained by dividing the third sub pixel 49*a*SG(1,2) of the pixel 48*a*S into two in the X direction, and a first column side region of regions obtained by dividing the fourth sub pixel 49*a*UR(2,2) of the pixel 48*a*U into two in the X direction are arranged in the pixel display region 50*a*S. A region in which the first sub pixel 49*a*UB(1,3) and the second sub pixel 49*a*UW(2,3) of the pixel 48*a*U are arranged, a third column side region of regions obtained by dividing the third sub pixel 49*a*SG(1,2) of the pixel 48*a*S into two the X direction, a third column side region of regions obtained by dividing the fourth sub pixel 49*a*UR(2,2) of the pixel 48*a*U into two in the X direction are arranged in the pixel display region 50*a*U.

As described above, in the image display panel 40*a* according to the second embodiment, a previous column side region of the two regions divided in the X direction in the third sub pixel 49G and the fourth sub pixel 49R is arranged in the pixel display region 50*a*S. A next column side region of the two regions divided in the X direction in the third sub pixel 49G and the fourth sub pixel 49R is arranged in the pixel display region 50*a*U. Thus, the image display panel 40*a* according to the second embodiment can suppress deterioration of an image, similarly to the image display panel 40 according to the first embodiment.

Third Embodiment

Next, a third embodiment will be described. A display device 10*b* according to the third embodiment differs from the display device 10 according to the first embodiment in that a pixel array of an image display panel 40*b* is different from that of the image display panel 40. The display device 10*b* according to the third embodiment has the same configuration as the display device 10 according to the first embodiment in the other points, and a description thereof is not repeated.

Figure 19:
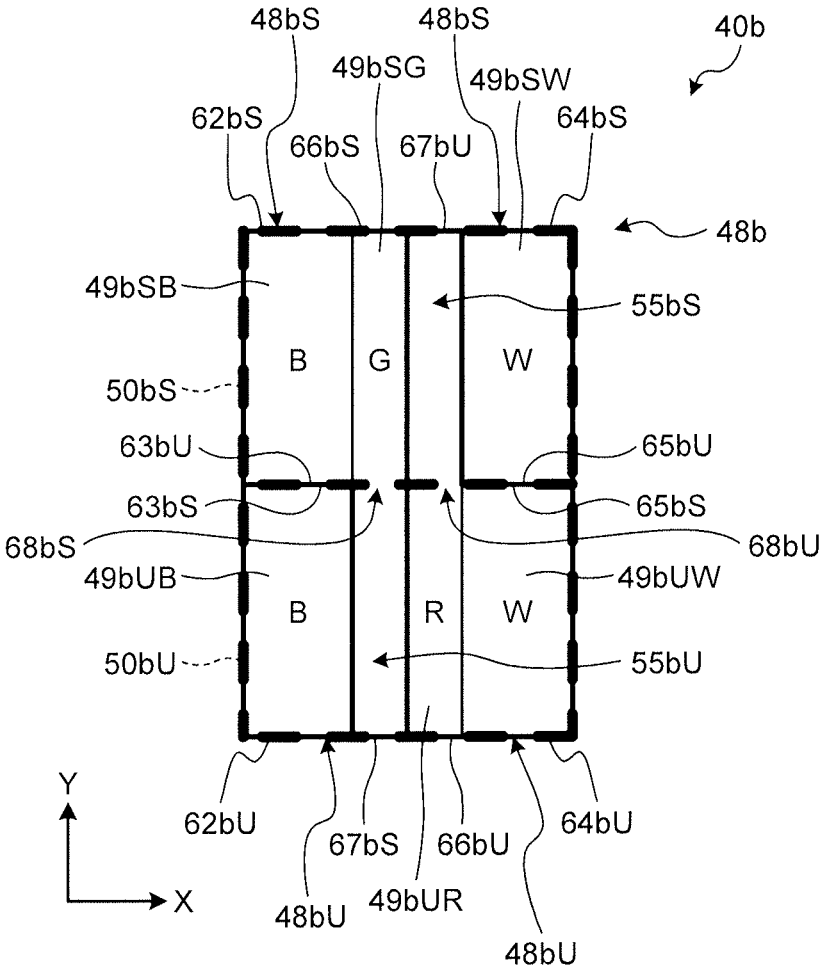
FIG. 19 is a schematic diagram illustrating a pixel array of an image display panel according to a third embodiment.

FIG. 19 is a schematic diagram illustrating a pixel array of the image display panel according to the third embodiment. In the image display panel 40*b*, a pixel 48*b*S and a pixel 48*b*U configure a set of pixels (a pixel unit) 48*b*, and P×Q pixel units 48*b* (P pixels in the row direction and Q pixels in the column direction) are arranged in a 2D matrix form.

In the third embodiment, the pixel 48*b*S and the pixel 48*b*U are alternately arranged in the Y direction (the column direction). The pixel 48*a*S and the pixel 48*a*U are consecutively arranged in the X direction (the row direction). For example, the pixel 48_b_S and the pixel 48_b_U may be alternately arranged even in the X direction.

The pixel 48_b_S includes a first sub pixel 49_b_SB, a second sub pixel 49_b_SW, and a third sub pixel 49_b_SG as illustrated in FIG. 19. In the pixel 48_b_S, the first sub pixel 49_b_SB, the third sub pixel 49_b_SG, and the second sub pixel 49_b_SW are arranged in the X direction in a stripe form in the described order. In the pixel 48_b_S, the third sub pixel 49_b_SG extends in the Y direction further than the other sub pixels. In the pixel 48_b_S, a space portion 55_b_S in which no sub pixel is arranged is formed between the third sub pixel 49_b_SG and the second sub pixel 49_b_SW, and the third sub pixel 49_b_SG and the second sub pixel 49_b_SW are not adjacent in the X direction.

More specifically, the first sub pixel 49_b_SB is arranged at one end portion of the pixel 48_b_Sin the X direction. The first sub pixel 49_b_SB extends from one end portion 62_b_S serving as an end portion at the side opposite to the pixel 48_b_U side in the Y direction to the other end portion 63_b_S. The first sub pixel 49_b_SB has a rectangular shape.

The second sub pixel 49_b_SW is arranged at the other end portion of the pixel 48_b_S in the X direction. The second sub pixel 49_b_SW extends from one end portion 64_b_S serving as an end portion at the side opposite to the pixel 48_b_U side in the Y direction to the other end portion 65_b_S. One end portion 64_b_S of the second sub pixel 49_b_S Wand one end portion 62_b_S of the first sub pixel 49_b_SB are at the same position in the Y direction. The other end portion 65_b_S of the second sub pixel 49_b_SW and the other end portion 63_b_S of the first sub pixel 49_b_SB are at the same position in the Y direction. Thus, the second sub pixel 49_b_SW and the first sub pixel 49_b_SB are arranged in the X direction. The second sub pixel 49_b_SW has the same shape as the first sub pixel 49_b_SB, that is, has the rectangular shape.

The third sub pixel 49_b_SG is arranged between the first sub pixel 49_b_SB and the second sub pixel 49_b_SW. More specifically, the third sub pixel 49_b_SG is adjacent to the first sub pixel 49_b_SB in the X direction. The third sub pixel 49_b_SG extends from one end portion 66_b_S (a third-sub-pixel first end portion) that is at an end portion at the side opposite to the pixel 48_b_U side in the Y direction to the other end portion 67_b_S (a third-sub-pixel second end portion). One end portion 66_b_S of the third sub pixel 49_b_SG is between the first sub pixel 49_b_SB and the second sub pixel 49_b_SW. In the third embodiment, one end portion 66_b_S of the third sub pixel 49_b_SG, one end portion 62_b_S of the first sub pixel 49_b_SB, and one end portion 64_b_S of the second sub pixel 49_b_SW are arranged in the X direction and are at the same position in the Y direction. The other end portion 67_b_S of the third sub pixel 49_b_SG is positioned at the pixel 48_b_U side further than the other end portion 63_b_S of the first sub pixel 49_b_SB and the other end portion 65_b_S of the second sub pixel 49_b_SW in the Y direction. The third sub pixel 49_b_SG has the rectangular shape.

The space portion 55_b_S in which no sub pixel is arranged is disposed between the second sub pixel 49_b_SW and the third sub pixel 49_b_SG. In other words, the second sub pixel 49_b_SW is not adjacent to the third sub pixel 49_b_SG.

The pixel 48_b_U includes a first sub pixel 49_b_UB, a second sub pixel 49_b_UW, and a fourth sub pixel 49_b_UR as illustrated in FIG. 19. In the pixel 48_b_U, the first sub pixel 49_b_UB, the fourth sub pixel 49_b_UR, and the second sub pixel 49_b_UW are arranged in the X direction in a stripe form in the described order. In the pixel 48_b_U, the fourth sub pixel 49_b_UR extends in the Y direction further than the other sub pixels. In the pixel 48_b_U, a space portion 55_b_U in which no sub pixel is arranged is formed between the fourth sub pixel 49_b_UR and the first sub pixel 49_b_UB, and the fourth sub pixel 49_b_UR is not adjacent to the first sub pixel 49_b_SB in the X direction.

More specifically, the first sub pixel 49_b_UB is arranged at one end portion of the pixel 48_b_U in the X direction. The first sub pixel 49_b_UB extends from one end portion 62_b_U serving as an end portion at the side opposite to the pixel 48_b_Sside in the Y direction to the other end portion 63_b_U. The first sub pixel 49_b_UB is adjacent to the first sub pixel 49_b_SB of the pixel 48_b_S in the Y direction. The first sub pixel 49_b_UB has the same shape as the first sub pixel 49_b_SB of the pixel 48_b_S, that is, has the rectangular shape.

The second sub pixel 49_b_UW is arranged at the other end portion of the pixel 48_b_U in the X direction. The second sub pixel 49_b_UW extends from one end portion 64_b_U serving as an end portion at the side opposite to the pixel 48_b_S side in the Y direction to the other end portion 65_b_U. One end portion 64_b_U of the second sub pixel 49_b_UW is at the same position as one end portion 62_b_U of the first sub pixel 49_b_UB in the Y direction. The other end portion 65_b_U of the second sub pixel 49_b_UW is at the same position as the other end portion 63_b_U of the first sub pixel 49_b_UB in the Y direction. Thus, the second sub pixel 49_b_UW and the first sub pixel 49_b_UB are arranged in the X direction. The second sub pixel 49_b_UW is adjacent to the second sub pixel 49_b_SW of the pixel 48_b_S in the Y direction. The second sub pixel 49_b_UW has the same shape as the first sub pixel 49_b_UB, that is, has the rectangular shape.

The fourth sub pixel 49_b_UR is arranged between the first sub pixel 49_b_UB and the second sub pixel 49_b_UW. More specifically, the fourth sub pixel 49_b_UR is adjacent to the second sub pixel 49_b_UW in the X direction. The fourth sub pixel 49_b_UR extends from one end portion 66_b_U (a fourth-sub-pixel first end portion) that is at an end portion at the side opposite to the pixel 48_b_S side in the Y direction to the other end portion 67_b_U (a fourth-sub-pixel second end portion). One end portion 66_b_U of the fourth sub pixel 49_b_UR is between the first sub pixel 49_b_UB and the second sub pixel 49_b_UW. In the third embodiment, one end portion 66_b_U of the fourth sub pixel 49_b_UR, one end portion 62_b_U of the first sub pixel 49_b_UB, and one end portion 64_b_U of the second sub pixel 49_b_UW are arranged in the X direction and are at the same position in the Y direction. The other end portion 67_b_U of the fourth sub pixel 49_b_UR is positioned at the pixel 48_b_S side further than the other end portion 63_b_U of the first sub pixel 49_b_UB and the other end portion 65_b_U of the second sub pixel 49_b_UW in the Y direction.

The fourth sub pixel 49_b_UR extends in the space portion 55_b_S of the pixel 48_b_S from a middle portion 68_b_U which is at the same position as the other end portion 63_b_U of the first sub pixel 49_b_UB and the other end portion 65_b_U of the second sub pixel 49_b_UW in the Y direction to the other end portion 67_b_U. A portion of the fourth sub pixel 49_b_UR from the middle portion 68_b_U to the other end portion 67_b_U is adjacent to the second sub pixel 49_b_SW of the pixel 48_b_S and the third sub pixel 49_b_SG of the pixel 48_b_S in the X direction. The other end portion 67_b_U of the fourth sub pixel 49_b_UR, one end portion 64_b_S of the second sub pixel 49_b_SW of the pixel 48_b_S, and one end portion 66_b_S of the third sub pixel 49_b_SG of the pixel 48_b_S are arranged in the X direction and arranged at the same position in the Y direction. The fourth sub pixel 49_b_UR has the same shape as the third sub pixel 49_b_SG, that is, has the rectangular shape.

The space portion 55_b_U in which no sub pixel is arranged is disposed between the first sub pixel 49_b_UB and the fourth sub pixel 49$b$UR. In other words, the first sub pixel 49$b$UB is not adjacent to the fourth sub pixel 49$b$UR.

The third sub pixel 49$b$SG of the pixel 48$b$S extends in the space portion 55$b$U of the pixel 48$b$U from a middle portion 68$b$S which is at the same position as the other end portion 63$b$S of the first sub pixel 49$b$SB and the other end portion 65$b$S of the second sub pixel 49$b$SW in the Y direction to the other end portion 67$b$S. A portion of the third sub pixel 49$b$SG from the middle portion 68$b$S to the other end portion 67$b$S is adjacent to the first sub pixel 49$b$UB of the pixel 48$b$U to the fourth sub pixel 49$b$UR of the pixel 48$b$U in the X direction. The other end portion 67$b$S of the third sub pixel 49$b$SG, one end portion 62$b$U of the first sub pixel 49$b$UB of the pixel 48$b$U, and one end portion 66$b$U of the fourth sub pixel 49$b$UR of the pixel 48$b$U are arranged in the X direction and arranged at the same position in the Y direction.

The image display panel 40$b$ according to the third embodiment has the above-described pixel array. The region of the first sub pixel 49$b$SB and the second sub pixel 49$b$SW of the pixel 48$b$S, the region from one end portion 66$b$S of the third sub pixel 49$b$SG of the pixel 48$b$S to the middle portion 68$b$S, and the region from the middle portion 68$b$U of the fourth sub pixel 49$b$UR of the pixel 48$b$U to the other end portion 67$b$U thereof are positioned in a pixel display region 50$b$S as illustrated in FIG. 19. The region of the first sub pixel 49$b$UB and the second sub pixel 49$b$UW of the pixel 48$b$U, the region from the middle portion 68$b$S of the third sub pixel 49$b$SG of the pixel 48$b$S to the other end portion 67$b$S thereof, and the region from one end portion 66$b$U of the fourth sub pixel 49$b$UR of the pixel 48$b$U to the middle portion 68$b$U are positioned in a pixel display region 50$b$U.

As described above, in the image display panel 40$b$ according to the third embodiment, the regions of one parts of the third sub pixel 49G and the fourth sub pixel 49R are arranged in the pixel display region 50$b$S, and the regions of the other parts thereof are arranged in the pixel display region 50$b$U. Thus, the image display panel 40$b$ according to the third embodiment can suppress deterioration of an image, similarly to the image display panel 40 according to the first embodiment.

Fourth Embodiment

Next, a fourth embodiment will be described. A display device 10$c$ according to the fourth embodiment differs from the display device 10$b$ according to the third embodiment in that a first sub pixel 49$c$B and a second sub pixel 49$c$W in a pixel array of an image display panel 40$c$ are adjacent, unlike the image display panel 40$b$. The display device 10$c$ according to the fourth embodiment has the same configuration as the display device 10$b$ according to the third embodiment in the other points, and a description thereof is not repeated.

Figure 20:
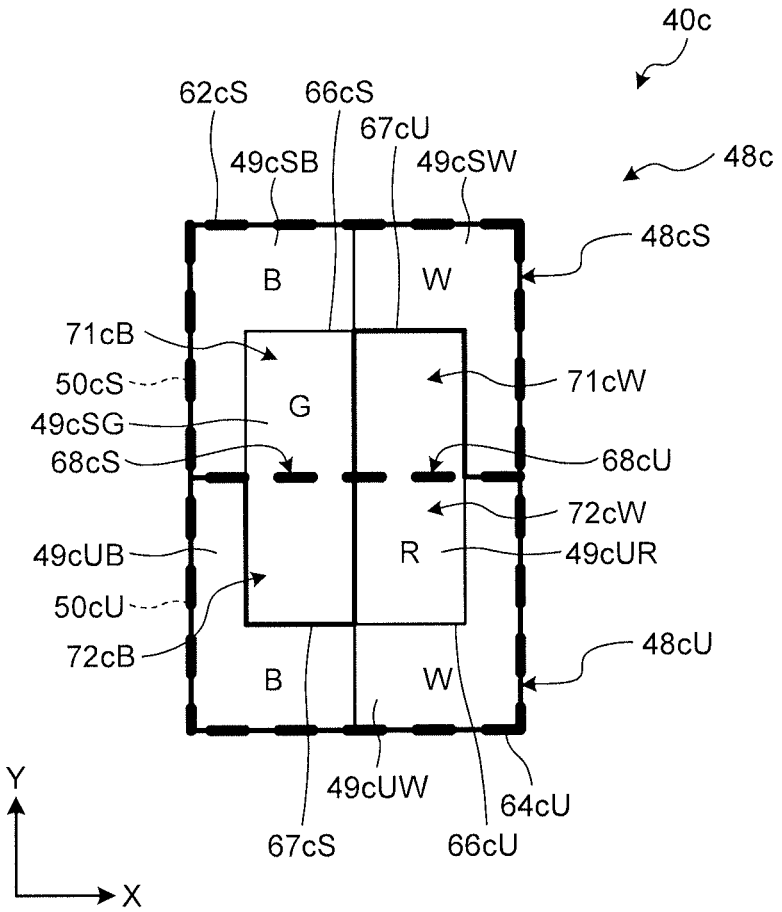
FIG. 20 is a schematic diagram illustrating a pixel array of an image display panel according to a fourth embodiment.

FIG. 20 is a schematic diagram illustrating a pixel array of an image display panel according to the fourth embodiment. In the image display panel 40$c$, a pixel 48$c$S and a pixel 48$c$U configure a set of pixels (a pixel unit) 48$c$, and P×Q pixel units 48$c$ (P pixels in the row direction and Q pixels in the column direction) are arranged in a 2D matrix form.

The pixel 48$c$S includes a first sub pixel 49$c$SB, a second sub pixel 49$c$SW, and a third sub pixel 49$c$SG. The first sub pixel 49$c$SB is arranged at one end portion of the pixel 48$c$S in the X direction. The first sub pixel 49$c$SB includes a space portion 71$c$B of a rectangular shape at one apex portion of a rectangle, and has a letter L shape formed by cutting out the space portion 71$c$B from the rectangle.

The second sub pixel 49$c$SW is arranged at the other end portion of the pixel 48$c$S in the X direction. The second sub pixel 49$c$SW includes a space portion 71$c$W of a rectangular shape at one apex portion of a rectangle, and has a letter L shape formed by cutting out the space portion 71$c$W from the rectangle. The second sub pixel 49$c$SW and the first sub pixel 49$c$SB are adjacent to each other at the sides of the space portions 71$c$B and 71$c$W in the X direction.

The third sub pixel 49$c$SG is arranged between the first sub pixel 49$c$SB and the second sub pixel 49$c$SW. More specifically, the third sub pixel 49$c$SG is arranged in the space portion 71$c$B of the first sub pixel 49$c$SB, and extends from one end portion 66$c$S to the other end portion 67$c$S via a middle portion 68$c$S in the Y direction. One end portion 66$c$S of the third sub pixel 49$c$SG is positioned at the pixel 48$c$U side in the Y direction further than one end portion 62$c$S of the first sub pixel 49$c$SB. The third sub pixel 49$c$SG is adjacent to the first sub pixel 49$c$SB in the X direction and the Y direction. The third sub pixel 49$c$SG has the rectangular shape.

The pixel 48$c$U includes a first sub pixel 49$c$UB, a second sub pixel 49$c$UW, and a fourth sub pixel 49$c$UR. The first sub pixel 49$c$UB is arranged at one end portion of the pixel 48$c$U in the X direction. The first sub pixel 49$c$UB includes a space portion 72$c$B at one apex portion of a rectangle, and has a letter L shape formed by cutting out the space portion 72$c$B from the rectangle.

The second sub pixel 49$c$UW is arranged at the other end portion of the pixel 48$c$U in the X direction. The second sub pixel 49$c$UW includes a space portion 72$c$W at one apex portion of a rectangle, and has a letter L shape formed by cutting out the space portion 72$c$W from the rectangle. The second sub pixel 49$c$UW is adjacent to the first sub pixel 49$c$UB in the sides of the space portions 72$c$B and 72$c$W in the X direction.

The fourth sub pixel 49$c$UR is arranged between the first sub pixel 49$c$UB and the second sub pixel 49$c$UW. More specifically, the fourth sub pixel 49$c$UR is arranged in the space portion 72$c$W of the second sub pixel 49$c$UW, and extends from one end portion 66$c$U to the other end portion 67$c$U via a middle portion 68$c$U in the Y direction. One end portion 66$c$U of the fourth sub pixel 49$c$UR is positioned at the pixel 48$c$S side in the Y direction further than one end portion 64$c$U of the second sub pixel 49$c$UW. The fourth sub pixel 49$c$UR is adjacent to the second sub pixel 49$c$UW in the X direction and the Y direction. The fourth sub pixel 49$c$UR has the rectangular shape.

The fourth sub pixel 49$c$UR extends from the middle portion 68$c$U to the other end portion 67$c$U in the space portion 71$c$W of the second sub pixel 49$c$SW of the pixel 48$c$S. The fourth sub pixel 49$c$UR is adjacent to the second sub pixel 49$c$SW of the pixel 48$c$S at the other end portion 67$c$U in the Y direction. A portion of the fourth sub pixel 49$c$UR from the middle portion 68$c$U to the other end portion 67$c$U is adjacent to the second sub pixel 49$c$SW of the pixel 48$c$S in the X direction.

The third sub pixel 49$c$SG of the pixel 48$c$S extends from the middle portion 68$c$S to the other end portion 67$c$S in the space portion 72$c$B of the first sub pixel 49$c$UB of the pixel 48$c$U. The third sub pixel 49$c$SG is adjacent to the first sub pixel 49$c$UB of the pixel 48$c$U at the other end portion 67$c$S in the Y direction. A portion of the third sub pixel 49$c$SG from the middle portion 68$c$S to the other end portion 67$c$S is adjacent to the first sub pixel 49$c$UB of the pixel 48$c$U in the X direction. The third sub pixel 49$c$SG is adjacent to the fourth sub pixel 49$c$UR of the pixel 48$c$U in the X direction.

The image display panel 40*c* according to the fourth embodiment has the above-described pixel array. As illustrated in FIG. 20, the region of the first sub pixel 49*c*SB and the second sub pixel 49*c*SW of the pixel 48*c*S, the region from one end portion 66*c*S of the third sub pixel 49*c*SG of the pixel 48*c*S to the middle portion 68*c*S, and the region from the middle portion 68*c*U of the fourth sub pixel 49*c*UR of the pixel 48*c*U to the other end portion 67*c*U thereof are positioned in a pixel display region 50*c*S. The region of the first sub pixel 49*c*UB and the second sub pixel 49*c*UW of the pixel 48*c*U, the region from the middle portion 68*c*S of the third sub pixel 49*c*SG of the pixel 48*c*S to the other end portion 67*c*S thereof, and the region from one end portion 66*c*U of the fourth sub pixel 49*c*UR of the pixel 48*c*U to the middle portion 68*c*U are positioned in a pixel display region 50*c*U.

As described above, in the image display panel 40*c* according to the fourth embodiment, the regions of one parts of the third sub pixel 49G and the fourth sub pixel 49R are arranged in the pixel display region 50*c*S, and the regions of the other parts thereof are arranged in the pixel display region 50*c*U. Thus, the image display panel 40*c* according to the fourth embodiment can suppress deterioration of an image, similarly to the image display panel 40 according to the first embodiment.

Fifth Embodiment

Next, a fifth embodiment will be described. A display device 10*d* according to the fifth embodiment differs from the display device 10*c* according to the fourth embodiment in that the shape of each sub pixel in a pixel array of an image display panel 40*d* differs from that of the image display panel 40*c*. The display device 10*d* according to the fifth embodiment has the same configuration as the display device 10*c* according to the fourth embodiment in the other points, and thus a description thereof is not repeated.

Figure 21:
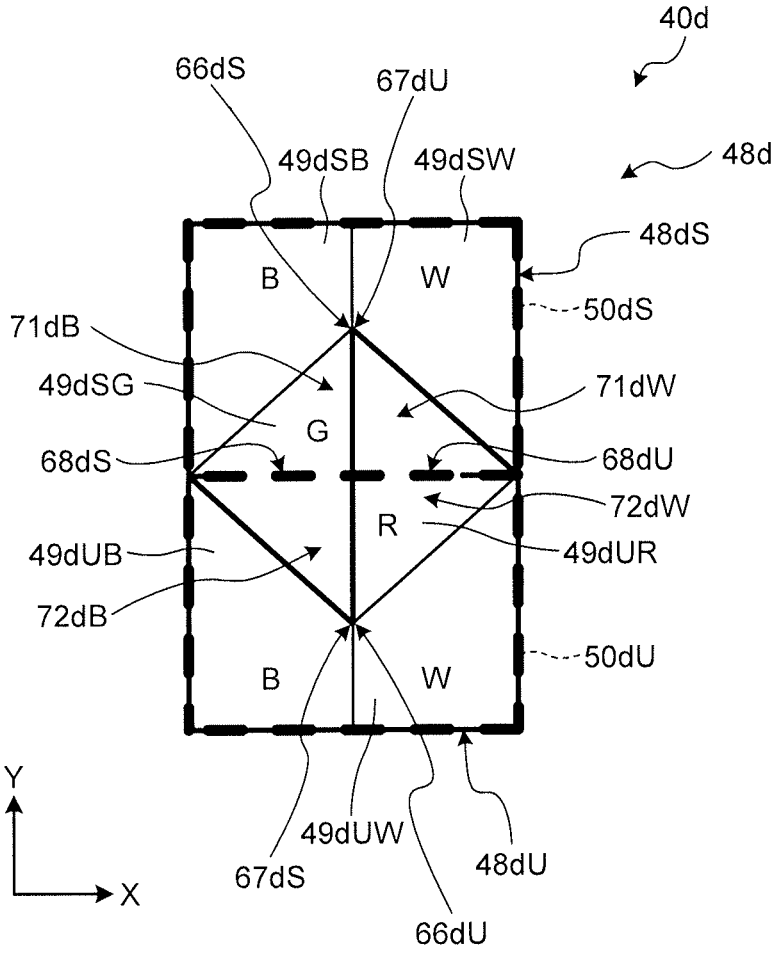
FIG. 21 is a schematic diagram illustrating a pixel array of an image display panel according to a fifth embodiment.

FIG. 21 is a schematic diagram illustrating a pixel array of the image display panel according to the fifth embodiment. In the image display panel 40*d*, a pixel 48*d*S and a pixel 48*d*U configure a set of pixels (a pixel unit) 48*d*, and P×Q pixel units 48*d* (P pixels in the row direction and Q pixels in the column direction) are arranged in a 2D matrix form. A pixel 48*d*S includes a first sub pixel 49*d*SB, a second sub pixel 49*d*SW, and a third sub pixel 49*d*SG as illustrated in FIG. 21. A space portion 71*d*B of the first sub pixel 49*d*SB has the triangular shape. A space portion 71*d*W of the second sub pixel 49*d*SW has the triangular shape as well. The third sub pixel 49*d*SG extends in the Y-axis direction such that the width of the third sub pixel 49*d*SG increases from one end portion 66*d*S to a middle portion 68*d*S and decreases from the middle portion 68*d*S to the other end portion 67*d*S. The third sub pixel 49*d*SG has the triangular shape.

A pixel 48*d*U includes a first sub pixel 49*d*UB, a second sub pixel 49*d*UW, and a fourth sub pixel 49*d*UR. A space portion 72*d*B of the first sub pixel 49*d*UB has the triangular shape. A space portion 72*d*W of the second sub pixel 49*d*UW has the triangular shape as well. The fourth sub pixel 49*d*UR extends in the Y-axis direction such that the width of the fourth sub pixel 49*d*UR increases from one end portion 66*d*U to a middle portion 68*d*U and decreases from the middle portion 68*d*U to the other end portion 67*d*U. The fourth sub pixel 49*d*UR has the triangular shape.

As illustrated in FIG. 21, in the image display panel 40*d* according to the fifth embodiment, the regions of one parts of the third sub pixel 49G and the fourth sub pixel 49R are arranged in the pixel display region 50*d*S, and the regions of the other parts thereof are arranged in the pixel display region 50*d*U. Thus, the image display panel 40*d* according to the fifth embodiment can suppress deterioration of an image, similarly to the image display panel 40 according to the first embodiment.

As described above in the third to fifth embodiments, when the image display panel 40 has the pixel array in which the first sub pixel 49B and the second sub pixel 49W are arranged at both end portions of the pixel in the X direction, the shape of each sub pixel 49 is arbitrary as long as the regions of one parts of the third sub pixel 49G and the fourth sub pixel 49R are arranged in the pixel display region 50S, and the regions of the other parts thereof are arranged in the pixel display region 50U. The shapes of the sub pixels described in the third to fifth embodiments are examples.

Sixth Embodiment

Next, a sixth embodiment will be described. A display device 10*e* according to the sixth embodiment differs from the display device 10 according to the first embodiment in that an array of sub pixels in the X direction in a pixel array of an image display panel 40*e* is inclined in the Y direction unlike the image display panel 40. The display device 10*e* according to the sixth embodiment has the same configuration as the display device 10 according to the first embodiment in the other points, and thus a description thereof is not repeated.

Figure 22:
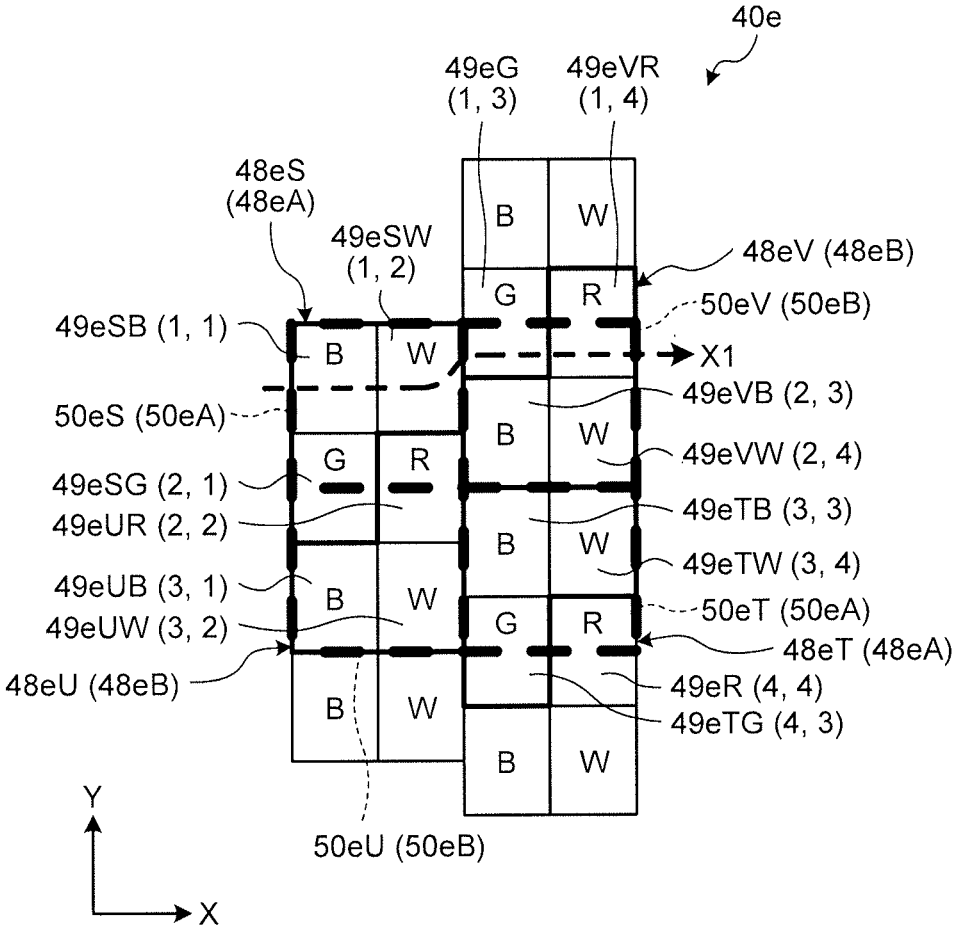
FIG. 22 is a schematic diagram illustrating a pixel array of an image display panel according to a sixth embodiment.

FIG. 22 is a schematic diagram illustrating a pixel array of the image display panel according to the sixth embodiment. A pixel 48*e*A and a pixel 48*e*B are alternately arranged in the Y direction (the column direction) as illustrated in FIG. 22. The pixel 48*e*A and the pixel 48*e*B are alternately arranged in the X direction (the row direction). An array in the X direction is inclined in the Y direction.

More specifically, the pixel 48*e*A includes a pixel 48*e*S and a pixel 48*e*T as illustrated in FIG. 22. The pixel 48*e*B includes a pixel 48*e*U and a pixel 48*e*V. The pixel 48*e*S is adjacent to the pixel 48*e*U in the Y direction and adjacent to the pixel 48*e*V in the X direction. The pixel 48*e*T is adjacent to the pixel 48*e*U in the X direction and adjacent to the pixel 48*e*V in the Y direction.

The pixel 48*e*S includes a first sub pixel 49*e*SB, a second sub pixel 49*e*SW, and a third sub pixel 49*e*SG. The pixel 48*e*T includes a first sub pixel 49*e*TB, a second sub pixel 49*e*TW, and a third sub pixel 49*e*TG. The pixel 48*e*U includes a first sub pixel 49*e*UB, a second sub pixel 49*e*UW, and a fourth sub pixel 49*e*UR. The pixel 48*e*U includes a first sub pixel 49*e*VB, a second sub pixel 49*e*VW, and a fourth sub pixel 49*e*VR.

The sub pixels 49*e* are arranged in the Y direction. The sub pixels 49*e* are arranged along a first column extending in the Y direction, a second column arranged in a column next to the first column, a third column arranged in a column next to the second column, and a fourth column arranged in a column next to the third column as illustrated in FIG. 22. The sub pixels 49*e* are arranged in the X direction as well, but the array is inclined in the Y direction as illustrated in FIG. 22. More specifically, the sub pixels 49*e* in the first column and the second column are arranged in the X direction. The sub pixels 49*e* in the third column and the fourth column are arranged in the X direction. However, the sub pixels 49*e* in the second column and the third column are arranged to be inclined in the Y direction. For example, the pixel 48*e*S includes a second sub pixel 49*e*SW(1,2) arranged in the second column as illustrated in FIG. 22. A region at a side opposite to the pixel 48*e*U in regions obtained by dividing the second sub pixel 49*e*SW(1,2) into two in the Y direction is adjacent to a region at the pixel 48*e*T sides in two regions divided in the Y direction in a third sub pixel 49*e*G(1,3) arranged in the third column in the X direction.

The third sub pixel 49eG(1,3) and a fourth sub pixel 49eVR(1,4) of the pixel 48eU arranged in the fourth column are arranged in the X direction. In other words, the sub pixel 49e in the second column and the sub pixel 49e in the third column are arranged in the X direction but arranged to be inclined in the Y direction toward the upper side (the pixel 48eS side) in FIG. 22. For this reason, in the following description, an array X1 serving as an array in which the first sub pixel 49eSB(1,1), the second sub pixel 49eSW(1,2), the third sub pixel 49eG(1,3), and the fourth sub pixel 49eVR (1,4) are inclined in the X direction is referred to as a "first row". An array in which in a row next to the first row, the sub pixels adjacent to the sub pixels 49e in the first row toward the lower side (the pixel 48eU side) in FIG. 22 in the Y direction are inclined in the X direction is referred to as a "second row". Similarly, a row next to the second row is referred to as a "third row", and a row next to the third row is referred to as a "fourth row".

One part of the sub pixel 49e in the second column is adjacent to the sub pixel 49e in the same row, but the other part thereof is adjacent to the sub pixel 49e in the next row as well. For example, the second sub pixel 49eSW(1,2) is adjacent to the first sub pixel 49eVB(2,3) arranged in the second row and the third column as well. Next, an arrangement of each sub pixel 49e will be described in further detail.

The pixel 48eS includes a first sub pixel 49eSB(1,1), a second sub pixel 49eSW(1,2), and a third sub pixel 49eSG (2,1) as illustrated in FIG. 22. The pixel 48eU includes a first sub pixel 49eUB(3,1), a second sub pixel 49eUW(3,2), and a fourth sub pixel 49eUR(2,2). The pixel 48eV includes a first sub pixel 49eVB(2,3), a second sub pixel 49eVW(2,4), and a fourth sub pixel 49eVR(1,4). The pixel 48eT includes a first sub pixel 49eTB(3,3), a second sub pixel 49eTW(3,4), and a third sub pixel 49eTG(4,3).

A second row side region of two regions obtained by dividing the second sub pixel 49eSW(1,2) of the pixel 48eS into two in the Y direction is adjacent to a first row side region of two regions obtained by dividing the first sub pixel 49eVB(2,3) of the pixel 48eV into two in the Y direction.

A third row side region of two regions obtained by dividing the first sub pixel 49eVB(2,3) of the pixel 48eU into two in the Y direction is adjacent to a first row side region of two regions obtained by dividing the fourth sub pixel 49eUR(2,2) of the pixel 48eU into two in the Y direction.

A third row side region of two regions obtained by dividing the fourth sub pixel 49eUR(2,2) of the pixel 48eU into two in the Y direction is adjacent to a second row side region of two regions obtained by dividing the first sub pixel 49eTB(3,3) of the pixel 48eT into two in the Y direction.

A fourth row side region of two regions obtained by dividing the first sub pixel 49eTB(3,3) of the pixel 48eT into two in the Y direction is adjacent to a second row side region of two regions obtained by dividing the second sub pixel 49eUW(3,2) of the pixel 48eU into two in the Y direction.

A fourth row side region of two regions obtained by dividing the second sub pixel 49eUW(3,2) of the pixel 48eU into two in the Y direction is adjacent to a third row side region of two regions obtained by dividing the third sub pixel 49eTG(4,3) of the pixel 48eT into two in the Y direction.

As illustrated in FIG. 22, a region in which the first sub pixel 49eSB(1,1) and the second sub pixel 49eSW(1,2) of the pixel 48eS are arranged, a first row side region of regions obtained by dividing the third sub pixel 49eSG(2,1) of the pixel 48eS into two in the Y direction, and a first row side region of regions obtained by dividing the fourth sub pixel 49eUR(2,2) of the pixel 48eU into two in the Y direction are arranged in a pixel display region 50eS.

A region in which the first sub pixel 49eTB(3,3) and the second sub pixel 49eTW(3,4) of the pixel 48eT are arranged, the third row side region of the regions obtained by dividing the third sub pixel 49eTG(4,3) of the pixel 48eT into two in the Y direction, and the third row side region of the regions obtained by dividing a fourth sub pixel 49eR(4,4) into two in the Y direction are arranged in a pixel display region 50eT.

A region in which the first sub pixel 49eUB(3,1) and the second sub pixel 49eUW(3,2) of the pixel 48eU are arranged, the third row side region of the regions obtained by dividing the third sub pixel 49eSG(2,1) of the pixel 48eS into two in the Y direction, and the third row side region of the regions obtained by dividing the fourth sub pixel 49eUR (2,2) of the pixel 48eU into two in the Y direction are arranged in a pixel display region 50eU.

A region in which the first sub pixel 49eVB(2,3) and the second sub pixel 49eVW(2,4) of the pixel 48eV are arranged, the second row side region of the regions obtained by dividing the third sub pixel 49eG(1,3) into two in the Y direction, and the second row side region of the regions obtained by dividing the fourth sub pixel 49eVR(1,4) of the pixel 48eV into two in the Y direction are arranged in a pixel display region 50eV.

As described above, even in the image display panel 40e according to the sixth embodiment, the regions of one parts of the third sub pixel 49eG and the fourth sub pixel 49eR are arranged in a pixel display region 50eA, and the regions of the other parts thereof are arranged in a pixel display region 50eB. Thus, even when an array of sub pixels is inclined as in the image display panel 40e according to the sixth embodiment, it is possible to suppress deterioration of an image, similarly to the image display panel 40 according to the first embodiment. The inclination of the array of sub pixels is not limited to the example described in the sixth embodiment, and a degree of inclination is arbitrary as long as the regions of one parts of the third sub pixel 49eG and the fourth sub pixel 49eR are arranged in the pixel display region 50eA, and the regions of the other parts thereof are arranged in the pixel display region 50eB.

Seventh Embodiment

Next, an seventh embodiment will be described. A display device 10f according to the seventh embodiment differs from the image display panel 40a according to the second embodiment in an array of a first sub pixel 49fB and a second sub pixel fW of an image display panel 40f. The display device 10f according to the seventh embodiment has the same configuration as the display device 10a according to the second embodiment in the other points, and thus a description thereof is not repeated.

Figure 23:
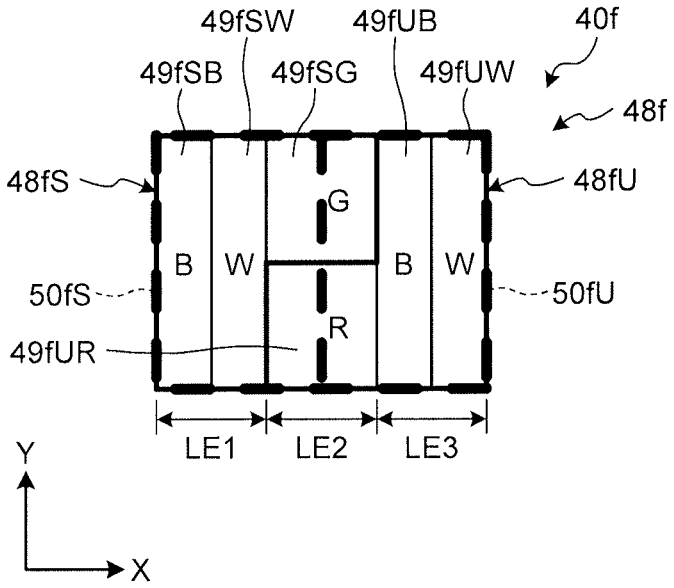
FIG. 23 is a schematic diagram illustrating a pixel array of an image display panel according to a seventh embodiment.

FIG. 23 is a schematic diagram illustrating a pixel array of an image display panel according to the seventh embodiment. In the image display panel 40f, a pixel 48fS and a pixel 48fU configure a set of pixels (a pixel unit) 48f, and P×Q pixel units 48f (P pixels in the row direction and Q pixels in the column direction) are arranged in a 2D matrix form. An image display panel 40f according to the seventh embodiment includes a pixel 48fS and a pixel 48fU as illustrated in FIG. 23. The pixel 48fS includes a first sub pixel 49fSB, a second sub pixel 49fSW, and a third sub pixel 49fSG. The pixel 48fU includes a first sub pixel 49fUB, a second sub pixel 49fUW, and a fourth sub pixel 49fUR.

In the pixel 48fS, the first sub pixel 49fSB, the second sub pixel 49fSW, and the third sub pixel 49fSG are arranged in the X direction in the described order. In other words, in the pixel 48/S, the first sub pixel 49/SB is arranged in the first column, the second sub pixel 49/SW is arranged in the second column, and the third sub pixel 49/SG is arranged in the third column. More specifically, the first sub pixel 49/SB and the second sub pixel 49/SW are arranged adjacent to each other in a stripe form.

The third sub pixel 49/SG is arranged adjacent to one (the upper side in FIG. 23) of regions obtained by dividing the second sub pixel 49/SW into two in the Y direction in the X direction. In other words, the third sub pixel 49/SG is smaller in the length in the Y direction than the first sub pixel 49/SB and the second sub pixel 49/SW. A length LE2 of the third sub pixel 49/SG in the X direction is larger than the length of the first sub pixel 49/SB and the second sub pixel 49/SW in the X direction. The length LE2 of the third sub pixel 49/SG in the X direction is the same as a length LE1 obtained by adding the length of the first sub pixel 49/SB to the length of the second sub pixel 49/SW in the X direction. The lengths of the first sub pixel 49/SB, the second sub pixel 49/SW, and the third sub pixel 49/SG in the X direction are not limited to this example and are arbitrary.

In the pixel 48/U, the fourth sub pixel 49/UR, the first sub pixel 49/UB, and the second sub pixel 49/UW are arranged in the X direction in the described order. In other words, in the pixel 48/U, the fourth sub pixel 49/UR is arranged in the third column, the first sub pixel 49/UB is arranged in the fourth column, and the second sub pixel 49/UW is arranged in the fifth column. More specifically, the first sub pixel 49/UB and the second sub pixel 49/UW are arranged adjacent to each other in a stripe form.

The fourth sub pixel 49/UR and one (the lower side in FIG. 23) of regions obtained by dividing the first sub pixel 49/UB into two in the Y direction are arranged adjacent to each other in the X direction. In other words, the fourth sub pixel 49/UR is smaller in the length in the Y direction than the first sub pixel 49/UB and the second sub pixel 49/UW. The length of the fourth sub pixel 49/UR in the X direction is the length LE2 of the third sub pixel 49/SG in the X direction. The length of the fourth sub pixel 49/UR in the X direction (the length LE2 of the third sub pixel 49/SG in the X direction) is larger than the length of the first sub pixel 49/UB and the second sub pixel 49/UW in the X direction. The length of the fourth sub pixel 49/UR in the X direction (the length LE2 of the third sub pixel 49/SG in the X direction) is the same as a length LE3 obtained by adding the length of the first sub pixel 49/UB to the length of the second sub pixel 49/UW in the X direction. The lengths of the first sub pixel 49/UB, the second sub pixel 49/UW, and the fourth sub pixel 49/UR in the X direction are not limited to this example and are arbitrary.

The third sub pixel 49/SG of the pixel 48/S and the other region (the upper side in FIG. 23) of regions obtained by dividing the first sub pixel 49/UB of the pixel 48/U into two in the Y direction are adjacent to each other in the X direction at an end portion on a side opposite to the second sub pixel 49/SW side. The fourth sub pixel 49/UR of the pixel 48/U and the other region (the lower side in FIG. 23) of regions obtained by dividing the second sub pixel 49/SW of the pixel 48/S into two in the Y direction are arranged adjacent to each other in the X direction at an end portion on a side opposite to the first sub pixel 49/UB. The third sub pixel 49/SG of the pixel 48/S and the fourth sub pixel 49/UR of the pixel 48/U are adjacent to each other in the Y direction.

The region in which the first sub pixel 49/SB and the second sub pixel 49/SW of the pixel 48/S are arranged, the second sub pixel 49/SW side region of the regions obtained by dividing the third sub pixel 49/SG of the pixel 48/S into two in the X direction, and the second sub pixel 49/SW side region of the regions obtained by dividing the fourth sub pixel 49/UR of the pixel 48/U into two in the X direction are arranged in a pixel display region 50/S. The region in which the first sub pixel 49/UB and the second sub pixel 49/UW of the pixel 48/U are arranged, the first sub pixel 49/UB side region of the regions obtained by dividing the third sub pixel 49/SG of the pixel 48/S into two in the X direction, and the first sub pixel 49/UB side region of the regions obtained by dividing the fourth sub pixel 49/UR of the pixel 48/U into two in the X direction are arranged in a pixel display region 50/U.

As described above, in the image display panel 40/ according to the seventh embodiment, the regions of one parts of a third sub pixel 49/G and a fourth sub pixel 49/R are arranged in the pixel display region 50/S, and the regions of the other parts thereof are arranged in the pixel display region 50/U. Thus, the image display panel 40/ according to the seventh embodiment can suppress deterioration of an image, similarly to the image display panel 40 according to the first embodiment. As described above, an arrangement of each sub pixel can be arbitrarily selected as long as the regions of one parts of the third sub pixel 49/G and the fourth sub pixel 49/R are arranged in the pixel display region 50/S, and the regions of the other parts thereof are arranged in the pixel display region 50/U. For example, the first sub pixel 49/B and a second sub pixel 49/W may be arranged in a stripe form as described in the seventh embodiment.

The above embodiment has been described in connection with the pixel array example of the image display panel, but the pixel array may not be configured such that the regions of one parts of the third sub pixel 49G and the fourth sub pixel 49R are arranged in the pixel display region 50S, and the regions of the other parts thereof are arranged in the pixel display region 50U. In the display device 10, the pixel including no third sub pixel 49G and the pixel including no fourth sub pixel 49R are alternately arranged, and the pixel array is arbitrary as long as the averaging process described in the first embodiment is performed. For example, as described above, the display device 10 can suppress deterioration of an image when the averaging process described in the first embodiment is performed even in the pixel array of the image display panel 40Y.

As described above, for example, the display device 10 may have a so-called BW thinning configuration in which the pixel including no first sub pixel 49B and the pixel including no second sub pixel 49W are arranged. In this case, a display device 10Z of the BW thinning has the following configuration.

In other words, an image display panel 40Z of the display device 10Z includes a pixel 48ZA and a pixel 48ZB that belong to the same pixel unit 48 and are adjacent to each other. The pixel 48ZA includes a first sub pixel 49ZR, a second sub pixel 49ZG, and the third sub pixel 49B. The pixel 48ZB includes the first sub pixel 49ZR, the second sub pixel 49ZG, and the fourth sub pixel 49ZW. The first sub pixel 49ZR displays red, the second sub pixel 49ZG displays green, the third sub pixel 49B displays blue, and the fourth sub pixel 49ZW displays yellow.

A signal processing unit 20Z of the display device 10Z obtains an output signal of the first sub pixel 49ZR of the pixel 48ZA based on an input signal of the first sub pixel 49ZR of the pixel 48ZA, and outputs the output signal to the first sub pixel 49ZR of the pixel 48ZA. The signal processing unit 20Z obtains an output signal of the second sub pixel 49ZG of the pixel 48ZA based on an input signal of the second sub pixel 49ZG of the pixel 48ZA, and outputs the output signal to the second sub pixel 49ZG of the pixel 48ZA. The signal processing unit 20Z obtains an output signal of the first sub pixel 49ZR of the pixel 48ZB based on an input signal of the first sub pixel 49ZR of the pixel 48ZB, and outputs the output signal to the first sub pixel 49ZR of the pixel 48ZB. The signal processing unit 20Z obtains an output signal of the second sub pixel 49ZG of the pixel 48ZB based on an input signal of the second sub pixel 49ZG of the pixel 48ZB, and outputs the output signal to the second sub pixel 49ZG of the pixel 48ZB.

The signal processing unit 20Z obtains a corrected output signal of a third sub pixel 49ZB of the pixel 48ZA based on an input signal of the third sub pixel 49ZB of the pixel 48ZA and an input signal of the third sub pixel 49ZB of the pixel 48ZB, and outputs the corrected output signal to the third sub pixel 49ZB of the pixel 48ZA. The signal processing unit 20Z obtains a corrected output signal of a fourth sub pixel 49ZW of the pixel 48ZB based on an input signal of the first sub pixel 49ZR of the pixel 48ZA, an input signal of the second sub pixel 49ZG of the pixel 48ZA, an input signal of the third sub pixel 49ZB of the pixel 48ZA, an input signal of the first sub pixel 49ZR of the pixel 48ZB, an input signal of the second sub pixel 49ZG of the pixel 48ZB, and an input signal of the third sub pixel 49ZB of the pixel 48ZB, and outputs the corrected output signal to the fourth sub pixel 49ZW of the pixel 48ZB. In other words, the signal processing unit 20Z calculates the generation signal of the fourth sub pixel 49ZW in the same manner as the second sub pixel 49W according to the first embodiment, and calculates the corrected output signal of the fourth sub pixel 49ZW in the same manner as the averaging process according to the first embodiment.

First Modification

The display device 10 according to the first embodiment described above is a reflective liquid crystal display device. The display device 10 according to the first embodiment described above may be an image display device of any other type. A display device 10*g* according to the first modification is a transmissive liquid crystal display device.

Figure 24:
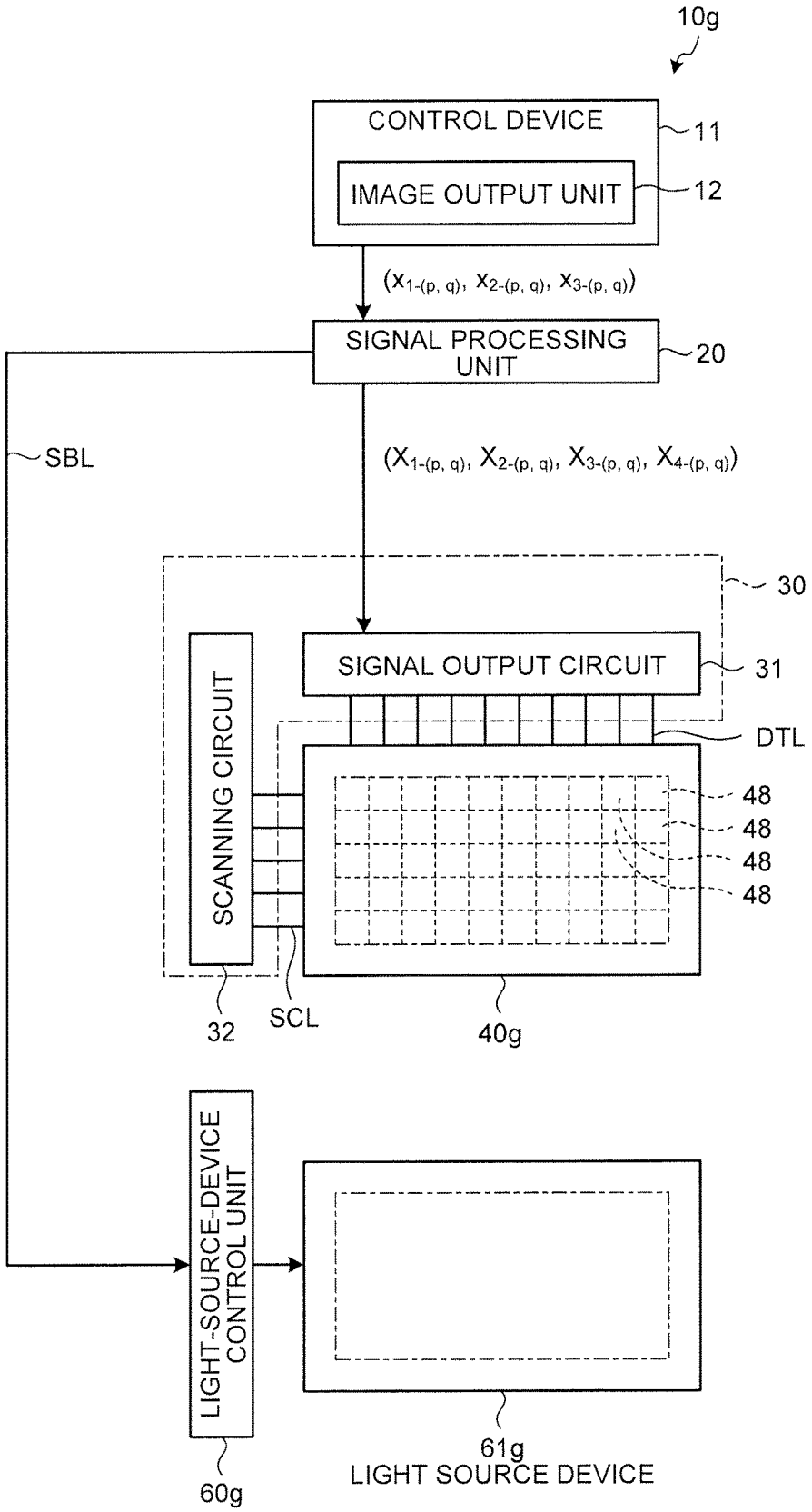
FIG. 24 is a block diagram illustrating an example of a configuration of a display device according to a first modification.

FIG. 24 is a block diagram illustrating an example of a configuration of the display device according to the first modification. The display device 10*g* according to the first modification includes the signal processing unit 20, the image-display-panel driving unit 30, an image display panel 40*g*, a light-source-device control unit 60*g*, and a light source device 61*g* as illustrated in FIG. 24. The signal processing unit 20 transfers a signal to the respective units of the display device 10*g*, the image-display-panel driving unit 30 controls driving of the image display panel 40*g* based on the signal received from the signal processing unit 20, the image display panel 40*g* displays an image based on a signal received from the image-display-panel driving unit 30, the light-source-device control unit 60*g* controls driving of the light source device 61*g* based on the signal received from the signal processing unit 20, and the light source device 61*g* illuminates the image display panel 40*g* from the back surface based on a signal of the light-source-device control unit 60*g*. Thus, the display device 10*g* displays an image.

The light source device 61*g* is arranged at the back surface side of the image display panel 40*g*, and light is emitted toward the image display panel 40*g* according to control of the light-source-device control unit 60*g* to illuminate the image display panel 40*g*, so that an image is displayed. The light source device 61*g* emits light toward the image display panel 40*g* to make the image display panel 40*g* brighter.

The light-source-device control unit 60*g* controls, for example, a quantity of light output from the light source device 61*g*. Specifically, the light-source-device control unit 60*g* controls a quantity of light (intensity of light) illuminating the image display panel 40*g* by adjusting, for example, a voltage supplied to the light source device 61*g* according to a pulse width modulation (PWM) based on a light-source-device control signal SBL output from a signal processing unit 20*g*.

The display device 10*g* calculates the expansion coefficient $\alpha$ from the corrected input signal by performing the same expansion process as in the display device 10 according to the first embodiment, and generates the output signal from the input signal and the expansion coefficient $\alpha$.

In the display device 10*g*, the output signal is expanded $\alpha$ times. In order to cause illuminance of an image to be the same as luminance of an image in a non-expanded state, there are cases in which the display device 10*g* reduces the luminance of the light source device 61*g* based on the expansion coefficient $\alpha$. Specifically, the display device 10*g* causes the luminance of the light source device 61*g* to be $(1/\alpha)$ times. As a result, the display device 10*g* can reduce the power consumption of the light source device 61*g*. The signal processing unit 20 outputs $(1/\alpha)$ to the light-source-device control unit 60*g* as the light-source-device control signal SBL.

The image display panel according to the first embodiment employs a so-called RG thinning configuration in which each pixel includes neither the third sub pixel 49G nor the fourth sub pixel 49R. On the other hand, in the first modification, the image display panel 40*g* employs a so-called BW thinning configuration in which there is neither the first sub pixel 49B nor the second sub pixel 49W. It is possible to select a sub pixel that is not arranged in each pixel arbitrarily.

Second Modification

The pixel array of the image display panel 40 according to the first embodiment can be applied even to a light-emitting image display device. A display device 10*h* according to the second modification includes a light-emitting image display panel 40*h* employing an organic light-emitting diode (OLED).

Figure 25:
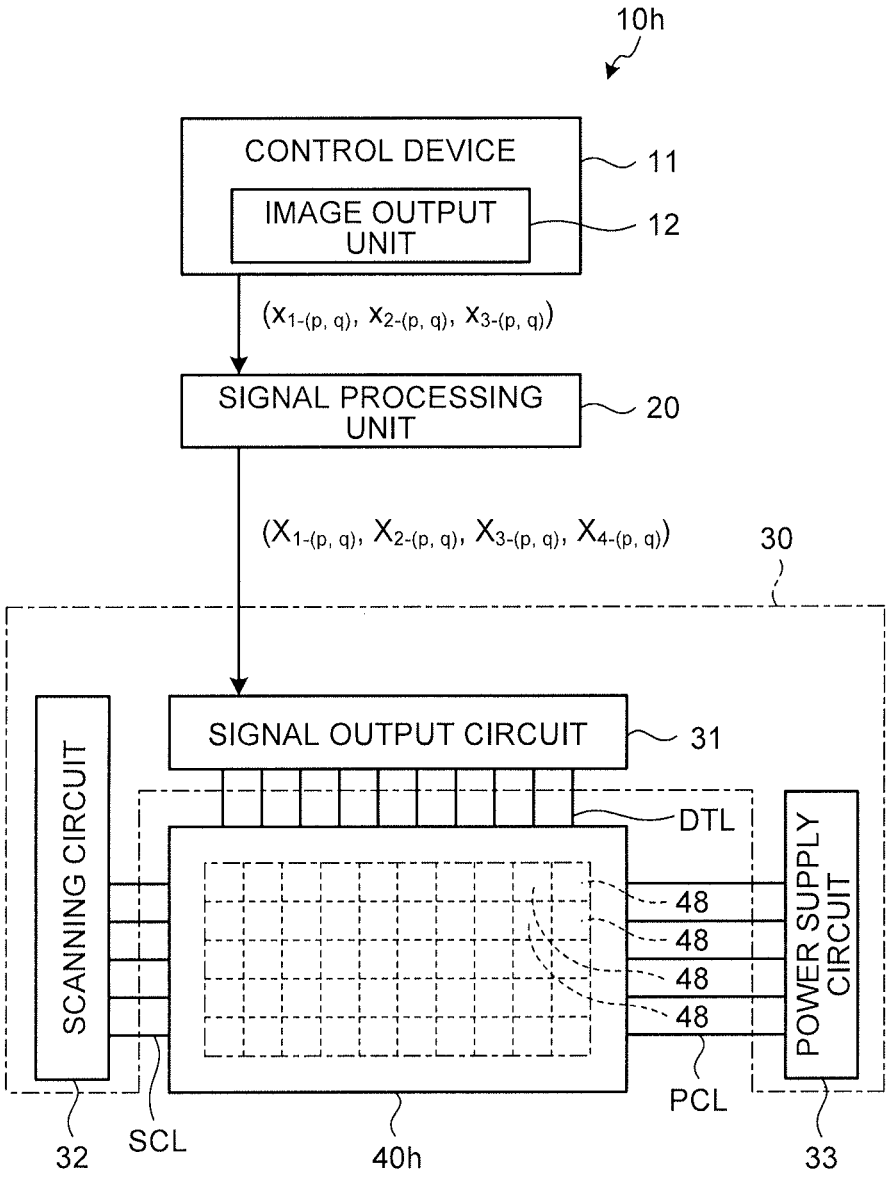
FIG. 25 is a block diagram illustrating an example of a configuration of a display device according to a second modification.
Figure 26:
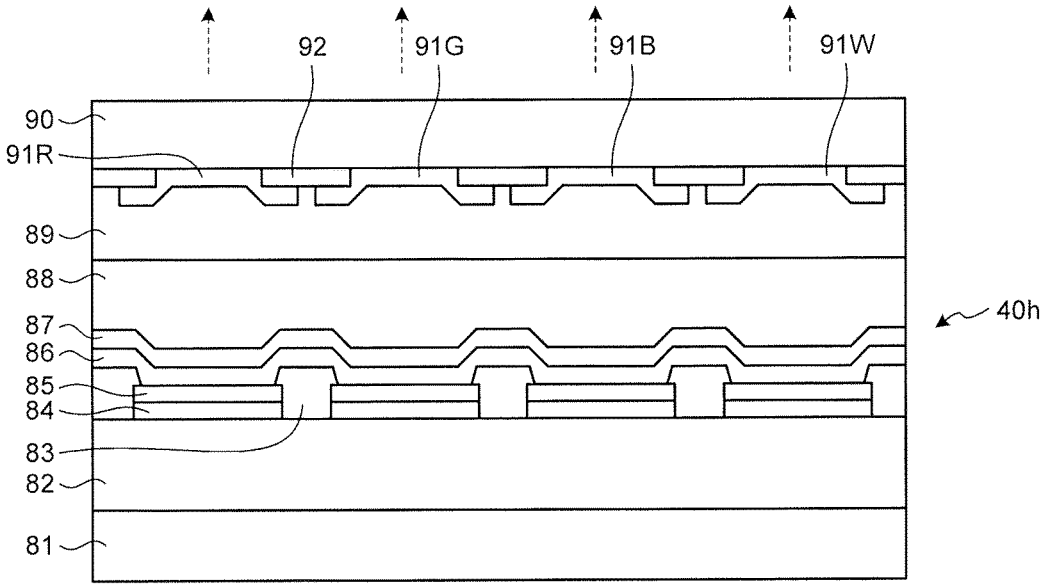
FIG. 26 is a cross-sectional view schematically illustrating a structure of an image display panel according to the second modification.

FIG. 25 is a block diagram illustrating an example of a configuration of a display device according to a second modification. FIG. 26 is a cross-sectional view schematically illustrating a structure of an image display panel according to the second modification. The display device 10*h* according to the second modification includes a power supply circuit 33 and an image display panel 40*h* as illustrated in FIG. 25. The power supply circuit 33 supplies electric power to a light-emitting layer which will be described later through a power line PCL.

The image display panel 40*h* includes a substrate 81, insulating layers 82 and 83, a reflecting layer 84, a lower electrode 85, a light-emitting layer 86, an upper electrode 87, an insulating layer 88, an insulating layer 89, color filters 91B, 91W, 91G, and 91R, a black matrix 92, and a substrate 90 as illustrated in FIG. 26. The substrate 81 is a substrate on which the respective components of the image display panel 40*h* are formed or held. The insulating layer 82 is a passivation film having an insulation property for protecting an electrode and the like. The insulating layer 83 is an insulating layer that is called a bank and divides the respective sub pixels 49. The reflecting layer 84 reflects light from the light-emitting layer 86. A voltage is applied from the power supply circuit 33 to the lower electrode 85 and the upper electrode 87 to cause an organic light-emitting diode of the light-emitting layer 86 to emit light. The color filters 91R, 91G, 91B, and 91W pass the first to fourth colors, respectively. The black matrix 92 is a light-shielding layer. The substrate 90 is a substrate that holds the respective components of the image display panel 40*h* like the substrate 81.

The first and second modifications are examples, and the pixel array of the image display panel 40 according to the first embodiment can be applied to various other types of image display devices.

2. Application Examples

Figure 27:
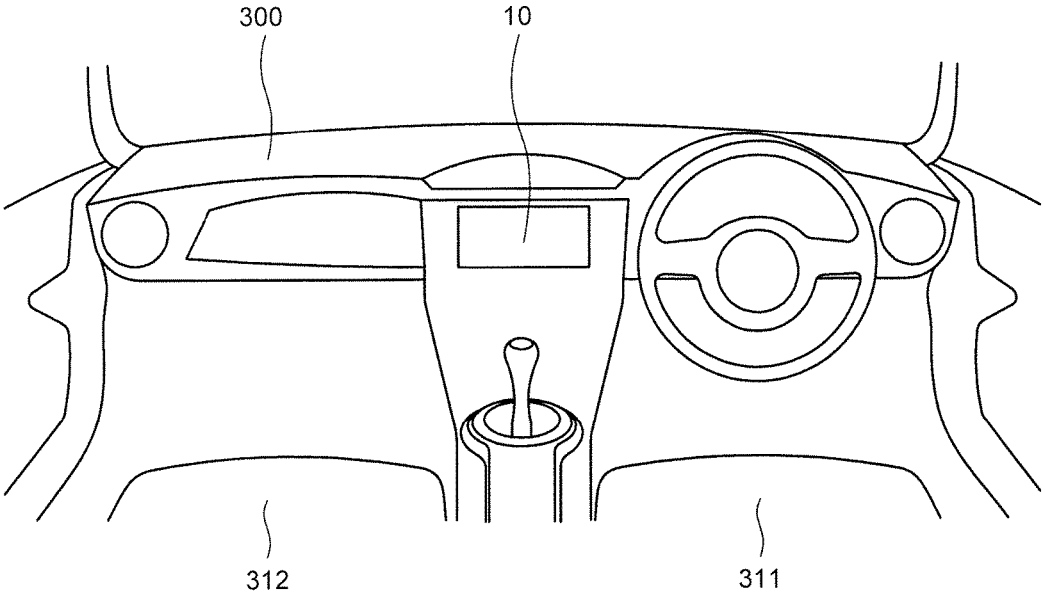
FIG. 27 is a diagram illustrating an example of an electronic apparatus to which the display device according to the first embodiment is applied.
Figure 28:
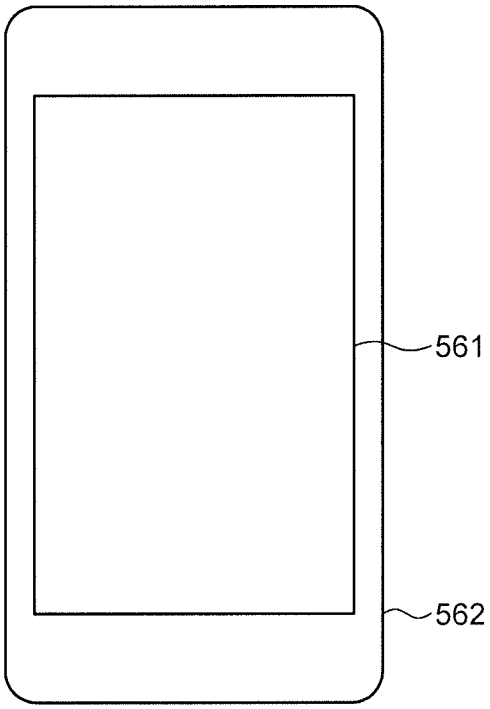
FIG. 28 is a diagram illustrating an example of an electronic apparatus to which the display device according to the first embodiment is applied.

Next, application examples of the display device 10 described in the first embodiment will be described with reference to FIGS. 27 and 28. FIGS. 27 and 28 are diagrams illustrating examples of an electronic apparatus to which the display device according to the first embodiment is applied. The display device 10 according to the first embodiment can be applied to all fields of electronic apparatuses such as a car navigation system illustrated in FIG. 27, a television device, a digital camera, a laptop personal computer, a portable terminal device such as a portable telephone illustrated in FIG. 28, a video camera, and the like. In other words, the display device 10 according to the first embodiment can be applied to all fields of electronic apparatuses that display a video signal input from the outside or a video signal generated inside as an image or a video. The electronic apparatus includes the control device 11 (see FIG. 1) that supplies the display device with the video signal, and controls an operation of the display device. The present application examples can be applied even to the display devices according to the other embodiments and the modifications in addition to the display device 10 according to the first embodiment.

The electronic apparatus illustrated in FIG. 27 is a car navigation device to which the display device 10 according to the first embodiment is applied. The display device 10 is installed on a dashboard 300 in a vehicle. Specifically, the display device 10 is installed at a portion of the dashboard 300 between a driver seat 311 and a passenger seat 312. The display device 10 of the car navigation device is used for a navigation display, a music operation screen display, a movie reproduction display, and the like.

The electronic apparatus illustrated in FIG. 28 is an portable information terminal to which the display device 10 according to the first embodiment is applied, and the portable information terminal operates a portable computer, a portable multi-function telephone, a portable computer with a voice call function, or a portable computer with a communication function and is called a smart phone or a tablet terminal as well. For example, the portable information terminal includes a display section 561 on the surface of a housing 562. The display section 561 includes the display device 10 according to the first embodiment and has a touch detection (so-called touch panel) function capable of detecting an external approaching object.

The embodiments and the modifications of the present invention have been described above, but the above embodiments and the like are not limited by content of the above embodiments or the like. A component which can be derived easily by those having skill in the art, substantially the same component, and a component of an equivalent scope are included as the above-described components. The above-described components can be appropriately combined. In addition, various omissions, replacements, or modifications of the components can be made within the scope not departing from the gist of the above embodiments or the like.

What is claimed is:

1. An image display device, comprising:

an image display panel in which pixel units each of which includes a first pixel and a second pixel are periodically arranged in a two dimensional matrix form, the first pixel including a first sub pixel displaying a first color, a second sub pixel displaying a second color, and a third sub pixel displaying a third color, the second pixel including the first sub pixel, the second sub pixel, and a fourth sub pixel displaying a fourth color, the second pixel being adjacent to the first pixel; and a signal processor configured to generate an output signal by converting an input value of an input signal into an extension value of a color space extended by the first color, the second color, the third color, and the fourth color, and configured to output the generated output signal to the image display panel, wherein the signal processor is configured to obtain an output signal of the first sub pixel of the first pixel based on an input signal of the first sub pixel of the first pixel, and is configured to output the output signal of the first sub pixel to the first sub pixel of the first pixel, the signal processor is configured to obtain an output signal of the second sub pixel of the first pixel based on the input signal of the first sub pixel, an input signal of the third sub pixel, and an input signal of the fourth sub pixel of the first pixel, and is configured to output the output signal of the second sub pixel to the second sub pixel of the first pixel, the signal processor is configured to obtain an output signal of the first sub pixel of the second pixel based on an input signal of the first sub pixel of the second pixel, and is configured to output the output signal of the first sub pixel to the first sub pixel of the second pixel, the signal processor is configured to obtain an output signal of the second sub pixel of the second pixel based on the input signal of the first sub pixel, the input signal of the third sub pixel, and the input signal of the fourth sub pixel of the second pixel, and is configured to output the output signal of the second sub pixel to the second sub pixel of the second pixel, the signal processor is configured to obtain a corrected output signal of the third sub pixel of the first pixel based on the input signal of the third sub pixel of the first pixel and the input signal of the third sub pixel of the second pixel of the same pixel unit, and is configured to output the corrected output signal of the third sub pixel to the third sub pixel of the first pixel, the signal processor is configured to obtain a corrected output signal of the fourth sub pixel of the second pixel based on the input signal of the fourth sub pixel of the first pixel of the same pixel unit and the input signal of the fourth sub pixel of the second pixel, and is configured to output the corrected output signal of the fourth sub pixel to the fourth sub pixel of the second pixel.

2. The image display device according to claim 1, wherein the signal processor is configured to use only the input signal of the third sub pixel of the first pixel and the input signal of the third sub pixel of the second pixel of the same pixel unit as input signals used for obtaining the corrected output signal of the third sub pixel of the first pixel, and is configured to use only the input signal of the fourth sub pixel of the first pixel of the same pixel unit and the input signal of the fourth sub pixel of the second pixel as input signals used for obtaining the corrected output signal of the fourth sub pixel of the second pixel.

3. The image display device according to claim 1, wherein the signal processor is configured to receive the input signal of the first sub pixel having a signal value of $x_{1A-(p,q)}$, the input signal of the third sub pixel having a signal value of $X_{3A-(p,q)}$, and the input signal of the fourth sub pixel having a signal value of $x_{4A-(p,q)}$ for the first pixel configuring a (p,q)-th pixel unit, the signal processor is configured to receive the input signal of the first sub pixel having a signal value of $x_{1B-(p,q)}$, the input signal of the third sub pixel having a signal value of $x_{3B-(p,q)}$, and the input signal of the fourth sub pixel having a signal value of $x_{4B-(p,q)}$ for the second pixel configuring the (p,q)-th pixel unit, the signal processor is configured to output the output signal of the first sub pixel that has a signal value of $X_{1A-(p,q)}$ and is used to decide a display gradation of the first sub pixel, the output signal of the second sub pixel that has a signal value of $X_{2A-(p,q)}$ and is used to decide a display gradation of the second sub pixel, and the corrected output signal of the third sub pixel that has a signal value of $XA_{3A-(p,q)}$ and is used to decide a display gradation of the third sub pixel to the first pixel configuring the (p,q)-th pixel unit, and the signal processor is configured to output the output signal of the first sub pixel that has a signal value of $X_{1B-(p,q)}$ and is used to decide a display gradation of the first sub pixel, the output signal of the second sub pixel that has a signal value of $X_{2B-(p,q)}$ and is used to decide a display gradation of the second sub pixel, and the corrected output signal of the fourth sub pixel that has a signal value of $XB_{4B-(p,q)}$ and is used to decide a display gradation of the fourth sub pixel to the second pixel configuring the (p,q)-th pixel unit, wherein, when a number P of the pixel units are arranged in a first direction and a number Q of the pixel units are arranged in a second direction of the two dimensional matrix form, (p,q) refers to the pth pixel unit in the first direction and the qth pixel unit in the second direction, where $1 \le p \le P$ and $1 \le q \le Q$.

4. The image display device according to claim 3, wherein the signal processor is configured to obtain the signal value $XA_{3A-(p,q)}$ of the corrected output signal of the third sub pixel of the first pixel based on a generation signal value $X_{3A-(p,q)}$ of the third sub pixel of the first pixel obtained based on an input signal value $x_{3A-(p,q)}$ of the third sub pixel of the first pixel and a generation signal value $X_{3B-(p,q)}$ of the third sub pixel of the second pixel obtained based on an input signal value $x_{3B-(p,q)}$ of the third sub pixel of the second pixel, the signal processor is configured to obtain the signal value $XB_{4B-(p,q)}$ of the corrected output signal of the fourth sub pixel of the second pixel based on a generation signal value $X_{4A-(p,q)}$ of the fourth sub pixel of the first pixel obtained based on an input signal value $x_{4A-(p,q)}$ of the fourth sub pixel of the first pixel and a generation signal value $x_{4B-(p,q)}$ of the fourth sub pixel of the second pixel obtained based on an input signal value $X_{4B-(p,q)}$ of the fourth sub pixel of the second pixel, the signal value $XA_{3A-(p,q)}$ of the corrected output signal of the third sub pixel of the first pixel is equal to or larger than a smaller value of the generation signal value $X_{3A-(p,q)}$ of the third sub pixel of the first pixel and the generation signal value $X_{3B-(p,q)}$ of the third sub pixel of the second pixel, and equal to or less than a larger value of the generation signal value $X_{3A-(p,q)}$ of the third sub pixel of the first pixel and the generation signal value $X_{3B-(p,q)}$ of the third sub pixel of the second pixel, and the signal value $XB_{4B-(p,q)}$ of the corrected output signal of the fourth sub pixel of the second pixel is equal to or larger than a smaller value of the generation signal value $X_{4A-(p,q)}$ of the fourth sub pixel of the first pixel and the generation signal value $X_{4B-(p,q)}$ of the fourth sub pixel of the second pixel, and equal to or less than a larger value of the generation signal value $X_{4A-(p,q)}$ of the fourth sub pixel of the first pixel and the generation signal value $X_{4B-(p,q)}$ of the fourth sub pixel of the second pixel.

5. The image display device according to claim 4, wherein the signal value $XA_{3A-(p,q)}$ of the corrected output signal of the third sub pixel of the first pixel is obtained from an average of the generation signal value $X_{3A-(p,q)}$ of the third sub pixel of the first pixel and the generation signal value $X_{3B-(p,q)}$ of the third sub pixel of the second pixel, and the signal value $XB_{4B-(p,q)}$ of the corrected output signal of the fourth sub pixel of the second pixel is obtained from an average of the generation signal value $X_{4A-(p,q)}$ of the fourth sub pixel of the first pixel and the generation signal value $X_{4B-(p,q)}$ of the fourth sub pixel of the second pixel.

6. The image display device according to claim 5, wherein when f and g are coefficients, the signal value $XA_{3A-(p,q)}$ of the corrected output signal of the third sub pixel of the first pixel is obtained by $$XA_{3A-(p,q)}=(f\cdot X_{3A-(p,q)}+g\cdot X_{3B-(p,q)})/(f+g)\text{, and}$$

when h and i are coefficients, the signal value $XB_{4B-(p,q)}$ of the corrected output signal of the fourth sub pixel of the second pixel is obtained by $$XA_{4B-(p,q)}=(h\cdot X_{4A-(p,q)}+i\cdot X_{4B-(p,q)})/(h+i).$$

7. The image display device according to claim 3, wherein the signal value $X_{2A-(p,q)}$ of the output signal of the second sub pixel of the first pixel configuring the (p,q)-th pixel unit is obtained from $MinA_{(p,q)}$ serving as a minimum value of $x_{1A-(p,q)}$, $x_{3A-(p,q)}$, and $x_{4A-(p,q)}$, and the signal value $X_{2B-(p,q)}$ of the output signal of the second sub pixel of the second pixel configuring the (p,q)-th pixel unit is obtained from $MinB_{(p,q)}$ serving as a minimum value of $x_{1B-(p,q)}$, $x_{3B-(p,q)}$ and $x_{4B-(p,q)}$.

8. The image display device according to claim 7, wherein when $\chi$ is a constant depending on an image display device, the signal processor is configured to obtain a maximum value $V_{max}(S)$ of brightness in which a saturation S is a variable in an HSV color space extended by adding the second color, (a) the signal processor is configured to obtain the saturation S and a brightness V(S) of a plurality of pixels based on the input signal values of the sub pixels in a plurality of pixels, (b) the signal processor is configured to obtain an expansion coefficient $\alpha$ based on at least one value among values of $V_{max}(S)/V(S)$ obtained for a plurality of pixels, (c) the signal processor is configured to obtain the output signal value $X_{1A-(p,q)}$ of the first sub pixel in a (p,q)-th first pixel based on the input signal value $x_{1A-(p,q)}$ of the first sub pixel, the signal value $X_{2A-(p,q)}$ of the output signal of the second sub pixel, the expansion coefficient $\alpha$, and the constant $\chi$, the signal processor is configured to obtain the generation signal value $X_{3A-(p,q)}$ of the third sub pixel in the (p,q)-th first pixel based on the input signal value $X_{3A-(p,q)}$ of the third sub pixel, the signal value $X_{2A-(p,q)}$ of the output signal of the second sub pixel, the expansion coefficient α, and the constant χ, the signal processor is configured to obtain the generation signal value $X_{4A-(p,q)}$ of the fourth sub pixel in the (p,q)-th first pixel based on the input signal value $X_{4A-(p,q)}$ of the fourth sub pixel, the signal value $X_{2A-(p,q)}$ of the output signal of the second sub pixel, the expansion coefficient α, and the constant χ, the signal processor is configured to obtain the output signal value $X_{1B-(p,q)}$ of the first sub pixel in a (p,q)-th second pixel based on the input signal value $x_{1B-(p,q)}$ of the first sub pixel, the signal value $X_{2B-(p,q)}$ of the output signal of the second sub pixel, the expansion coefficient α, and the constant χ, the signal processor is configured to obtain the generation signal value $X_{3B-(p,q)}$ of the third sub pixel in the (p,q)-th second pixel based on the input signal value $x_{3B-(p,q)}$ of the third sub pixel, the signal value $X_{2B-(p,q)}$ of the output signal of the second sub pixel, the expansion coefficient α, and the constant χ, and the signal processor is configured to obtain the generation signal value $X_{4B-(p,q)}$ of the fourth sub pixel in the (p,q)-th second pixel based on the input signal value $x_{4B-(p,q)}$ of the fourth sub pixel, the signal value $X_{2B-(p,q)}$ of the output signal of the second sub pixel, the expansion coefficient α, and the constant χ, when the saturation S of the (p,q)-th first pixel is $S_{A(p,q)}$, the brightness V(S) of the (p,q)-th first pixel is $V_{A(p,q)}$, the saturation S of the (p,q)-th second pixel is $S_{B(p,q)}$, and the brightness V(S) of the (p,q)-th second pixel is $V_{B(p,q)}$, $$S_{A(p,q)}=(\mathrm{Max}_{A(p,q)}-\mathrm{Min}_{A(p,q)})/\mathrm{Max}_{A(p,q)},$$

$$V_{A(p,q)}=\mathrm{Max}_{A(p,q)},$$

$$S_{B(p,q)}=(\mathrm{Max}_{B(p,q)}-\mathrm{Min}_{B(p,q)})/\mathrm{Max}_{B(p,q)}, \text{ and}$$

$$V_{B(p,q)}=\mathrm{Max}_{B(p,q)},$$

wherein $\mathrm{Max}_{A(p,q)}$ is a maximum value of the input signals $x_{1A-(p,q)}$, $x_{3A-(p,q)}$, and $x_{4A-(p,q)}$ of the (p,q)-th first pixel, $\mathrm{Min}_{A(p,q)}$ is a minimum value of the input signals $x_{1A-(p,q)}$, $x_{3A-(p,q)}$, and $x_{4A-(p,q)}$ of the (p,q)-th first pixel, $\mathrm{Max}_{B(p,q)}$ is a maximum value of the input signals $x_{1B-(p,q)}$, $x_{3B-(p,q)}$, and $x_{4B-(p,q)}$ of the (p,q)-th second pixel, and $\mathrm{Min}_{B(p,q)}$ is a minimum value of the input signals $x_{1B-(p,q)}$, $x_{3B-(p,q)}$, and $x_{4B-(p,q)}$ of the (p,q)-th second pixel.

9. The image display device according to claim 1, wherein in the image display panel, a region of the image display panel in which an image is displayed is divided in a two dimensional matrix form in units of pixel display regions serving as a region in which a color is displayed based on color information included in each input signal input to the image display panel, the pixel display region includes a first pixel display region and a second pixel display region adjacent to the first pixel display region, the first sub pixel and the second sub pixel of the first pixel, one part of the third sub pixel, and one part of the fourth sub pixel are arranged in the first pixel display region, the first sub pixel and the second sub pixel of the second pixel, the other part of the third sub pixel, and the other part of the fourth sub pixel are arranged in the second pixel display region.

10. The image display device according to claim 9, wherein the first pixel includes the first and second sub pixels that are arranged in a first row extending in a row direction and adjacent to each other in the row direction and the third sub pixel that is arranged in a second row next to the first row and adjacent to the first sub pixel or the second sub pixel in a column direction different from the row direction, the second pixel includes the fourth sub pixel that is arranged in the second row and adjacent to the third sub pixel in the row direction and the first and second sub pixels that are arranged in a third row arranged next to the second row and adjacent to each other in the row direction, a region in which the first sub pixel and the second sub pixel of the first pixel are arranged, a first row side region of regions obtained by dividing the third sub pixel into two in the column direction, and a first row side region of regions obtained by dividing the fourth sub pixel into two in the column direction are arranged in the first pixel display region, and a region in which the first sub pixel and the second sub pixel of the second pixel are arranged, a third row side region of regions obtained by dividing a region in which the third sub pixel is arranged into two in the column direction, and a third row side region of regions obtained by dividing the fourth sub pixel into two in the column direction are arranged in the second pixel display region.

11. The image display device according to claim 1, wherein the first sub pixel displays blue, the second sub pixel displays white, the third sub pixel displays green, and the fourth sub pixel displays red.

12. An electronic apparatus, comprising:

the image display device according to claim 1; and a controller configured to supply the input signal to the display device.

13. An image display device, comprising:

an image display panel in which pixel units each of which includes a first pixel and a second pixel are periodically arranged in a two dimensional matrix form, the first pixel including a first sub pixel displaying a first color, a second sub pixel displaying a second color, and a third sub pixel displaying a third color, the second pixel including the first sub pixel, the second sub pixel, and a fourth sub pixel displaying a fourth color, the second pixel being adjacent to the first pixel; and a signal processor configured to generate an output signal by converting an input value of an input signal into an extension value of a color space extended by the first color, the second color, the third color, and the fourth color, and configured to output the generated output signal to the image display panel, wherein the signal processor is configured to obtain an output signal of the first sub pixel of the first pixel based on an input signal of the first sub pixel of the first pixel, and is configured to output the output signal of the first sub pixel to the first sub pixel of the first pixel, the signal processor is configured to obtain an output signal of the second sub pixel of the first pixel based on an input signal of the second sub pixel of the first pixel, and is configured to output the output signal of the second sub pixel to the second sub pixel of the first pixel, the signal processor is configured to obtain an output signal of the first sub pixel of the second pixel based on an input signal of the first sub pixel of the second pixel, and is configured to output the output signal of the first sub pixel to the first sub pixel of the second pixel, the signal processor is configured to obtain an output signal of the second sub pixel of the second pixel based on an input signal of the second sub pixel of the second pixel, and is configured to output the output signal of the second sub pixel to the second sub pixel of the second pixel, the signal processor is configured to obtain a corrected output signal of the third sub pixel of the first pixel based on an input signal of the third sub pixel of the first pixel and an input signal of the third sub pixel of the second pixel, and is configured to output the corrected output signal of the third sub pixel to the third sub pixel of the first pixel, and the signal processor is configured to obtain a corrected output signal of the fourth sub pixel of the second pixel based on an input signal of the first sub pixel, an input signal of the second sub pixel, and an input signal of the third sub pixel of the first pixel and an input signal of the first sub pixel, an input signal of the second sub pixel, and an input signal of the third sub pixel of the second pixel, and is configured to output the corrected output signal of the fourth sub pixel to the fourth sub pixel of the second pixel.

14. A method for driving an image display device including an image display panel in which pixel units each of which includes a first pixel and a second pixel are periodically arranged in a two dimensional matrix form, the first pixel including a first sub pixel displaying a first color, a second sub pixel displaying a second color, and a third sub pixel displaying a third color, the second pixel including the first sub pixel, the second sub pixel, and a fourth sub pixel displaying a fourth color, the second pixel being adjacent to the first pixel, and a signal processor that generates an output signal by converting an input value of an input signal into an extension value of a color space extended by the first color, the second color, the third color, and the fourth color, and outputs the generated output signal to the image display panel, the method comprising:

obtaining an output signal of the first sub pixel of the first pixel based on an input signal of the first sub pixel of the first pixel and outputting the output signal of the first sub pixel to the first sub pixel of the first pixel, obtaining an output signal of the second sub pixel of the first pixel based on the input signal of the first sub pixel, an input signal of the third sub pixel, and an input signal of the fourth sub pixel of the first pixel and outputting the output signal of the second sub pixel to the second sub pixel of the first pixel, obtaining an output signal of the first sub pixel of the second pixel based on an input signal of the first sub pixel of the second pixel and outputting the output signal of the first sub pixel to the first sub pixel of the second pixel, obtaining an output signal of the second sub pixel of the second pixel based on the input signal of the first sub pixel, the input signal of the third sub pixel, and the input signal of the fourth sub pixel of the second pixel and outputting the output signal of the second sub pixel to the second sub pixel of the second pixel, obtaining a corrected output signal of the third sub pixel of the first pixel based on the input signal of the third sub pixel of the first pixel and the input signal of the third sub pixel of the second pixel and outputting the corrected output signal of the third sub pixel to the third sub pixel of the first pixel, obtaining a corrected output signal of the fourth sub pixel of the second pixel based on the input signal of the fourth sub pixel of the first pixel and the input signal of the fourth sub pixel of the second pixel and outputting the corrected output signal of the fourth sub pixel to the fourth sub pixel of the second pixel.

* * * * *